US007373959B2

(12) United States Patent
Edwards et al.

(10) Patent No.: US 7,373,959 B2
(45) Date of Patent: May 20, 2008

(54) APPARATUS AND METHOD FOR ASEPTIC SERIAL FILLING OF CONTAINERS

(75) Inventors: Simon Peter Edwards, Irvine, CA (US); Douglas Kent Stricklin, Brea, CA (US); Chester Savage, Irvine, CA (US); Donald E. Ripley, Oceanside, CA (US)

(73) Assignee: Scholle Corporation, Irvine, CA (US)

( * ) Notice: Subject to any disclaimer, the term of this patent is extended or adjusted under 35 U.S.C. 154(b) by 0 days.

(21) Appl. No.: 10/800,332

(22) Filed: Mar. 12, 2004

(65) Prior Publication Data

US 2005/0199313 A1 Sep. 15, 2005

(51) Int. Cl.
*B65B 1/04* (2006.01)

(52) U.S. Cl. ..... 141/114; 141/10; 141/313; 222/541.6; 220/265; 220/276

(58) Field of Classification Search ..... 141/10, 141/114, 313–316, 89–92; 222/105, 153.06, 222/541.6; 220/265–268, 276, 277; 53/471
See application file for complete search history.

(56) References Cited

U.S. PATENT DOCUMENTS 4,813,578 A * 3/1989 Gordon et al. ..... 222/541.1
5,000,359 A * 3/1991 Scholle et al. ..... 222/505
5,303,837 A * 4/1994 Adams et al. ..... 220/258.3
5,467,806 A 11/1995 Stricklin
5,743,313 A 4/1998 Josefsson
6,148,874 A 11/2000 Rutter
6,925,780 B1 8/2005 Anderson

FOREIGN PATENT DOCUMENTS

WO WO 00/00390 1/2000

* cited by examiner

*Primary Examiner*—Steven O. Douglas
(74) *Attorney, Agent, or Firm*—Watson IP Group, PLC; Jovan N. Jovanovic; Vladan M. Vasiljevic

(57) ABSTRACT

A flexible bag container (10) is filled by a system (500) and method for filling the bag container (10). The flexible bag container (10) has a pair of walls (12, 14) and a spout member (18) attached to one side wall of the container. This spout member is opened and closed in the filling system. A plug member (22) is inserted into the spout member (18) from outside of the bag container (10) and is withdrawable in the opposite direction in order to open the bag container. The bag container is filled via the spout member after removal of the plug member outwardly of the bag container and into a filling head, and then the plug member is replaced from within the filling head into the spout member to close the bag container.

39 Claims, 49 Drawing Sheets

FIG. 22
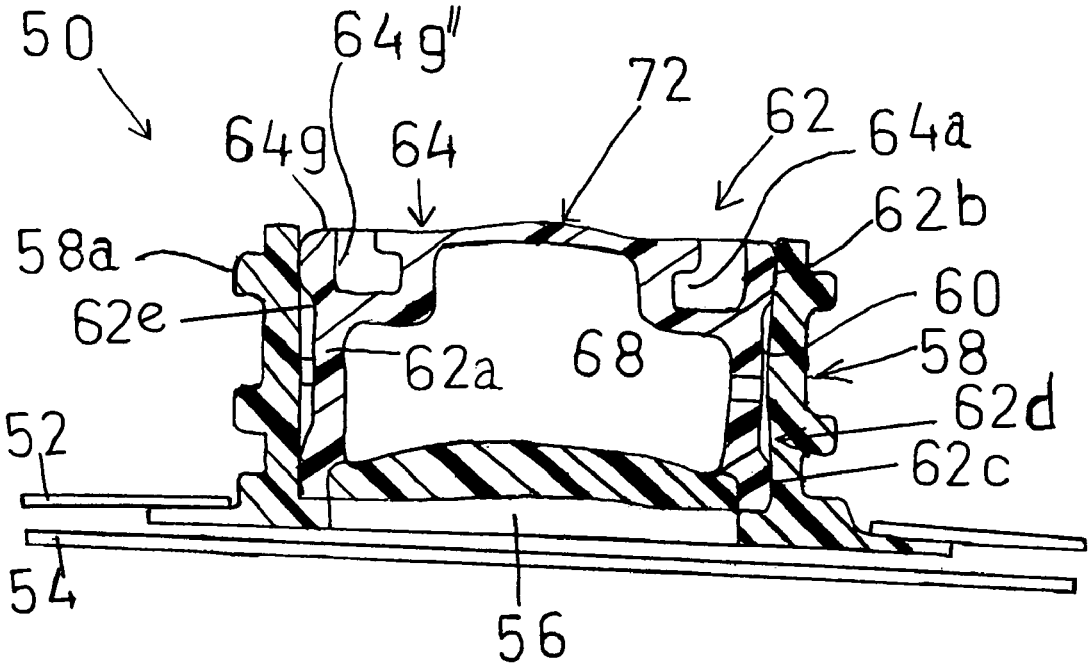
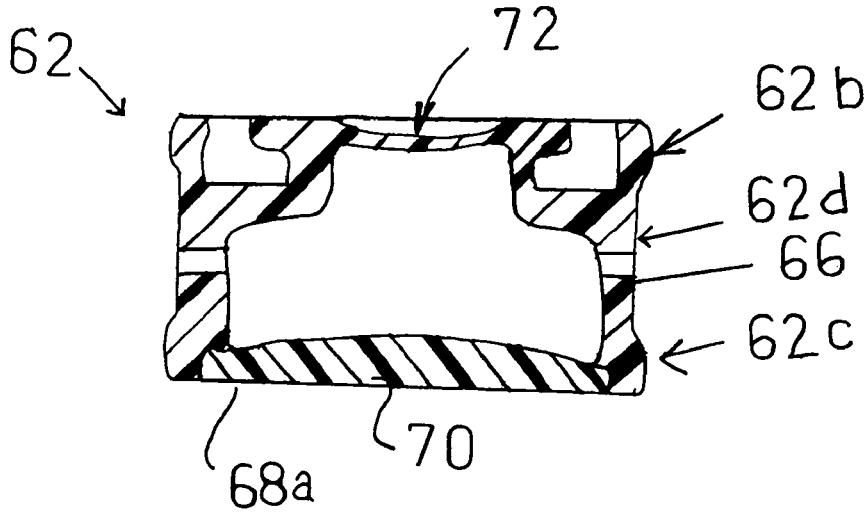
FIG. 23

1000

APPARATUS AND METHOD FOR ASEPTIC SERIAL FILLING OF CONTAINERS

CROSS REFERENCE TO RELATED APPLICATIONS

This application claims benefit of both U.S. provisional application Ser. No. 60/322,678, filed 13 Sep. 2001; and Ser. No. 60/329,075, filed 12 Oct. 2001, the entire contents of which are incorporated herein by reference, and of PCT application PCT/US02/29203, filed 13 Sep. 2002.

BACKGROUND OF THE INVENTION

Field of the Invention

This invention relates to filling of a material, which may be a food product, into a sterile container or package using aseptic methods and apparatus, although the invention is not so limited, so that the material may be stored and transported in the container. Some materials may be stored and transported under "extended shelf life" conditions, which means that refrigeration is applied. Other materials may be stored and transported without refrigeration. The filling methods and apparatus are not limited to aseptic conditions.

Many liquid, semi-liquid, and dry granular or powdered products, including food products, are packaged aseptically into containers of various sizes. Some of these containers are relatively large, and are used for bulk storage and distribution of the products to repackagers, commercial users, and other users of large quantities of product. Others of the packages may be smaller in size, and are intended for home or restaurant uses of the products so distributed.

Many of these products so packaged and distributed, particularly food products, deteriorate rapidly when exposed to oxygen, or if exposed to microbes in the environment. That is, food products especially must be protected against possible contamination from microbes, including mold spores and bacteria.

Therefore, these products are often placed in bags constructed from a plastic or similar material having one or more spouts by which the bag is filed with product and/or from which the product is dispensed from the bag. Sometimes the bag is simply cut open, and the spout is not used for dispensing. The plastic bag may be supported and protected within an outer rigid container, such as a drum, box, or crate. These plastic bag containers are advantageous in that as the product is dispensed from the container the bag collapses around the remaining material so that no air enters the container. On the other hand, with conventional containers of a fixed shape or fixed internal volume, air must enter the container to fill the space vacated by the removal of the product in order for the product to be dispensed. For example, as liquid is poured from the familiar gallon glass or plastic jug, air will gurgle into the jug. This air entering the container carries oxygen and may carry harmful microbes. Dispensing product from a bag type of container takes place with no air gurgling into the container. Thus, the bag type of container shields the product remaining in the container from oxygen and ambient microbes, and has many advantages when filled aseptically.

However, care must be taken when packaging food product into a container so that no (or substantially no) microbes or bacteria that would either cause the food product to spoil or which would possibly create a potential health hazard to the consumer of the food product, enter the container.

Conventionally, this necessary sterility is typically assured during filling, by placing the spout of the container inside a chamber containing a controlled environment. The controlled environment may include provision for exposure of the spout to a sterilizing gas or vapor, such as steam or another sterilant. An opening is provided in the chamber; which is just large enough to receive the spout of the bag. A positive pressure is maintained inside the chamber to keep ambient air from entering the chamber. Once the spout is placed in the opening to this chamber and a plug member is removed from the spout, it comes into contact with a filling head and the product is dispensed into the bag. Clamps or jaws are utilized to hold the spout in the correct position for filling as well as to provide a partial seal of the container opening during the filling process.

The gas charged system is a fill and dispense system for a flexible or rigid packaging container.

The gas charge system can be used for products classified as, but not limited to, low acid aseptic, high acid aseptic, extended shelf life (ESL), hot fill, and ambient fill, food product, and non-food product, fluid product, slurry product, or dry flowable product.

The gas charged system uses a charge or dose of high pressure gas, which may be inert gas or anti-bacterial gas, for example, to prevent the contamination of the empty or filled container as well as preventing contamination of product filled into the container.

The plug member of the gas charged system is charged with gas, and is fitted into a spout member. The combination of a plug member and spout member is termed a fitment. The fitment is welded into an aperture of a container, and the completed container is then irradiated, rendering the whole container sterile.

The sterile container(s) are shipped from a manufacturing location to a product processing location for filling. Each container is connected to a filling system, which fills the container, and recharges the gas charge of the plug member. The filled containers are then shipped to a location for use of the product. At the product use location, the containers are either connected to a filling system, which is used as a dispensing device, or a one-time dispense valve is employed to empty the container in one operation. The filling system when used as a dispensing device, is able to remove the plug member from the spout member, dispense a portion of the contents of the container, and replace the plug member in to the container while recharging the gas charge to safeguard the integrity of the remaining portion of the contents of the container.

The gas charge within the plug member prevents contaminants, including bacteria and other microbes, from entering the package via the fitment, because the gas charge is at a comparatively high pressure. The integrity of the sealing of the container may be checked by the provision of a pressure test diaphragm or button on the plug member.

According to one embodiment of the invention, the test button is molded as an integral part of the plug member, and is configured as a concave diaphragm portion, which becomes convex under the effect of the dose of pressurized gas charged into the plug member. Any loss of pressure from the gas charge is then apparent because of return of the test button to or toward a concave configuration.

SUMMARY OF THE INVENTION

In view of the deficiencies of the conventional related technology, it is an object of this invention to overcome or reduce one or more of these deficiencies.

Accordingly the present invention provides a bag wherein the bag has a spout member, and this spout member is closed by a cap member engageable with the spout member from the outside of the bag. This cap member is constructed of a yieldably shape-retaining material, and includes both a central plug portion, a radial flange portion extending outwardly from the plug portion, and a circumferential skirt or collar portion depending from an outer extent of the flange portion. This arrangement of a spout member with removable cap member makes it possible to open and then re-seal the container. While the container is opened, food product or other material is filled into the container under aseptic conditions.

An aspect of this invention is that the configuration of the cap member shields the interface of the spout member and plug portion during sterilization. That is, sterilization pressure cannot force microbes past the interface of the spout member and plug portion of the cap member.

According to the present invention, opening the container in preparation for filling it involves separating the cap member into a central plug portion and a skirt portion. The plug portion is removed from the spout member in order to allow material to be filled into the bag. The separated skirt portion remains on the outside of the spout member.

It is also an object of this invention to provide a bag filling apparatus for use with just such a flexible bag of the type defined by this invention; while providing during the filling process a substantially sterile isolation of the product filled into the bag, so as to not expose the product filled into the bag to ambient air and ambient microbes.

Accordingly this invention provides such a filling system consisting of a spout member gripping and elevating mechanism, a filling head, and a method of sterilizing an axial face of the cap member before separating the cap member into a plug portion and a collar portion, subsequent to which the plug portion is removed from the bag and product is filled into the bag via the spout member under substantially sterile conditions. Again, the invention is not limited to use of sterile conditions of filling. After filling of the bag, the plug portion is returned to the spout member to sealingly close the filled bag, preventing exposure of the material filled into the bag to ambient air.

Accordingly the present invention provides a container with a spout member and a plug member received in and closing the spout member. The plug member defines a circumferential chamber, and a pressurized barrier gas is received into this pressurized chamber.

A filling system is capable of cooperating with the plug member having the chamber for pressurized gas, to pressurize this chamber after filling the container, and upon returning the plug member to a position of sealing cooperation with the spout member.

Still further, the present invention provides a container with a spout member and a cap member including a plug portion similar to the plug member generally described above, with a circumferential chamber for receiving a pressurized barrier gas, and in which the cap member further includes a sacrificial skirt which provides a shield for the sealing interface of the plug portion and spout member during sterilization of a selected portion of the ambient-exposed external surface of the cap member.

Other objects, features, and advantages of the present invention will be apparent to those skilled in the art from a consideration of the following detailed description of several exemplary preferred embodiments thereof taken in conjunction with the associated figures which will first be described briefly.

BRIEF DESCRIPTION OF THE DRAWING FIGURES

FIG. 1 provides a fragmentary view of an empty sterile container of the bag type embodying the present invention, with the container including a spout member providing communication with a cavity within the container, and a cap member closing the spout member, and with the container being in preparatory alignment and spaced confrontation with a filling mechanism also embodying the present invention, all representing a step in the process of filling the container;

FIG. 1*a* is an enlarged fragmentary view of a portion of FIG. 1;

FIG. 1*b* is an enlarged fragmentary view of another portion of FIG. 1;

FIG. 2 provides a fragmentary view similar to that of FIG. 1, but with the container at a subsequent stage of engagement with the filling mechanism preparatory to filling of the container;

FIG. 2*a* is an enlarged fragmentary view of a portion of FIG. 2;

FIG. 3 also provides a fragmentary view, similar to FIGS. 1 and 2, but with the container and filling mechanism in a next-subsequent stage of preparation to filling the container;

FIG. 3*a* is an enlarged fragmentary view of a portion of FIG. 3;

Figure 13:
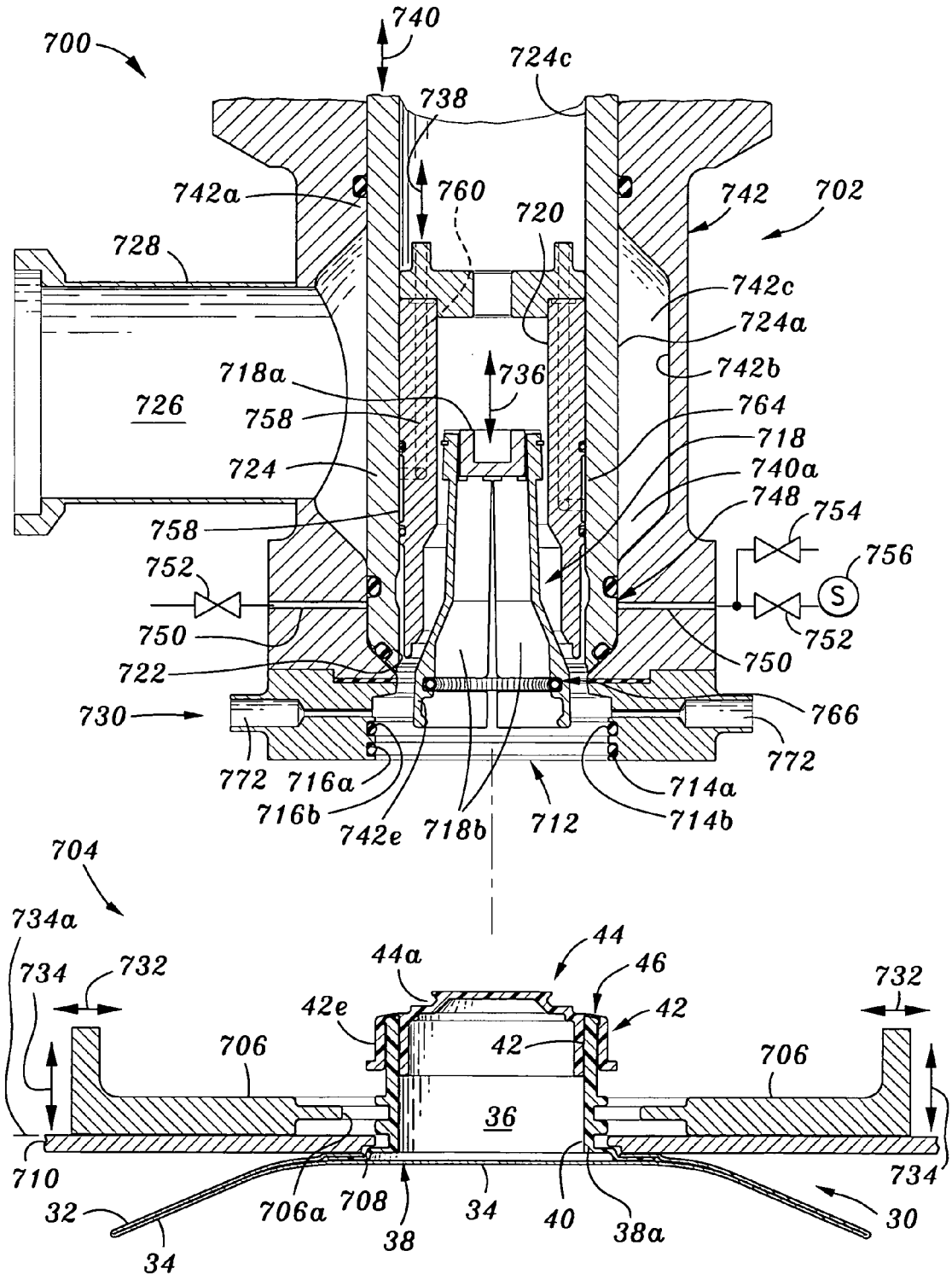
Figure 14:
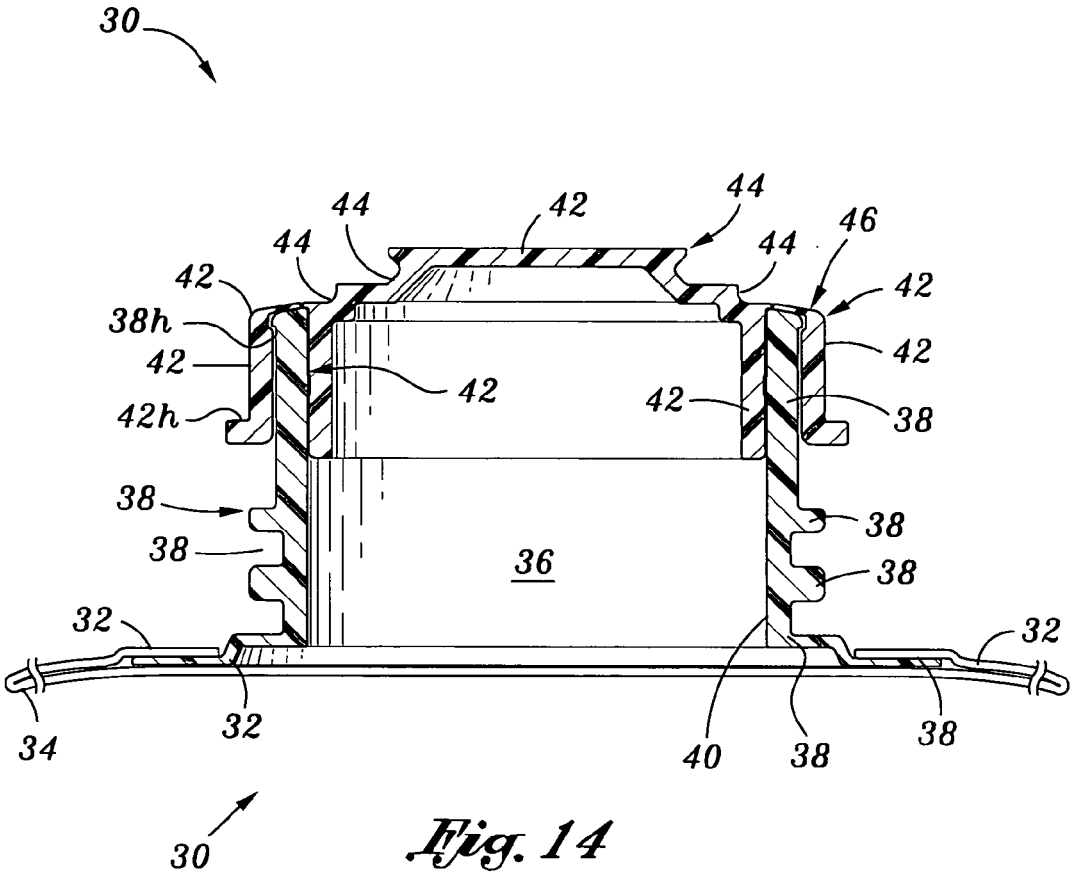
Figure 15:
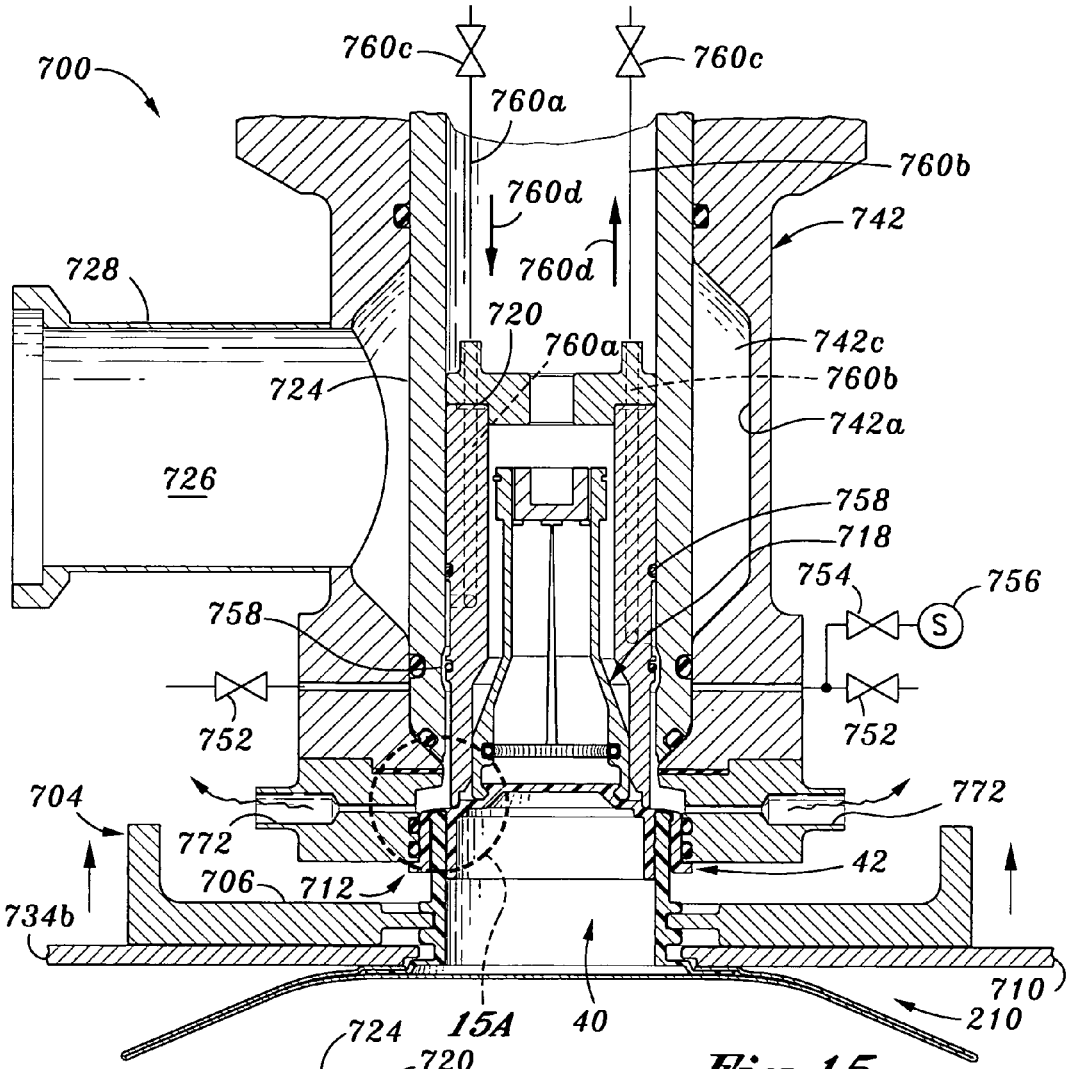
Figure 15A:
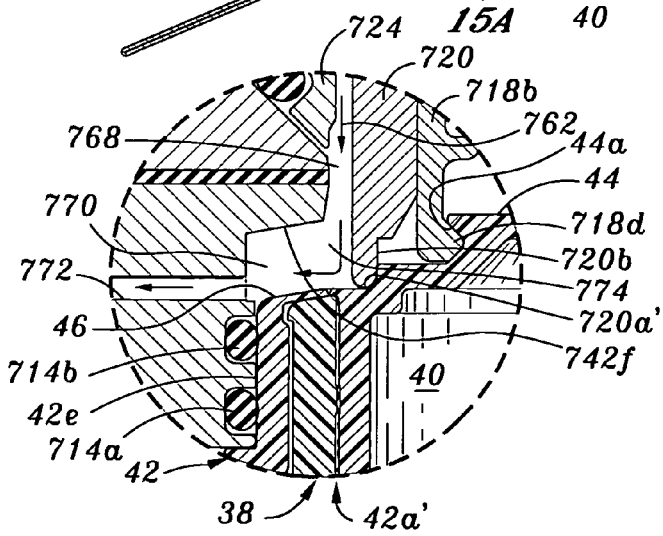
Figure 16:
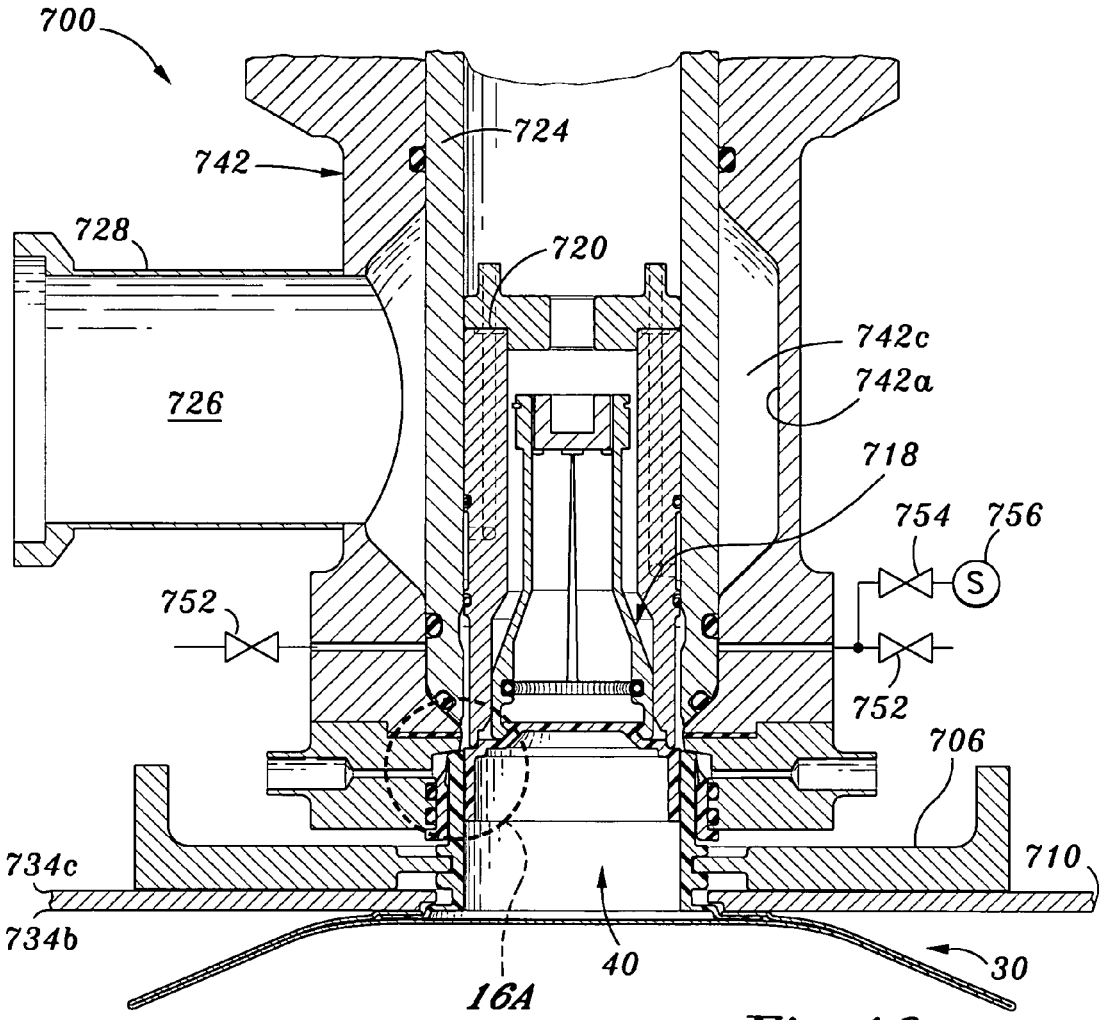
Figure 16A:
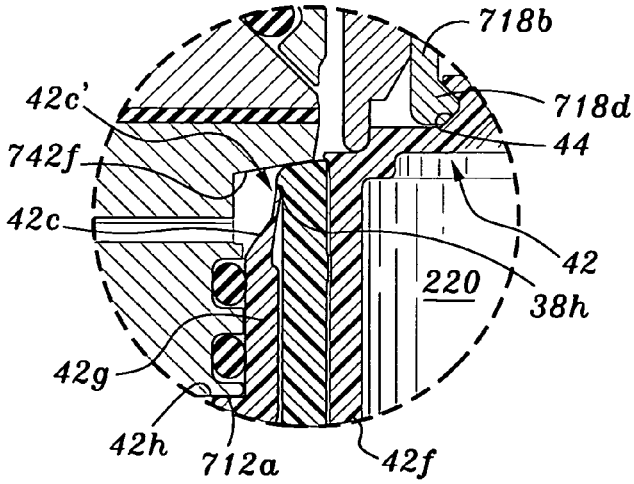
Figure 17:
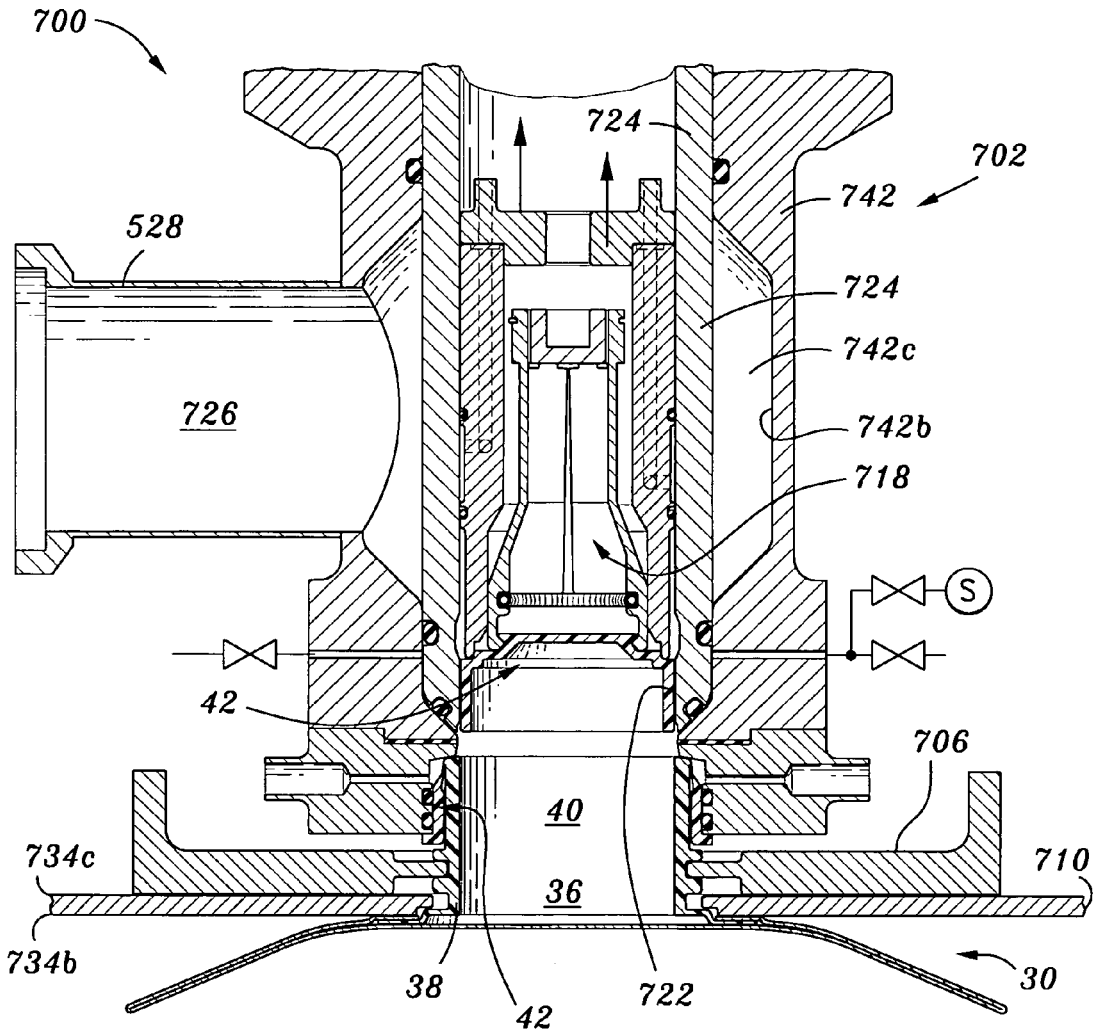
Figure 18:
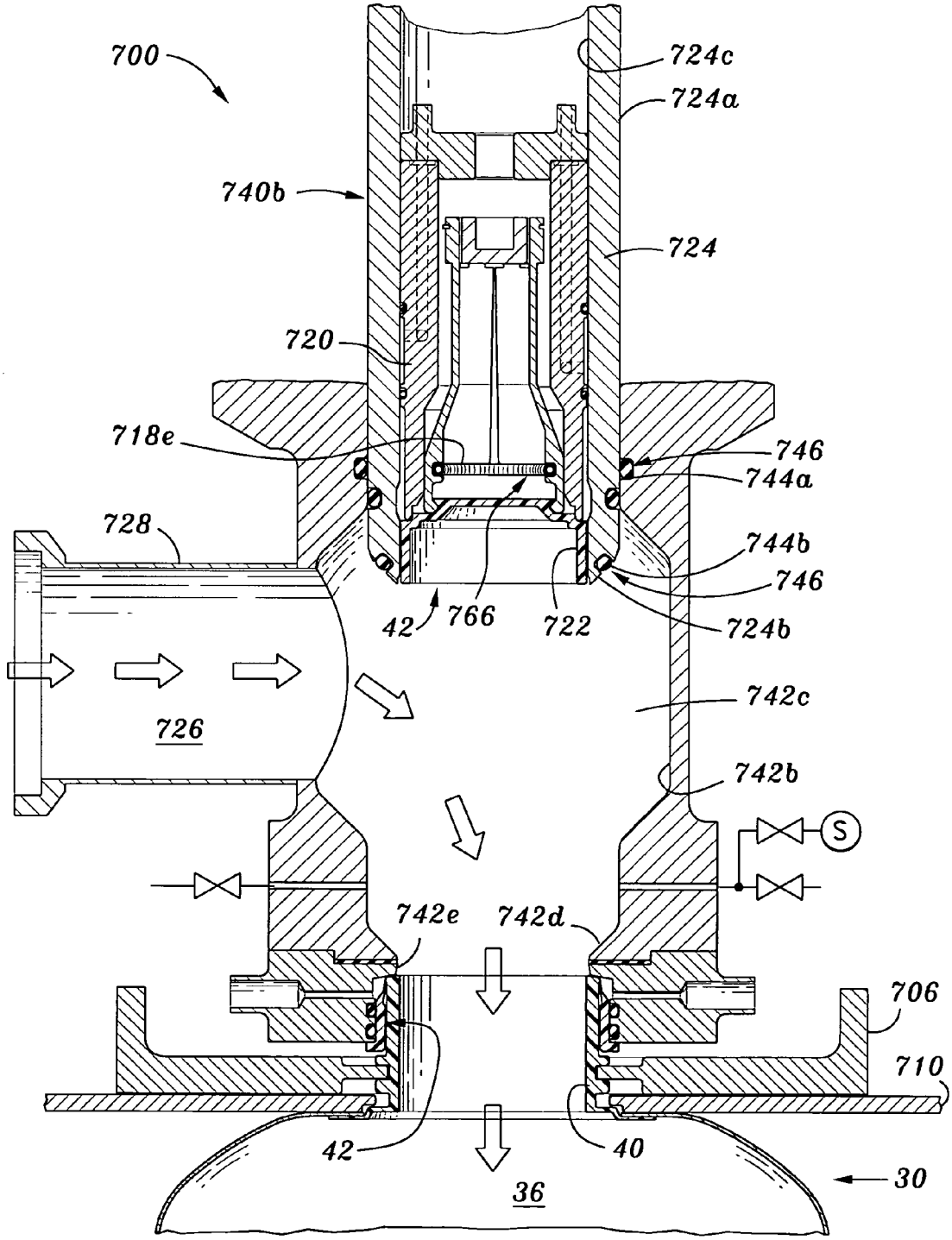
Figure 19:
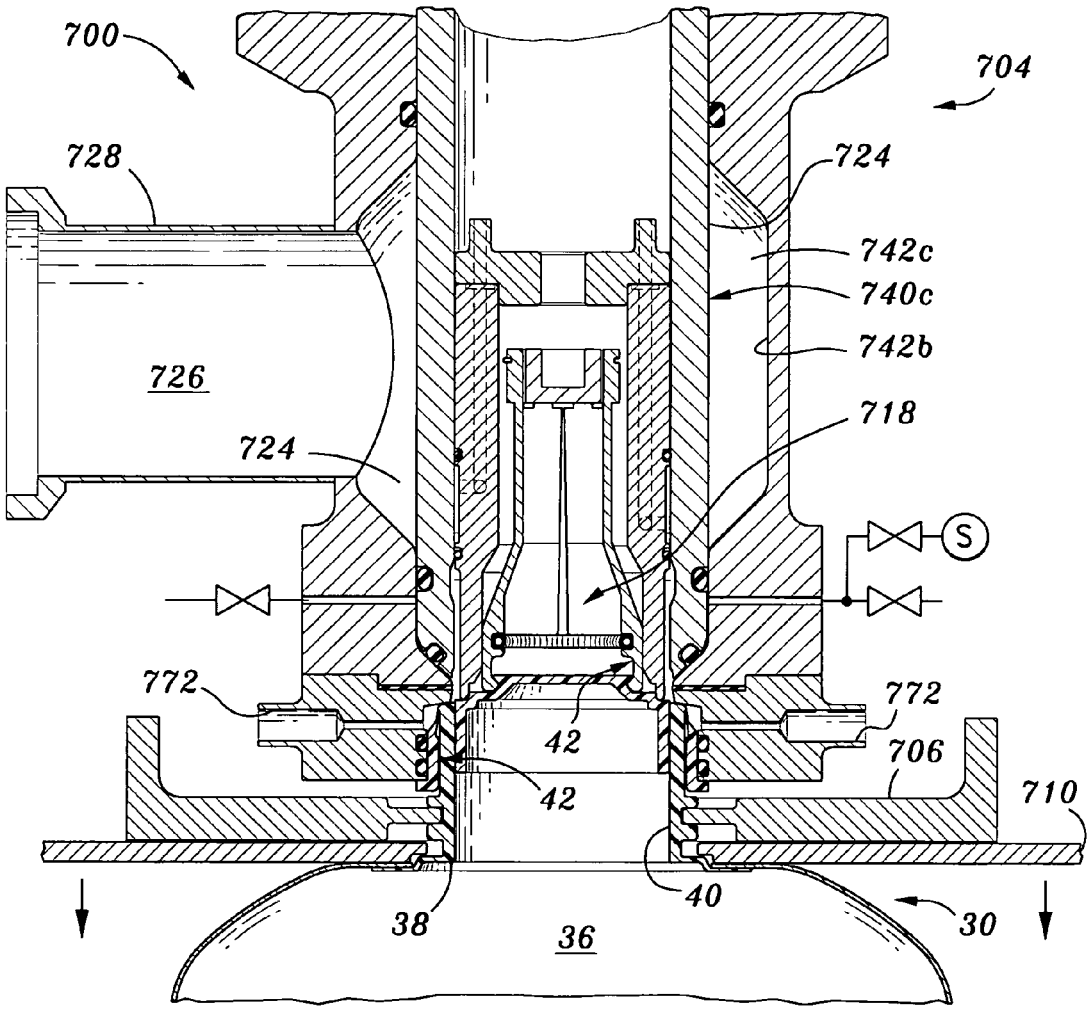
Figure 20:
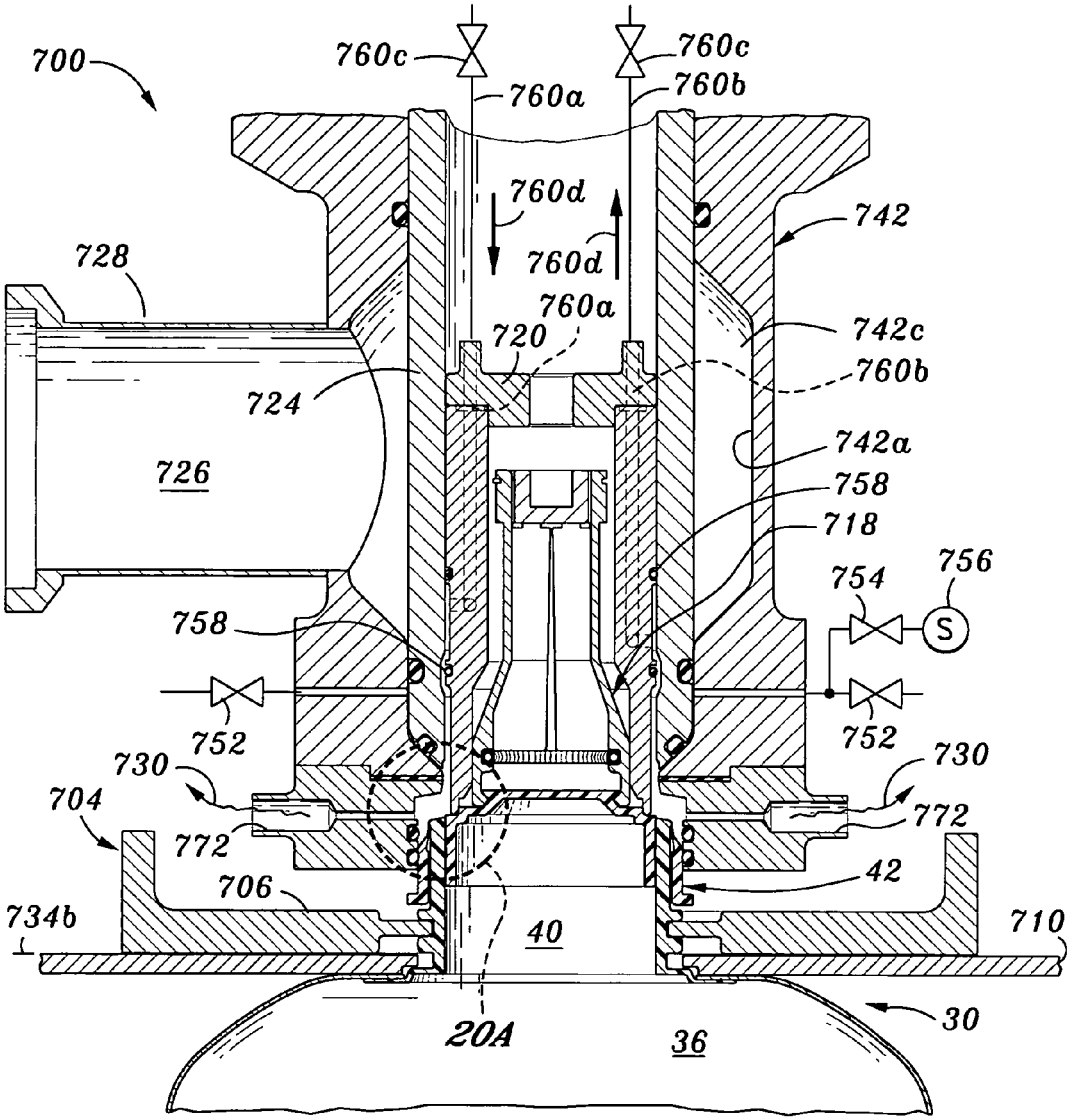
Figure 20A:
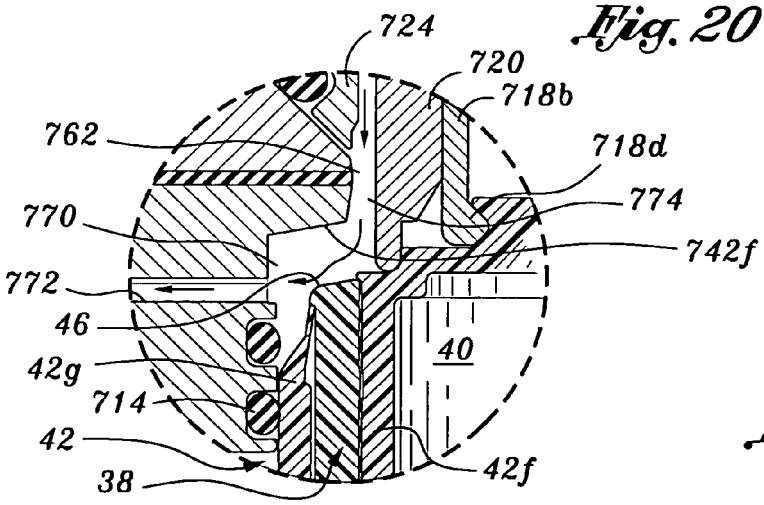
Figure 21:
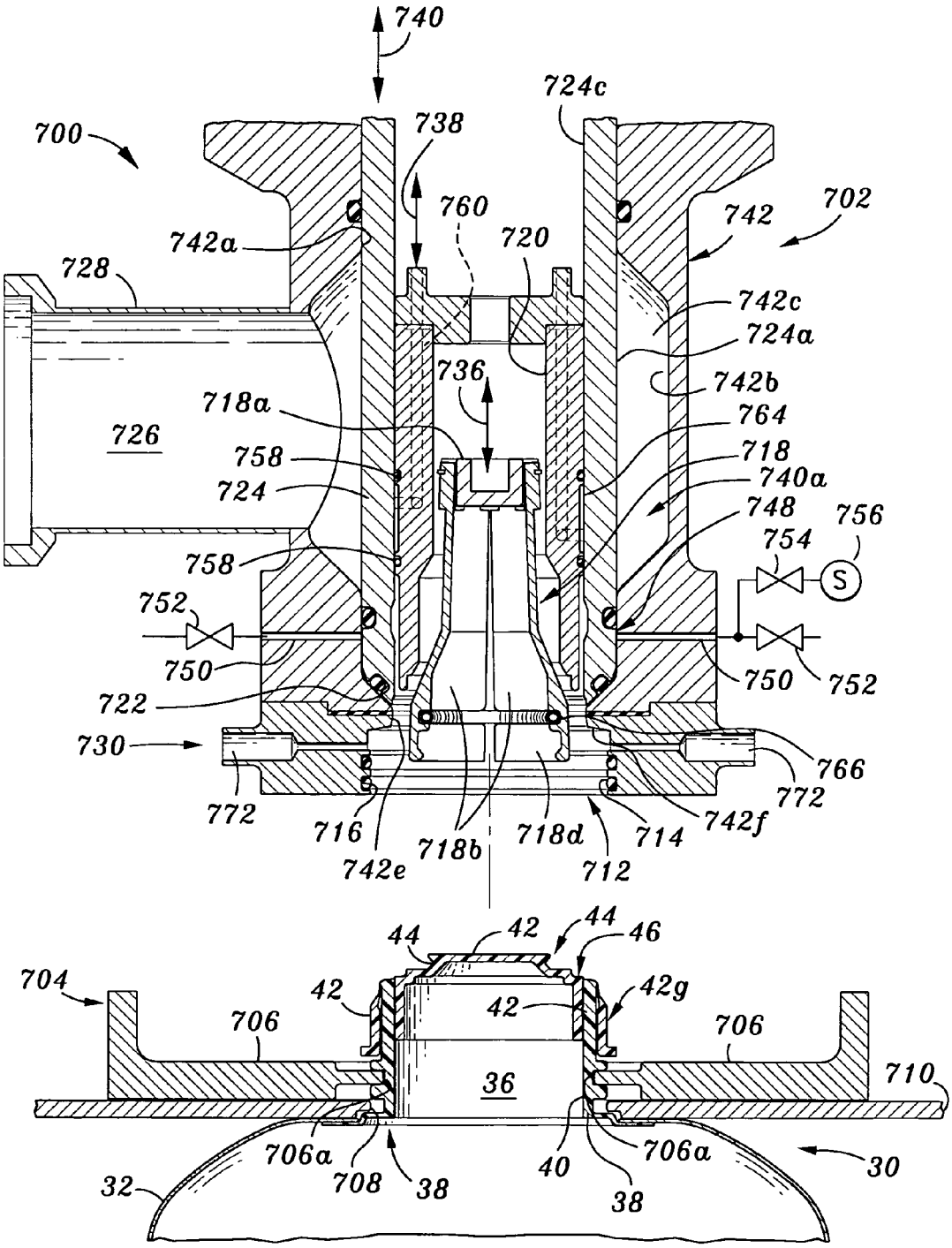
Figure 24:
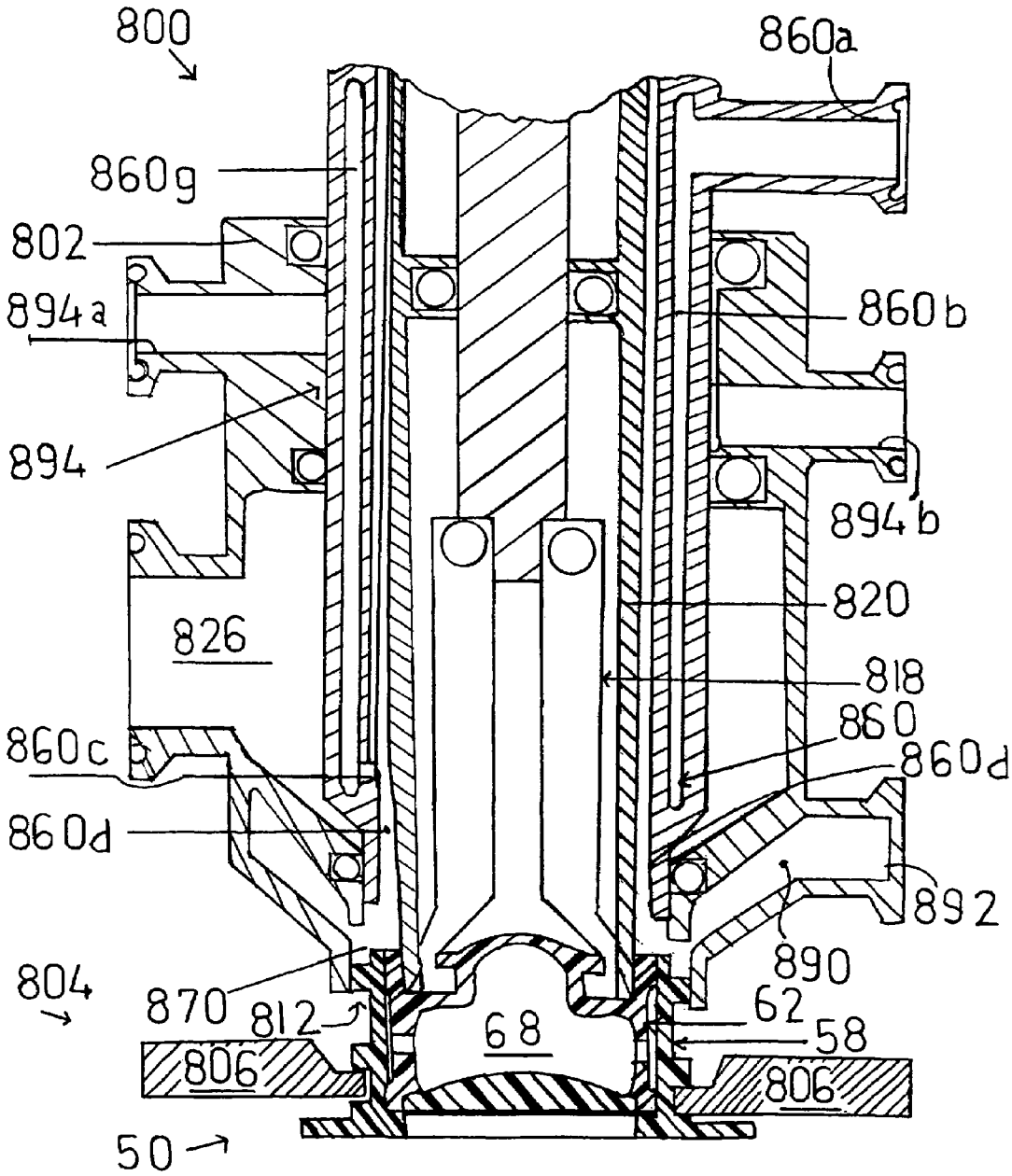
Figure 25:
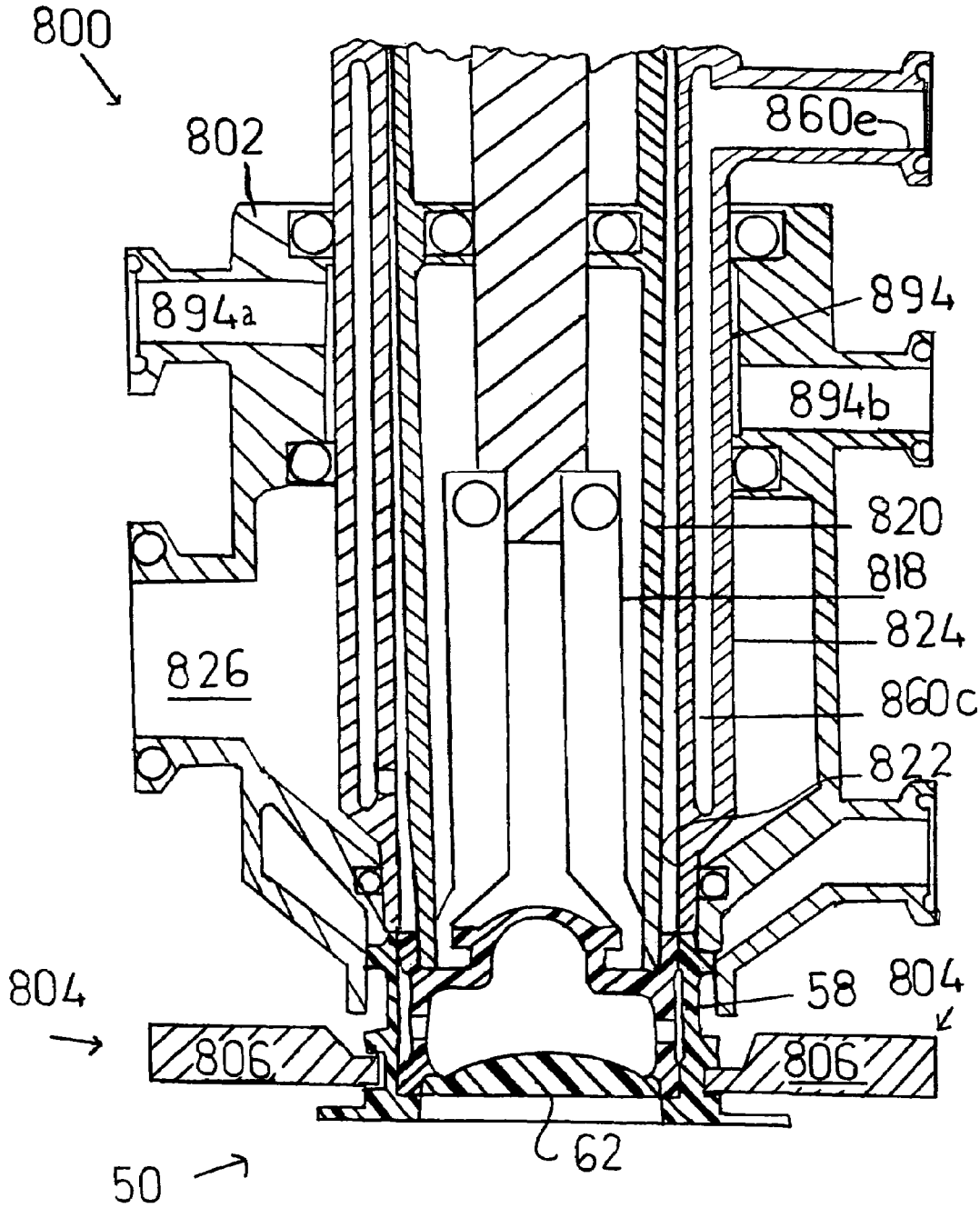
Figure 26:
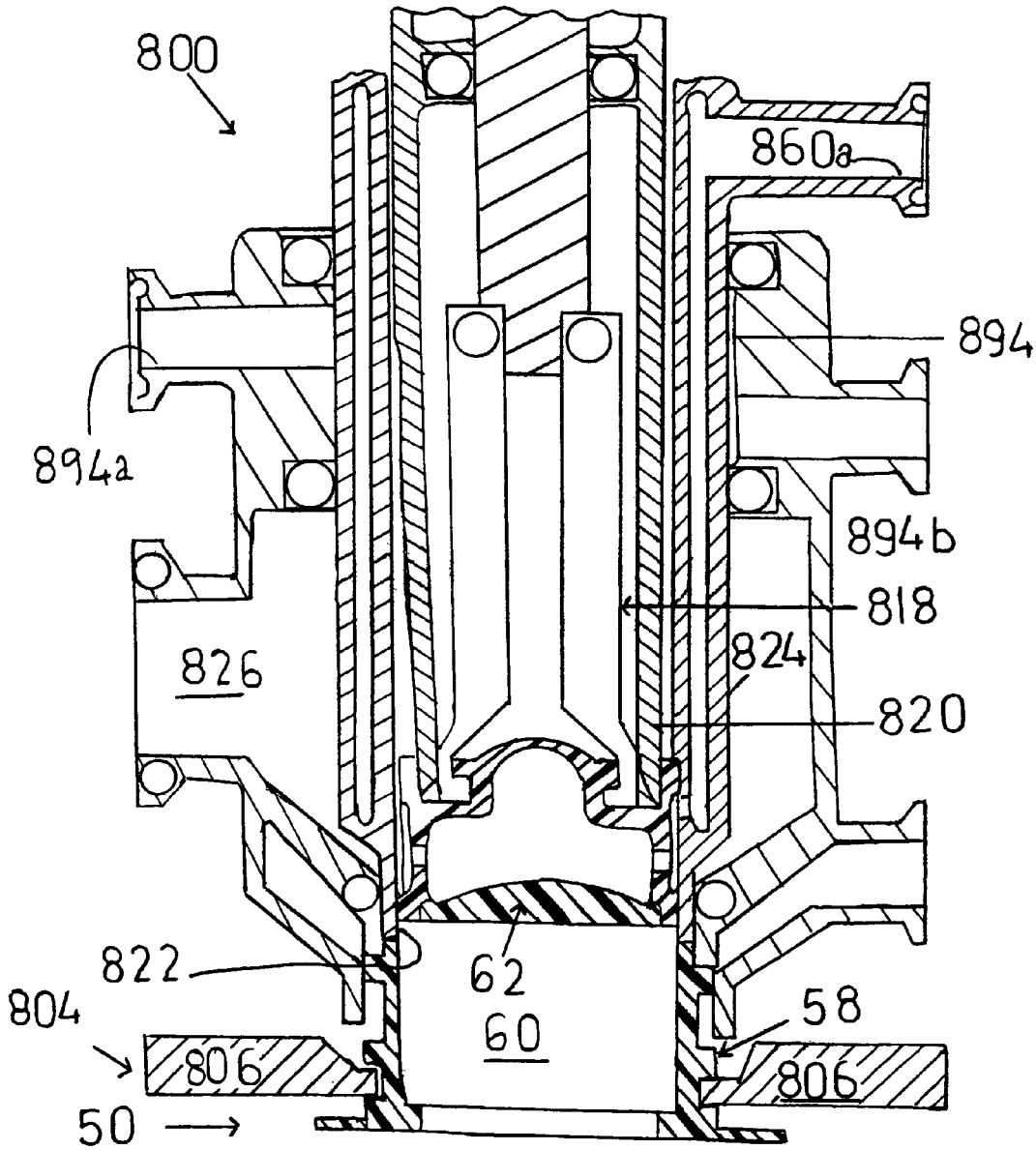
Figure 27:
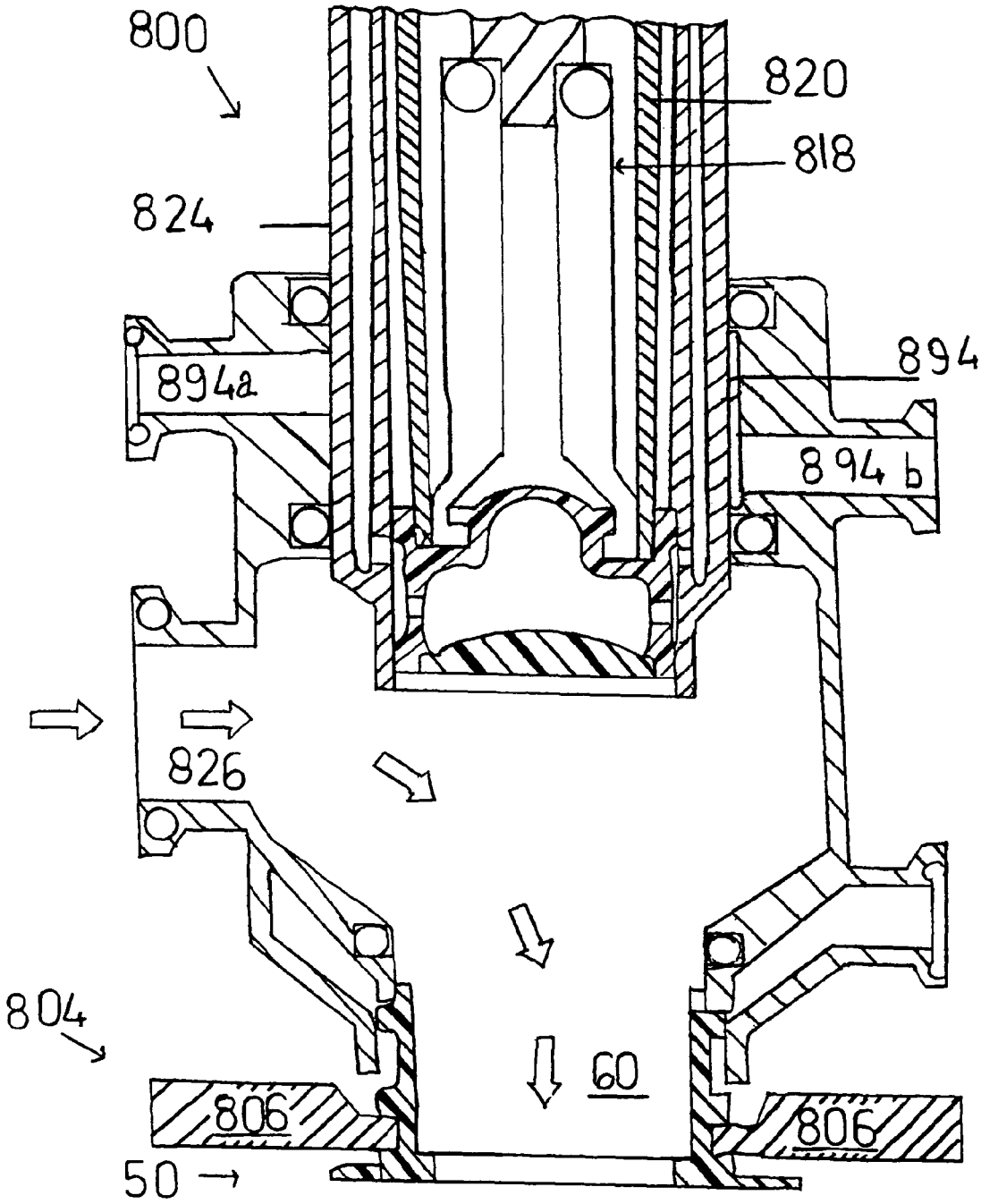
Figure 28:
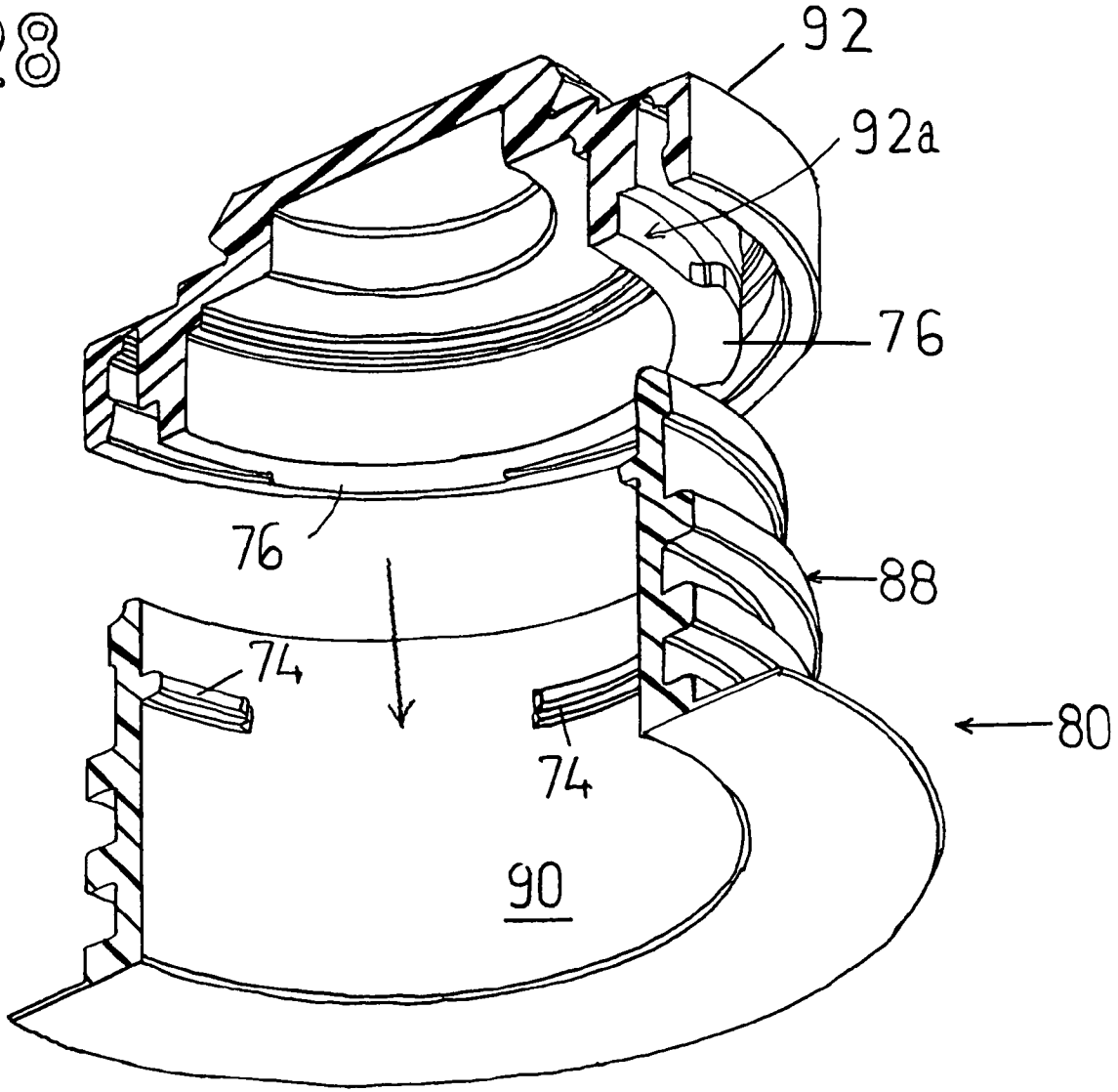
Figure 29:
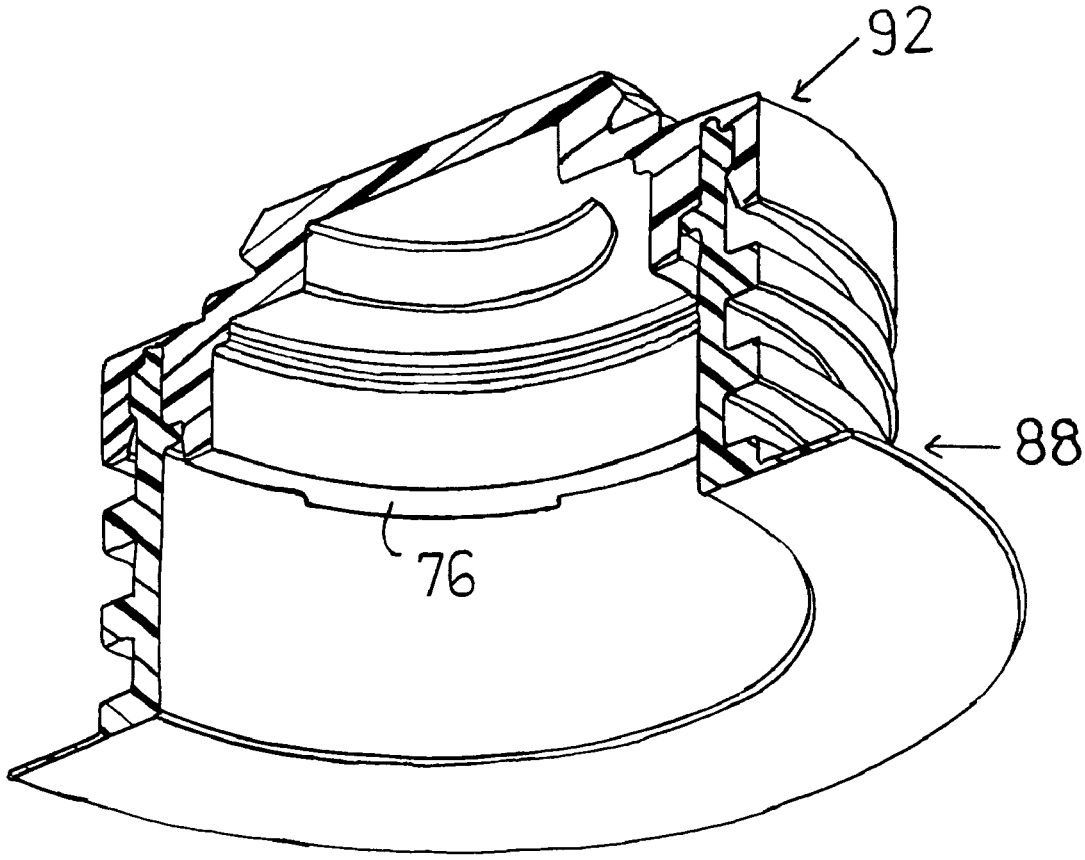
Figure 30:
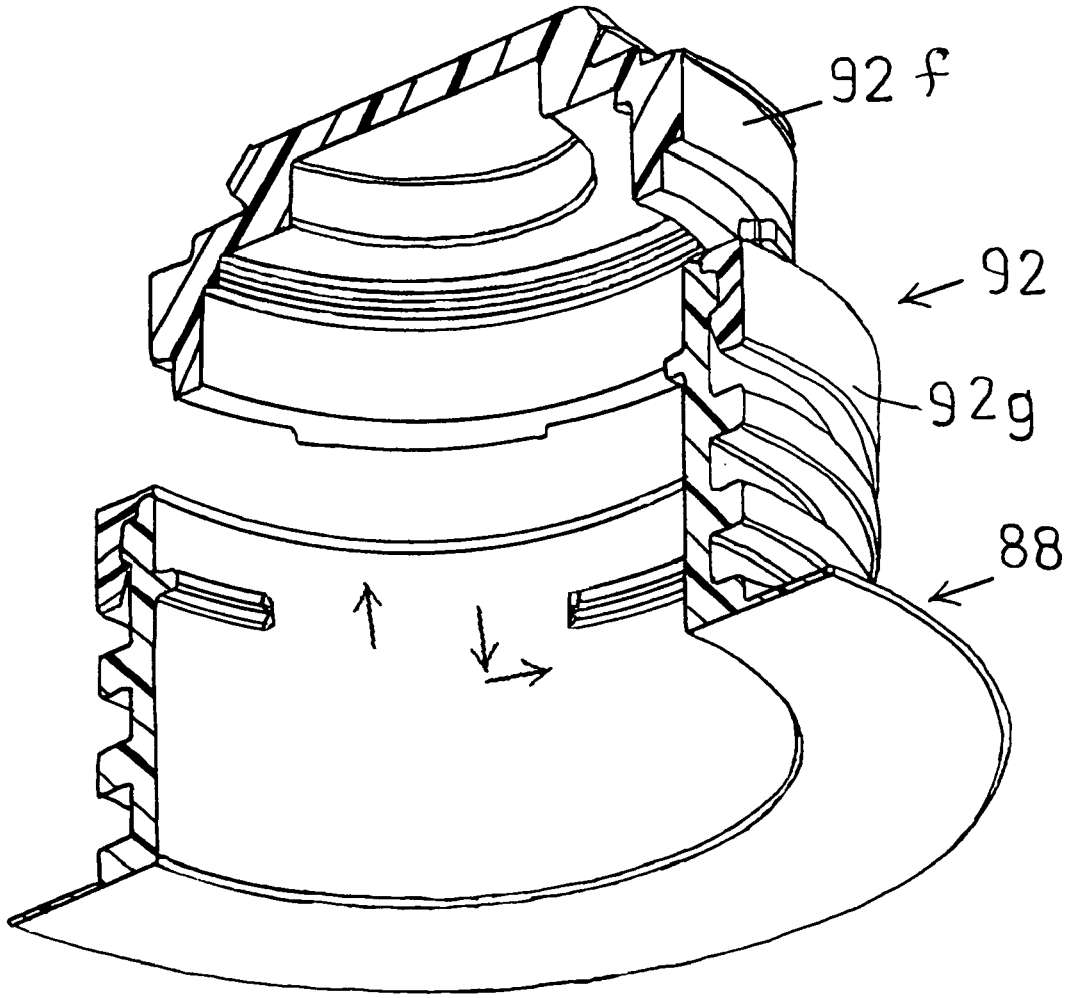
Figure 31:
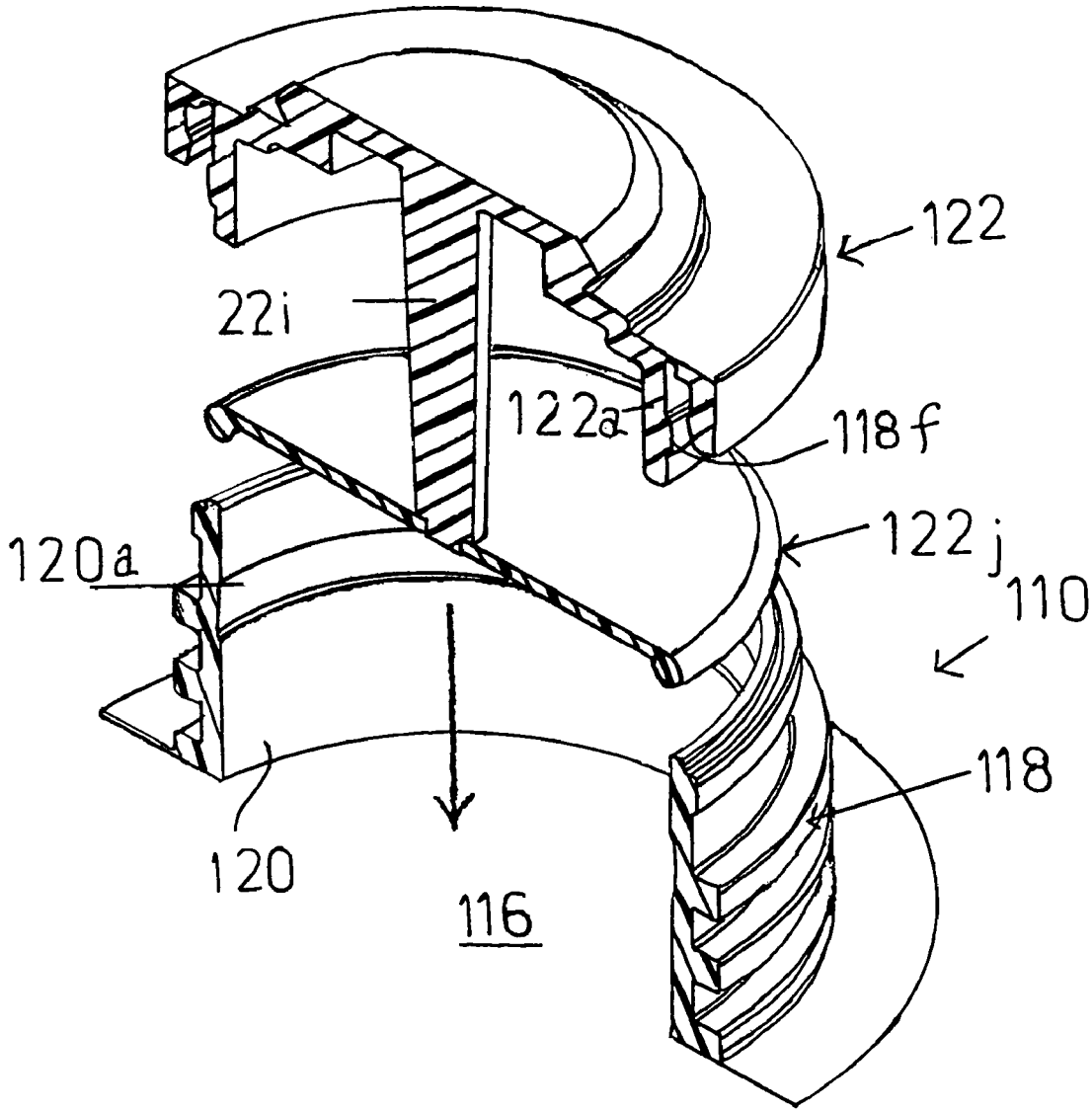
Figure 32:
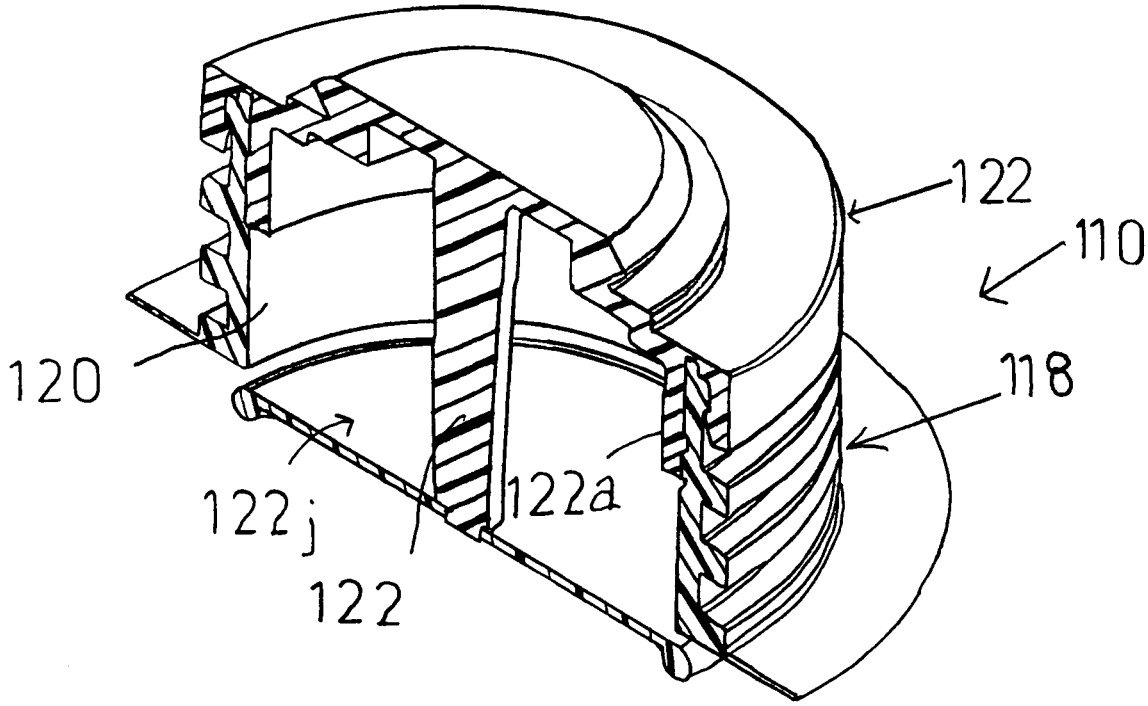
Figure 33:
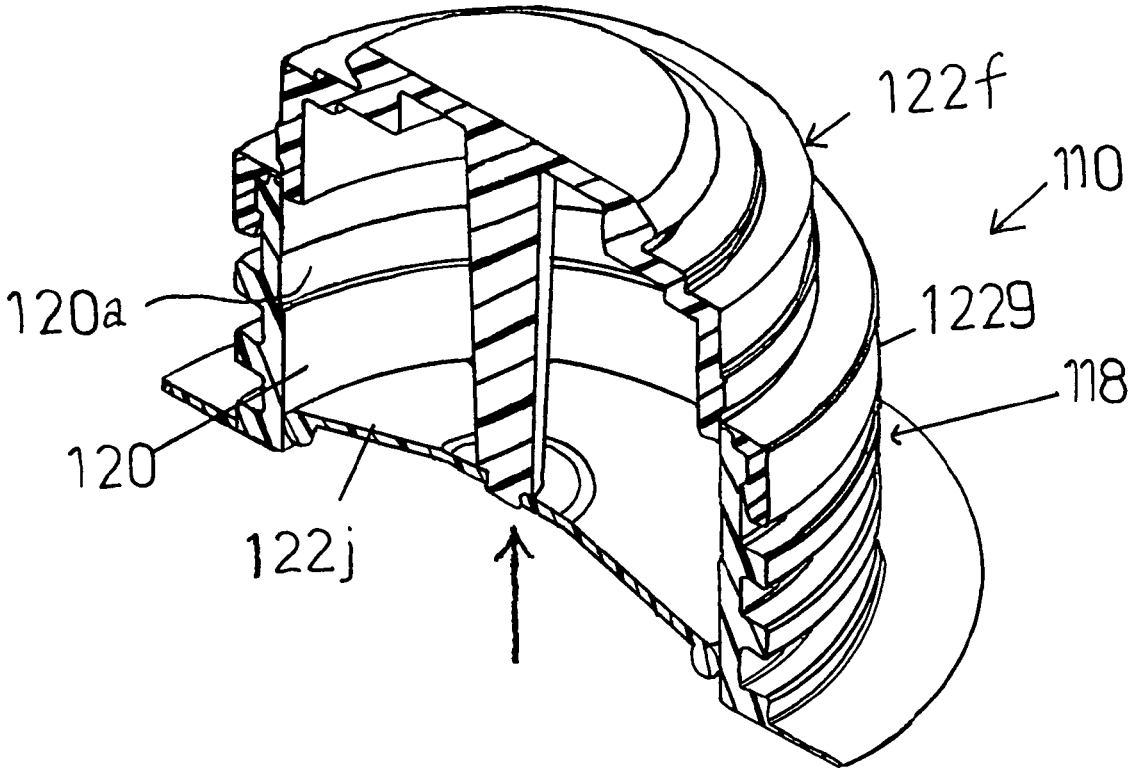
Figure 34:
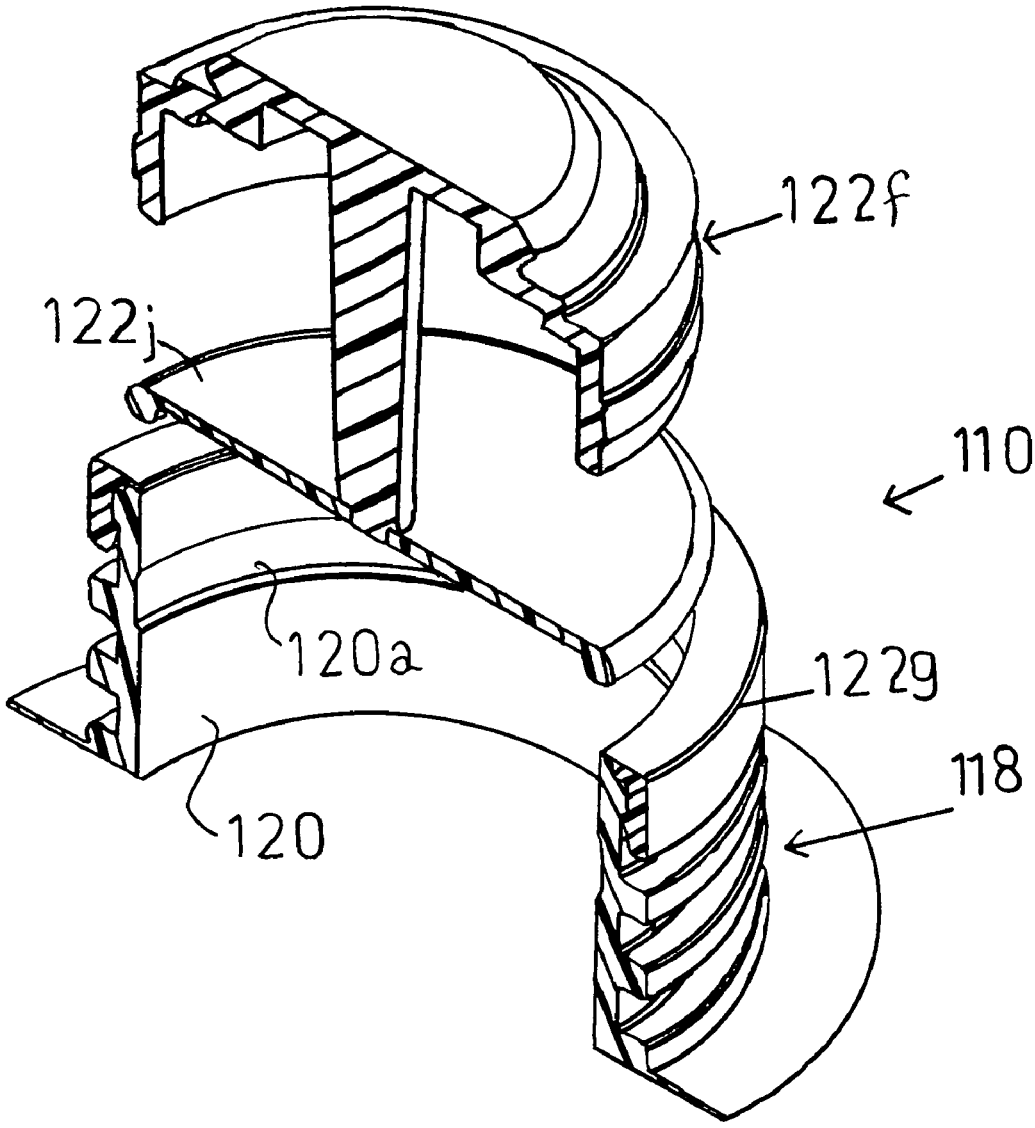
Figure 35:
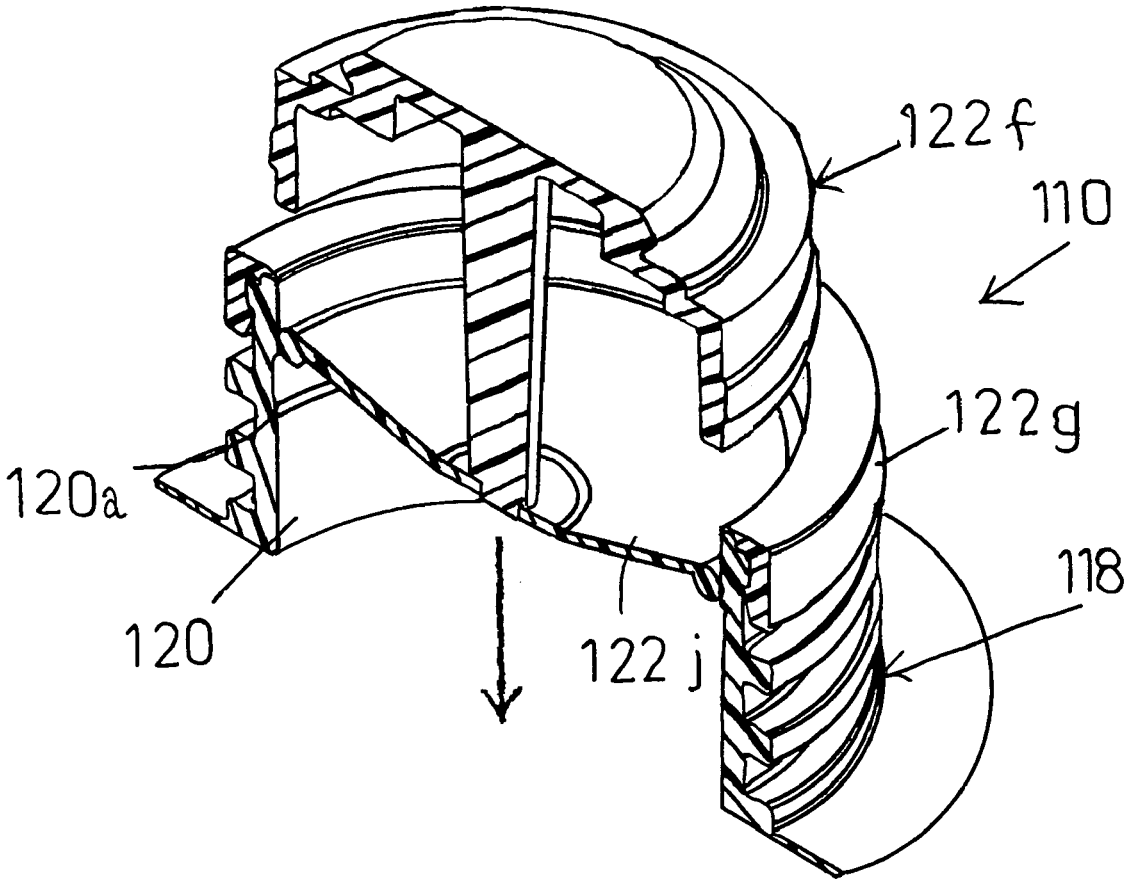
Figure 36:
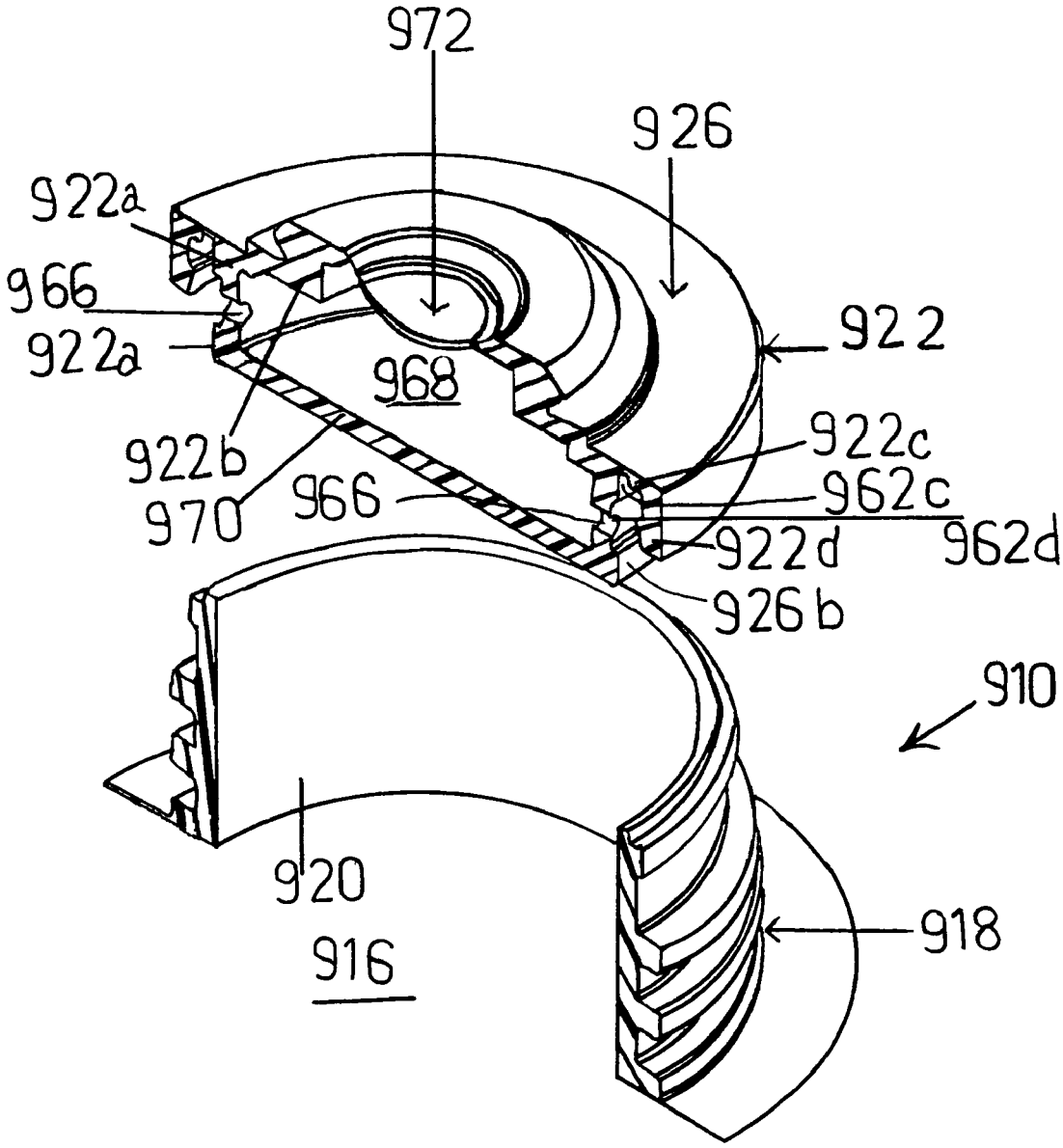
Figure 37:
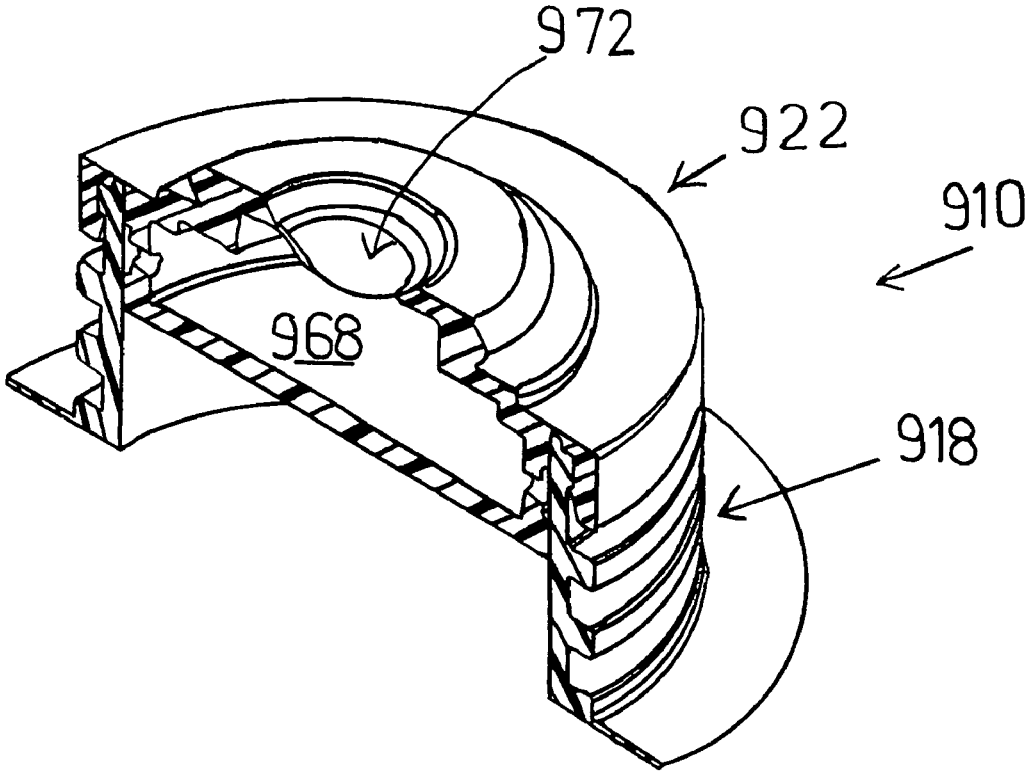
Figure 38:
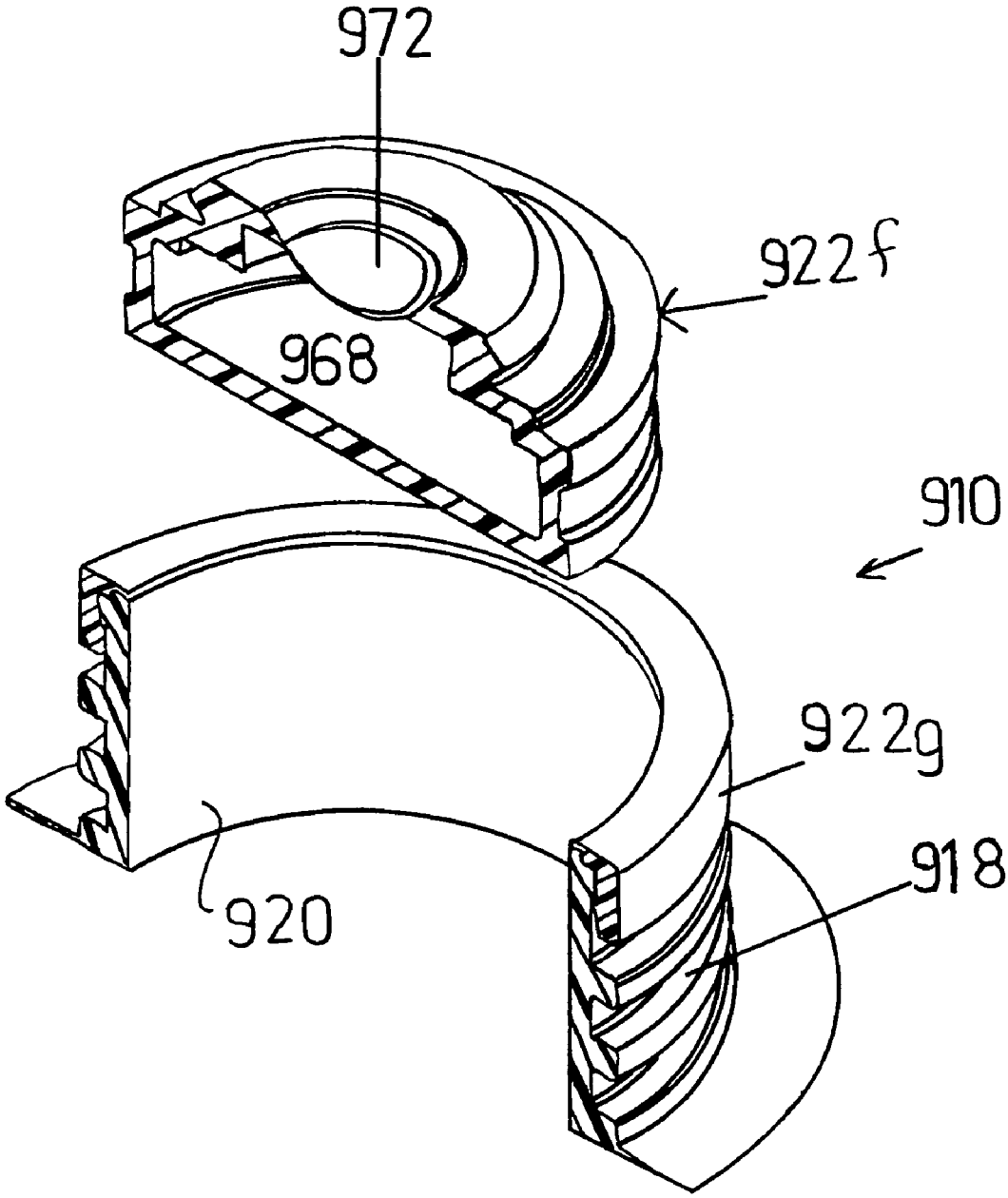
Figure 39:
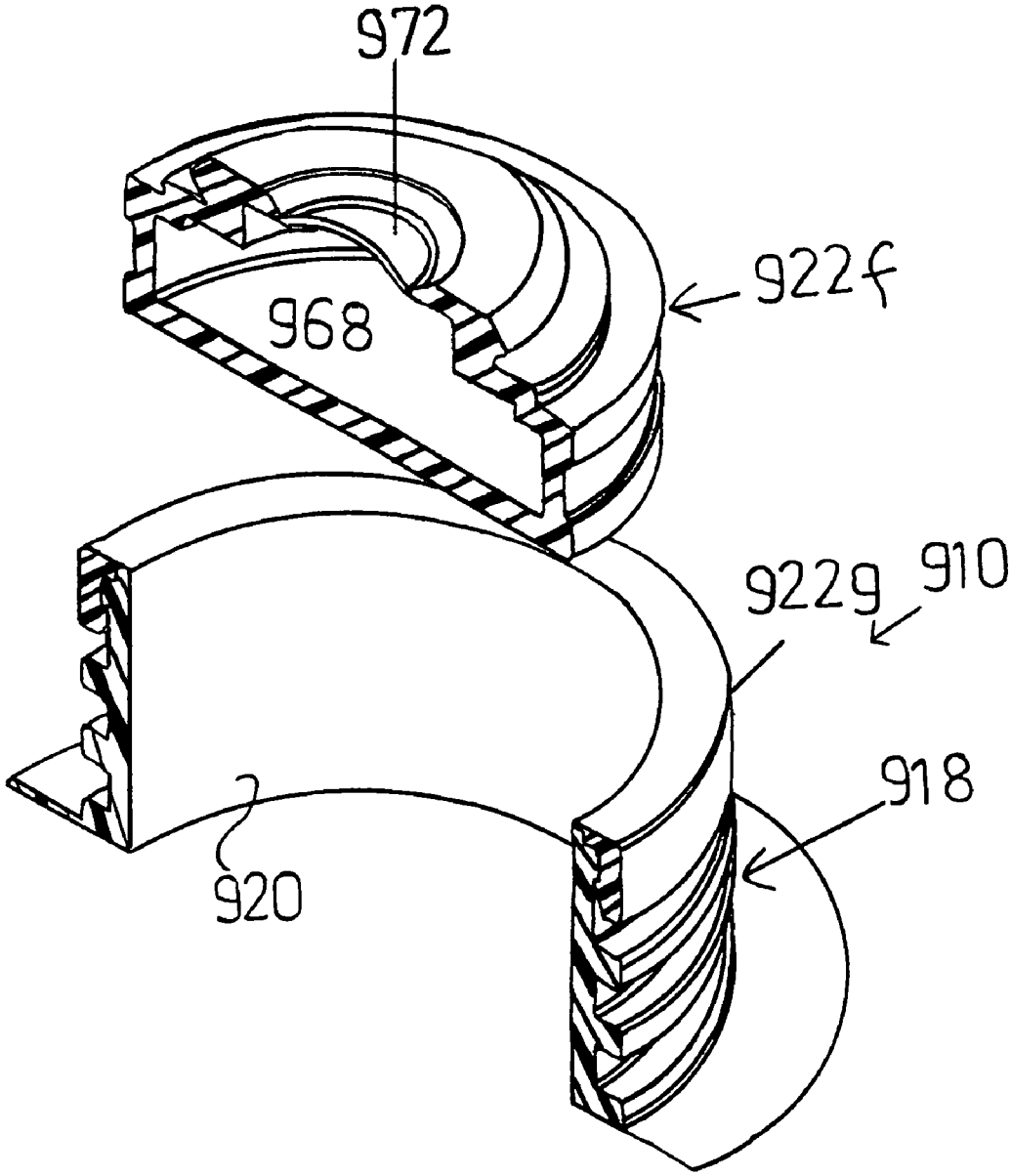
Figure 40:
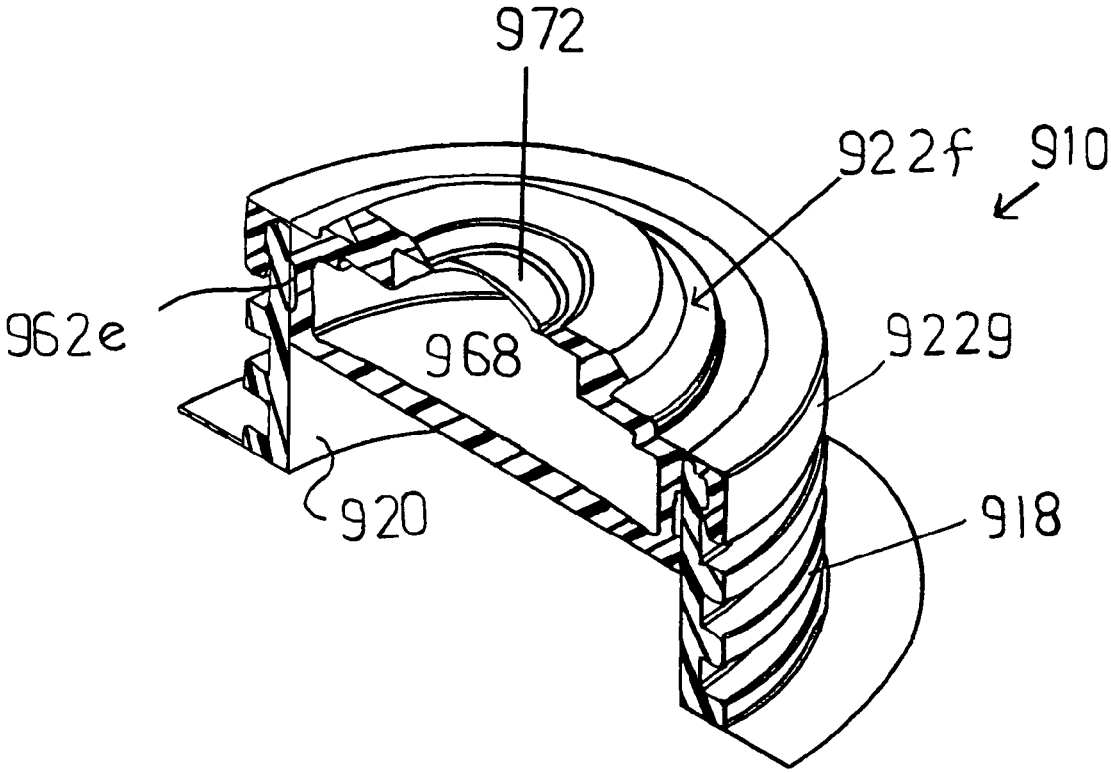
Figure 41:
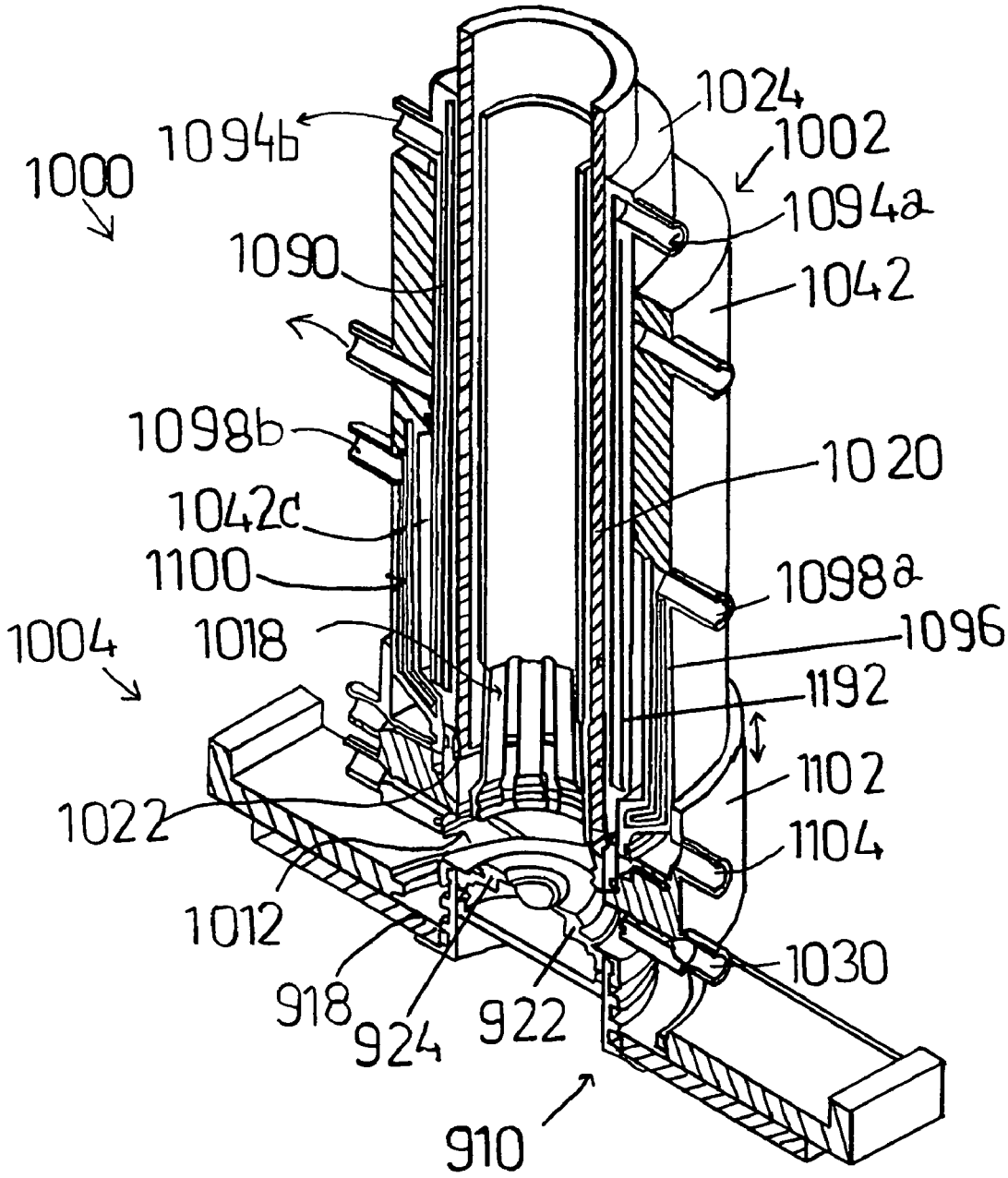
Figure 41A:
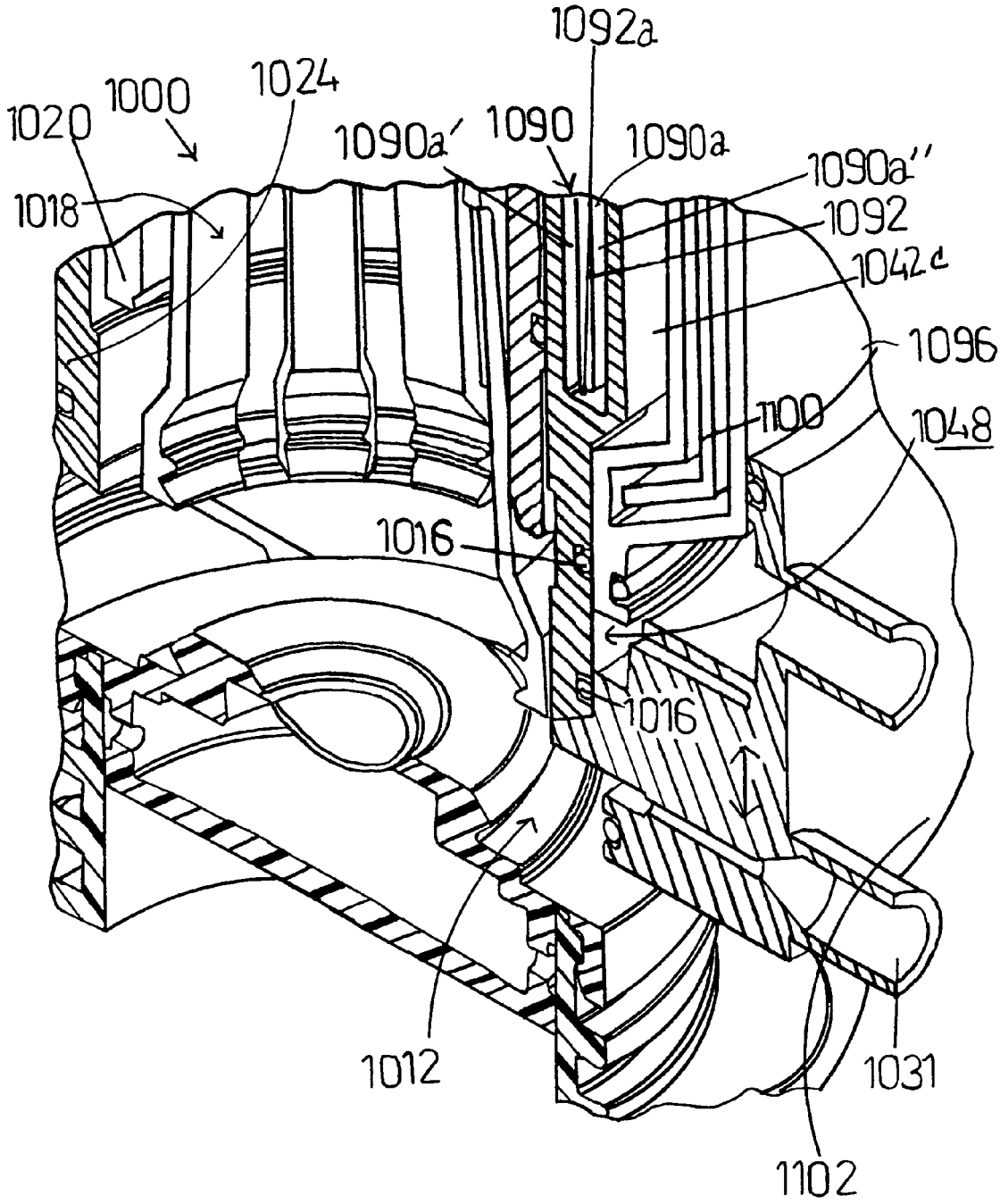
Figure 42:
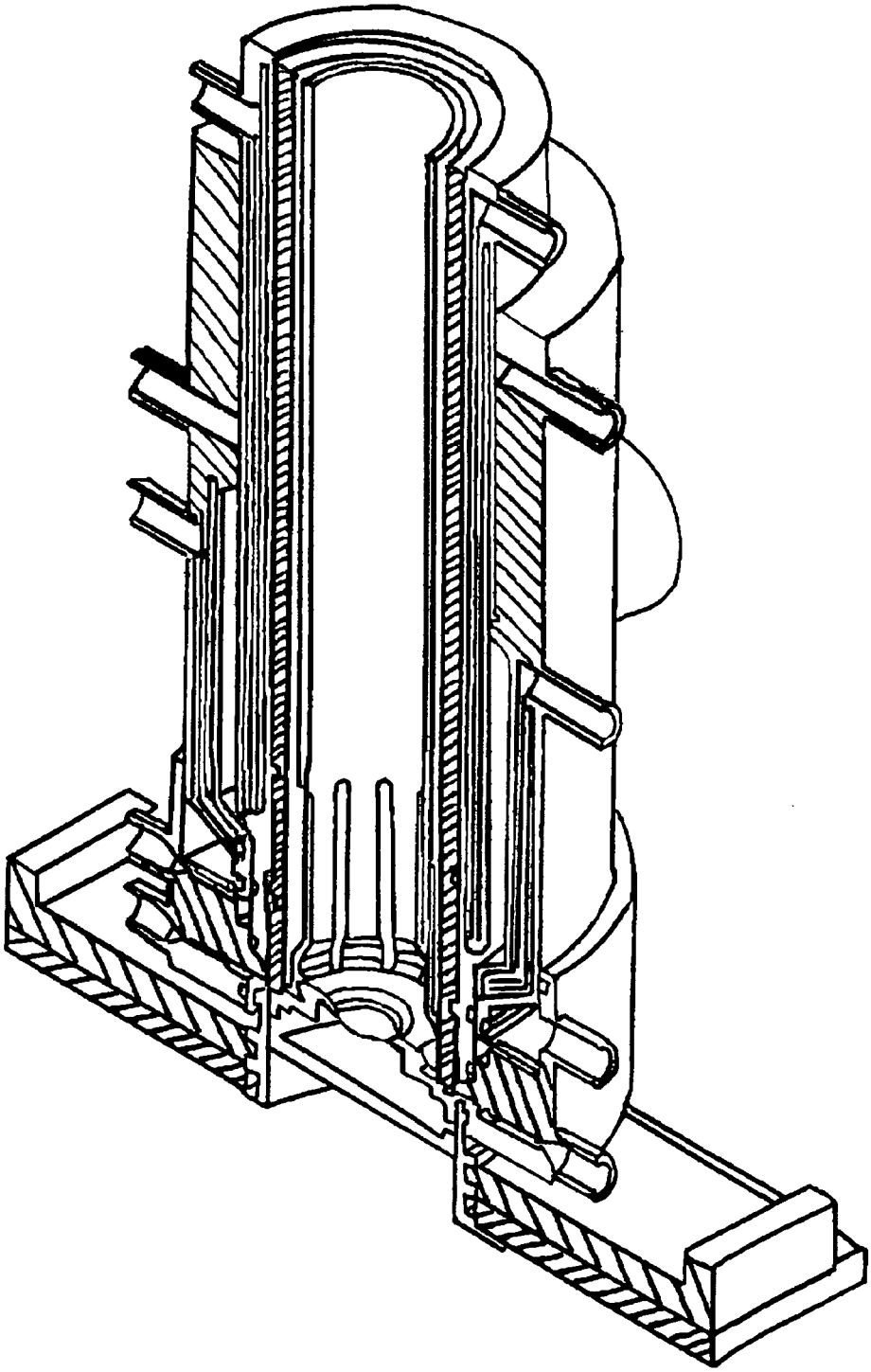
Figure 42A:
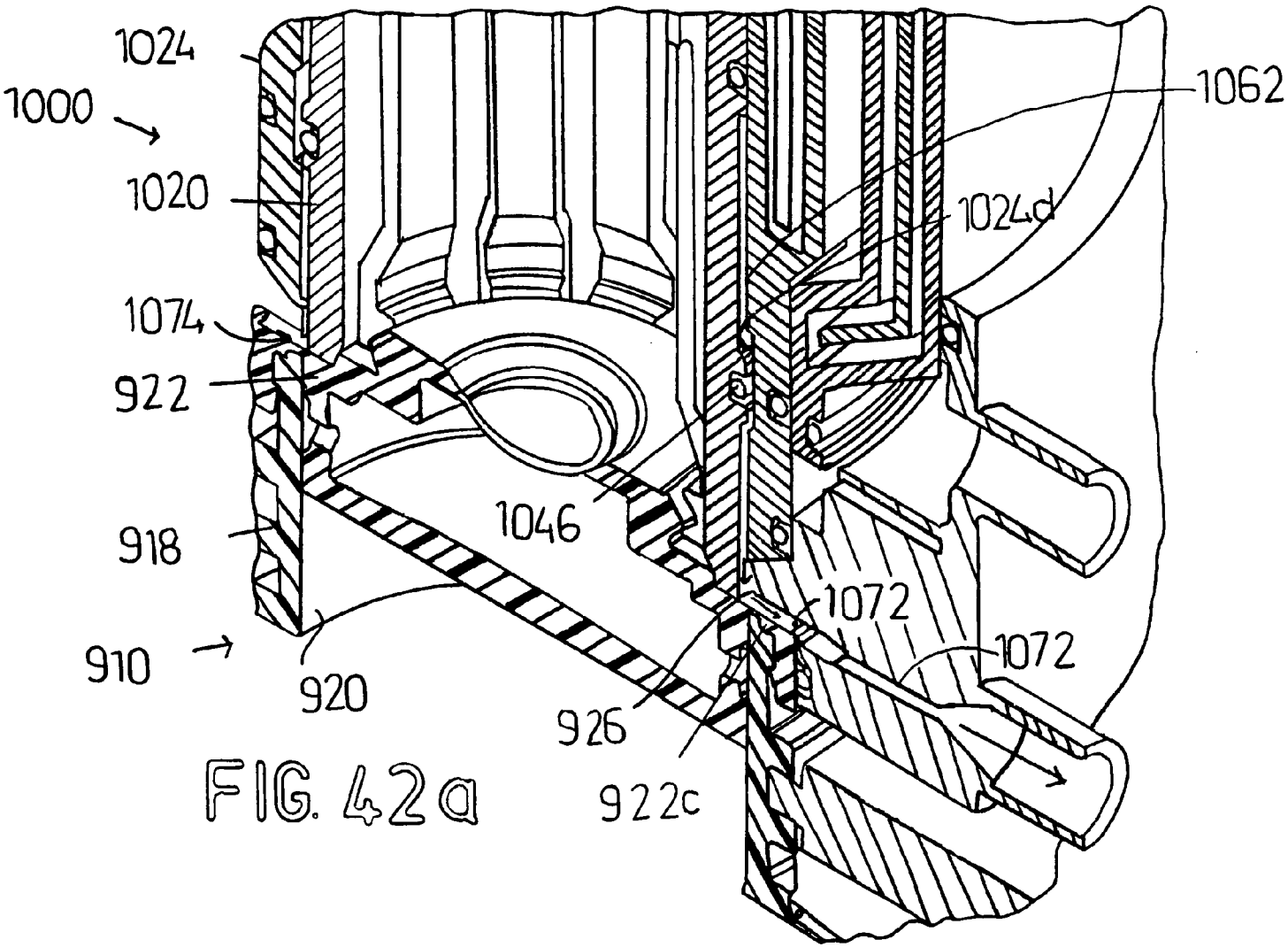
Figure 43:
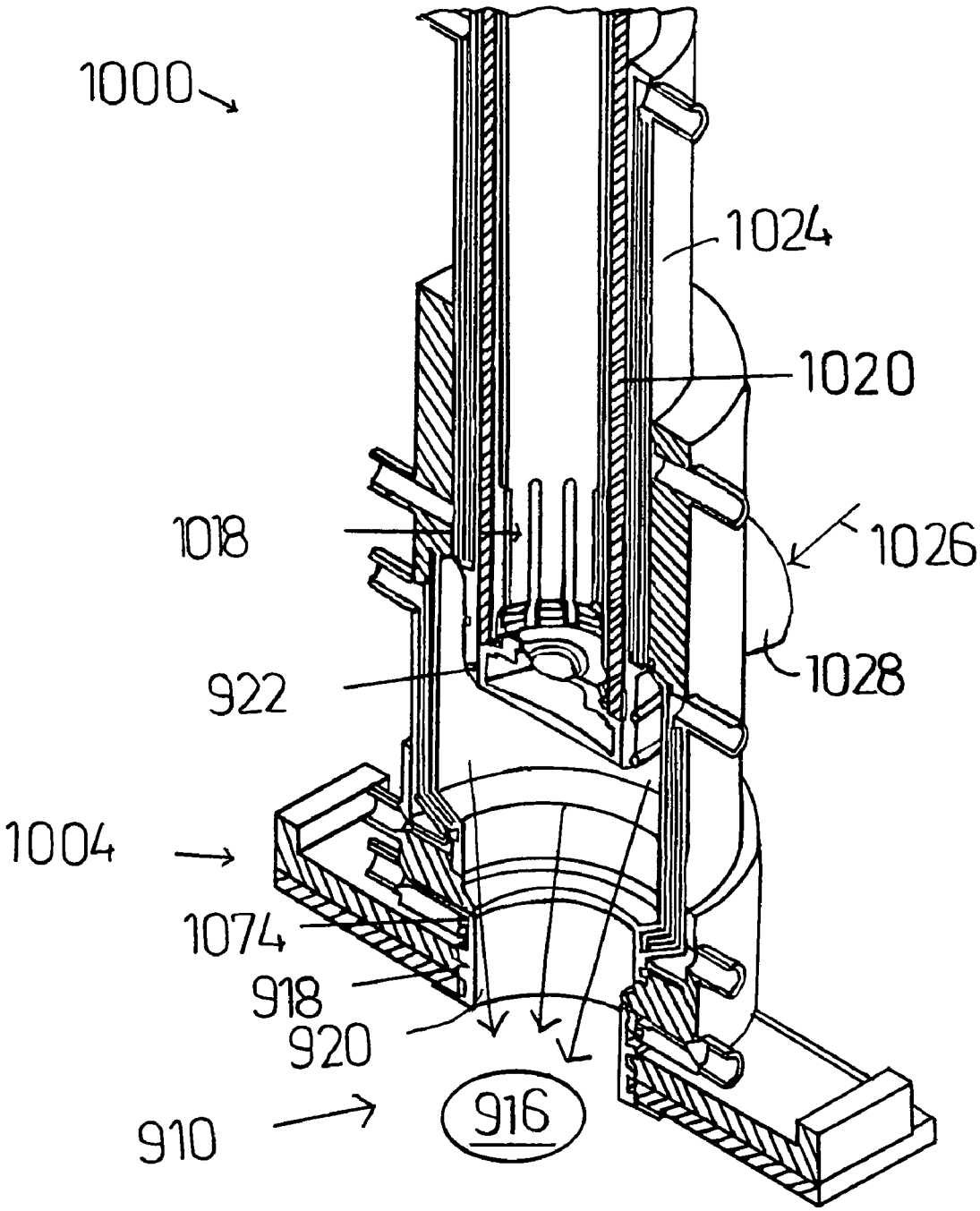
Figure 44:
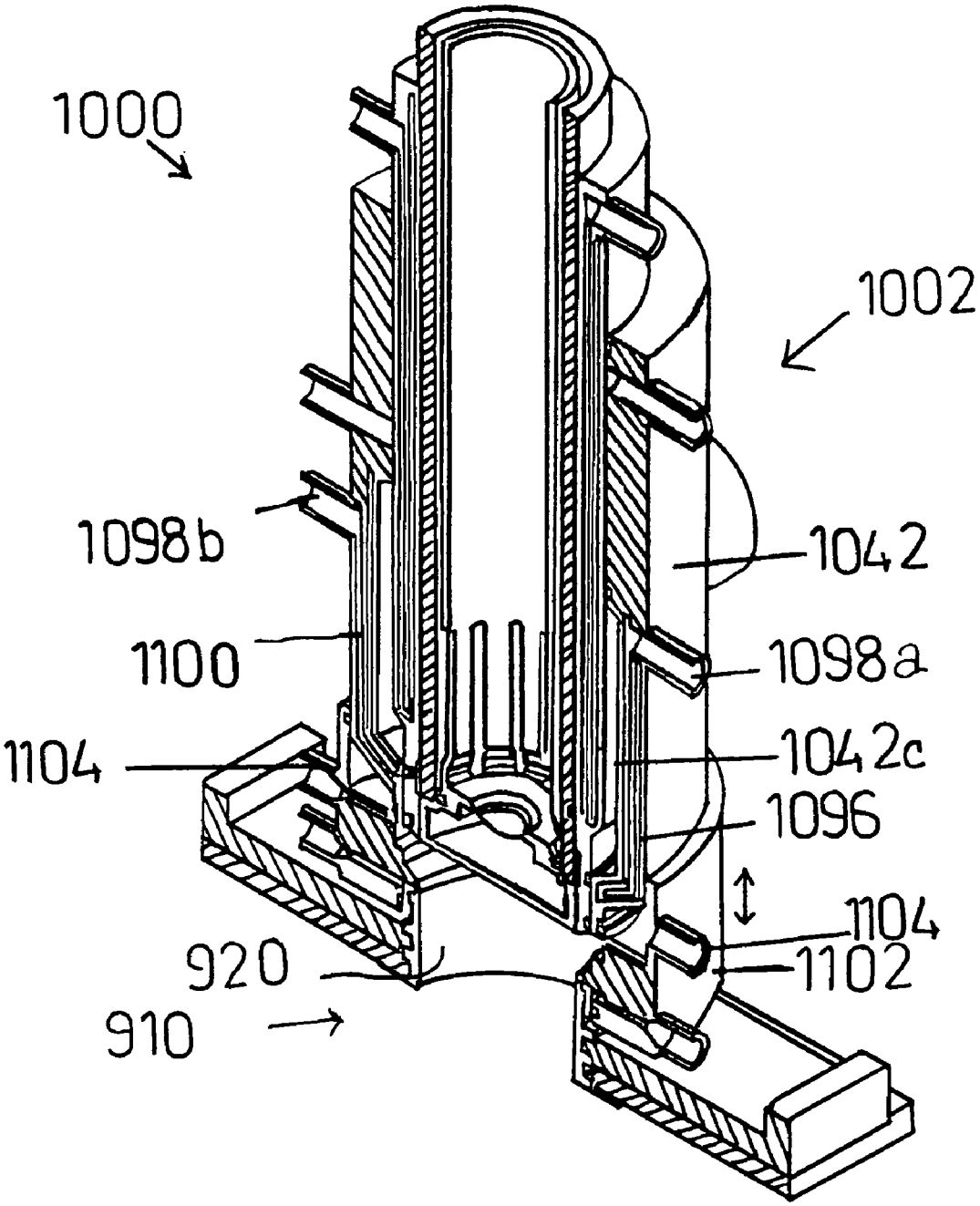
Figure 44A:
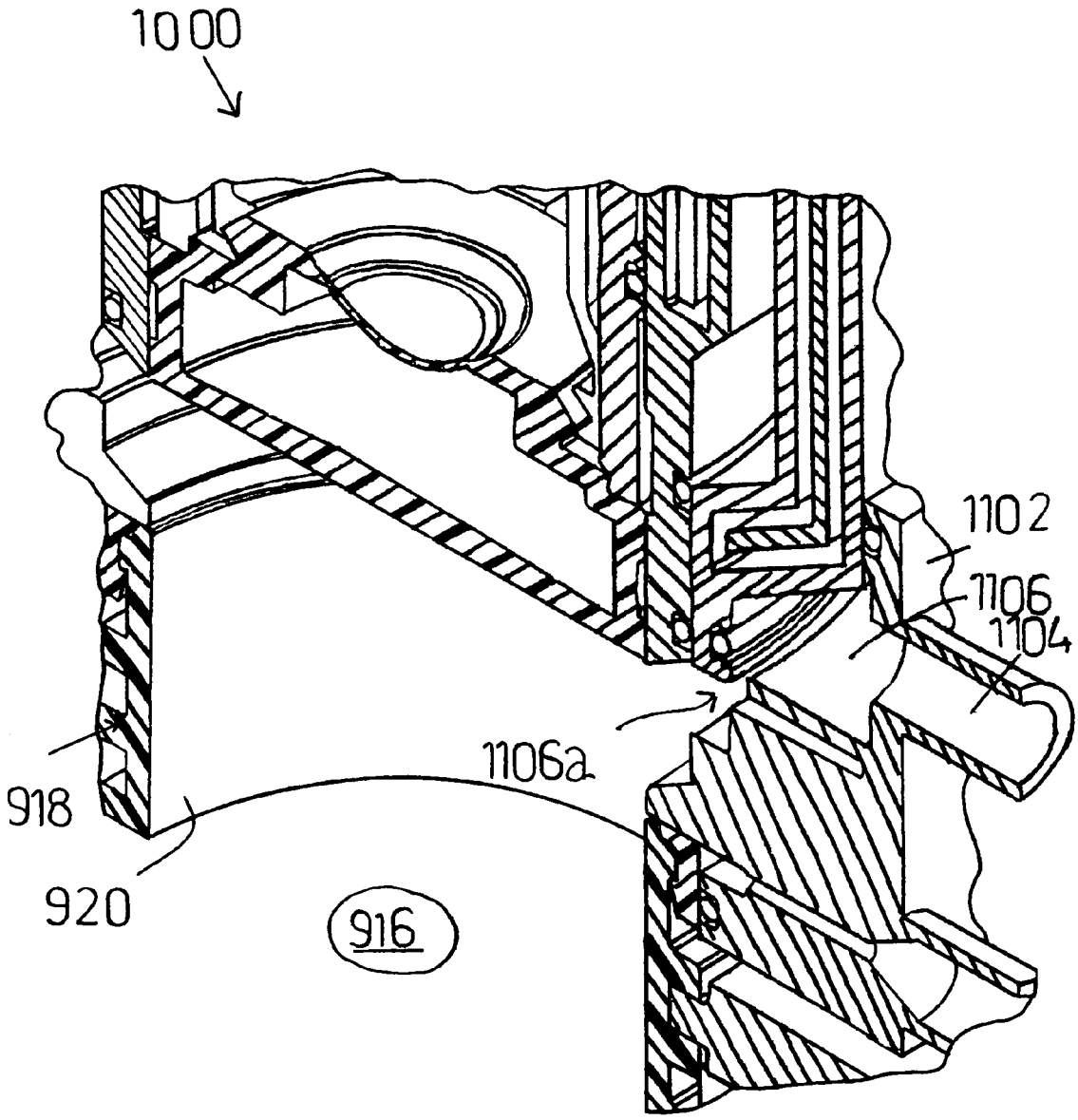
Figure 45:
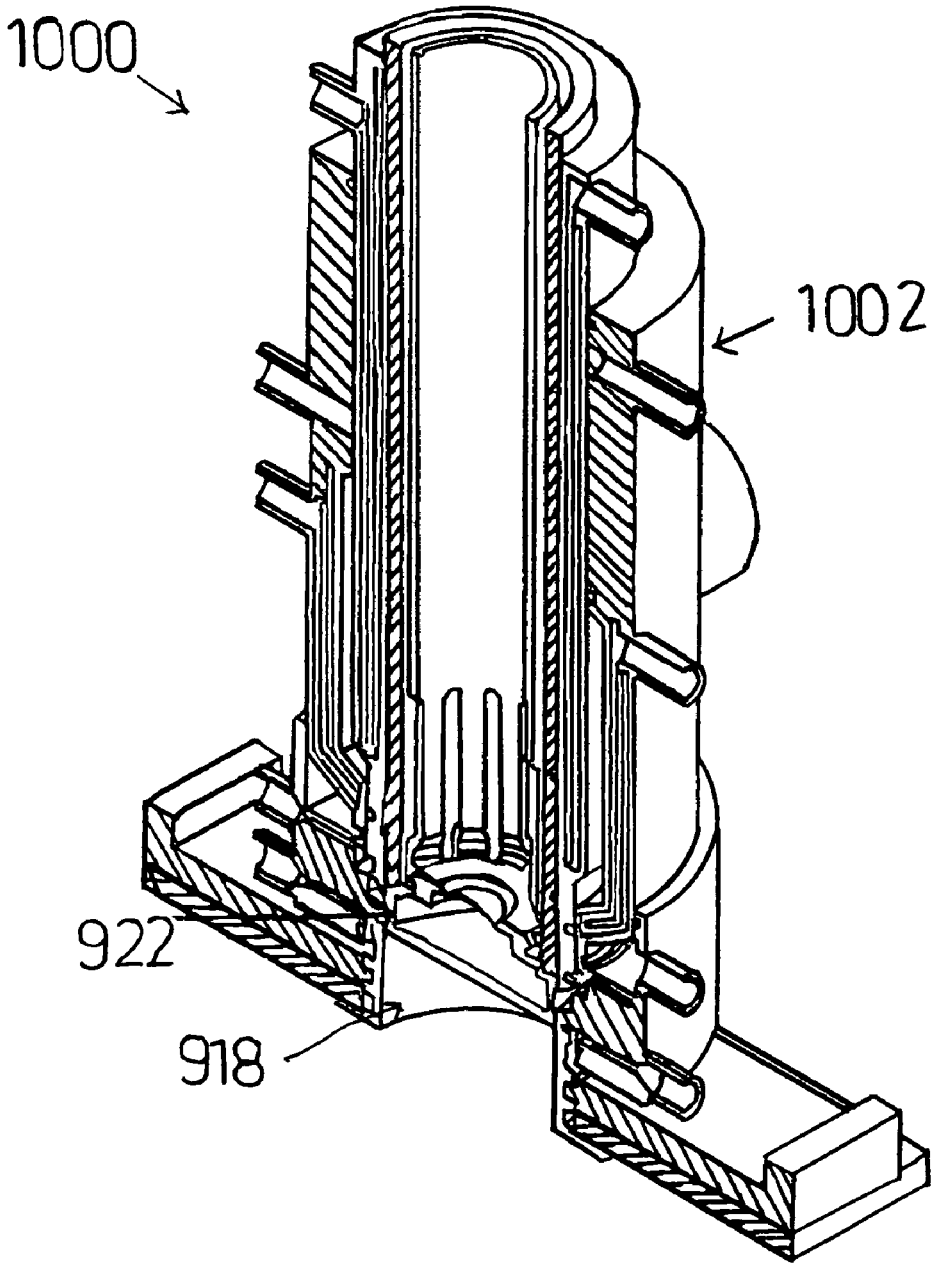
Figure 5A:
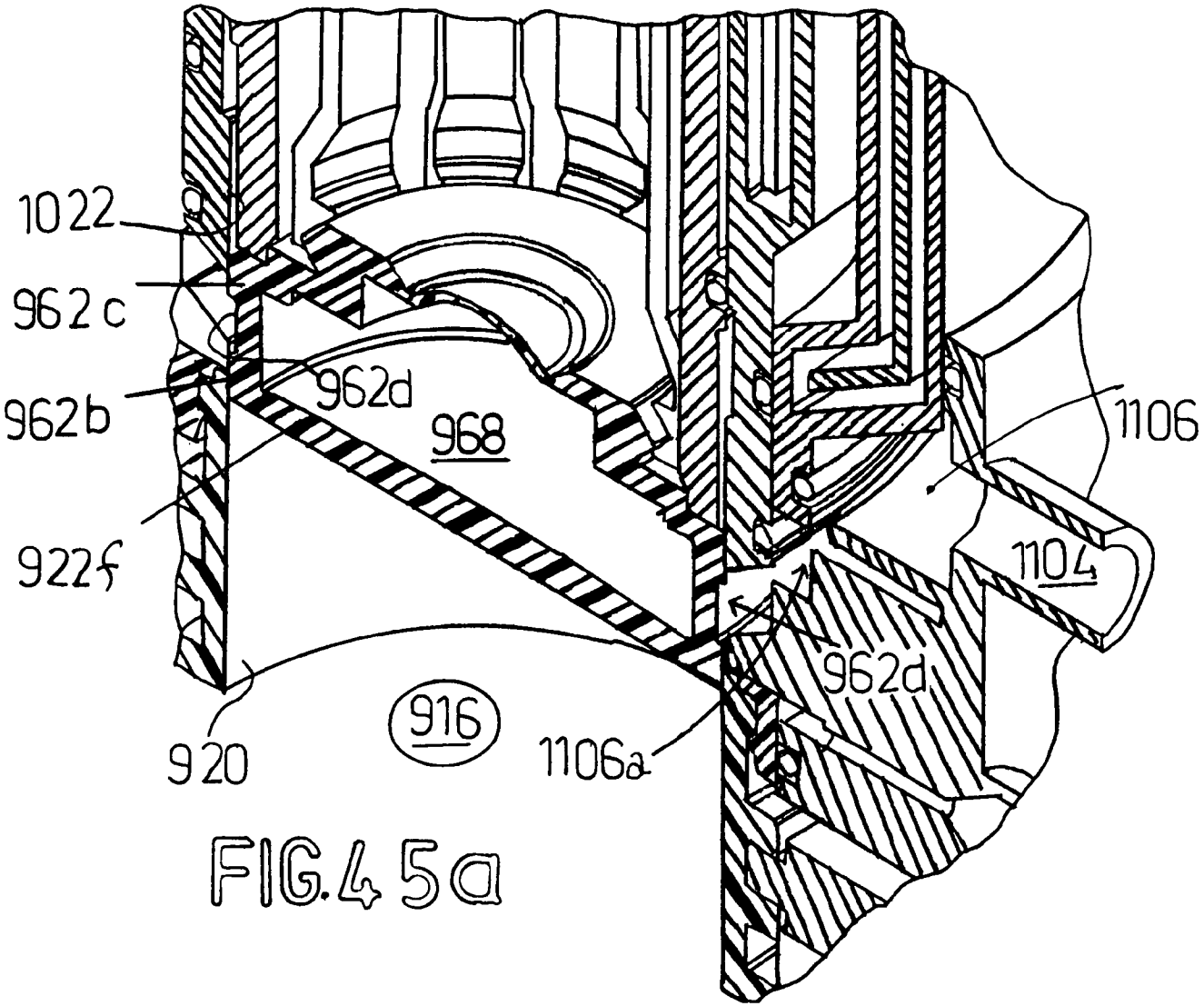

FIG. 13 provides a fragmentary view of an empty sterile container of the bag type embodying a third embodiment of the present invention, and with the container being in preparatory alignment and spaced confrontation with a filling mechanism also embodying the present invention, all representing a step in the process of filling the container;

FIG. 14 is an enlarged fragmentary view of a portion of FIG. 13;

FIG. 15 provides a fragmentary view similar to that of FIG. 13, but with the container at a subsequent stage of engagement with the filling mechanism preparatory to filling of the container;

FIG. 15*a* is an enlarged fragmentary view of a portion of FIG. 15;

FIG. 16 also provides a fragmentary view, similar to FIGS. 13 and 14, but with the container and filling mechanism in a subsequent stage of preparation to filling the container;

FIG. 16*a* is an enlarged fragmentary view of a portion of FIG. 16;

FIG. 17 illustrates a subsequent step in the process of filling the container utilizing the illustrated filling mechanism;

FIG. 18 depicts a subsequent step in the filling of a product or material into the container utilizing the filling mechanism of the present invention;

FIG. 19 depicts a subsequent step in the filling of the container, after the time when the container is filled, shows reclosing of the container;

FIG. 20 depicts a subsequent step in the filling of the container, and shows a cleaning step in the process of filling the container;

FIG. 20*a* is an enlarged fragmentarily view of a portion of FIG. 20; and FIG. 21 shows the filled container at a nearly final step preparatory to separation of the container from the filling mechanism;

FIG. 22 is a fragmentary cross sectional view of a portion of yet another embodiment of a container according to the present invention;

FIG. 23 provides a cross sectional view of the cap member of the container seen in FIG. 22, and depicts this cap member at a step in the manufacture of this plug member;

FIG. 24 provides a fragmentary cross sectional view of a filling device preparatory to filling a container of the type seen in FIG. 22, and each embodying the present invention;

FIG. 25 provides a fragmentary cross sectional view similar to that of FIG. 24, with the filling device and container being depicted at a subsequent step in the process of filling the container;

FIG. 26 provides a fragmentary cross sectional view similar to that of FIGS. 24 and 25, with the filling device at a subsequent step in the process of filling the container, a step in which the container is opened;

FIG. 27 is a fragmentary cross sectional view of the container and filling device during the process of flowing material into the container;

FIG. 28 is an exploded fragmentary cross sectional view in perspective of a portion of yet another embodiment of a container according to the present invention;

FIG. 29 provides a cross sectional assembly view of the plug member and spout member of the container seen in FIG. 28;

FIG. 30 provides an exploded fragmentary cross sectional view in perspective of a container of the type seen in FIGS. 28 and 29, with the container being re-closed after filling according to the present invention;

FIG. 31 is an exploded fragmentary cross sectional view in perspective of a portion of yet another embodiment of a container according to the present invention;

FIG. 32 provides a cross sectional assembly view of the plug member and spout member of the container seen in FIG. 31;

FIG. 33 provides a fragmentary cross sectional view in perspective of a container of the type seen in FIGS. 31 and 32, with the container being opened in preparation to filling the container according to the present invention;

FIG. 34 is an exploded fragmentary cross sectional view in perspective of the container with the plug member opened from the spout member;

FIG. 35 provides an exploded fragmentary cross sectional view in perspective of the container seen in FIGS. 31–34, with the container being re-closed after filling according to the present invention;

FIG. 36 is an exploded fragmentary cross sectional view in perspective of a portion of still another embodiment of a container according to the present invention;

FIG. 37 provides a cross sectional assembly view of the plug member and spout member of the container seen in FIG. 36;

FIG. 38 provides a fragmentary cross sectional view in perspective of a container of the type seen in FIGS. 36 and 37, with the container being opened in preparation to filling the container according to the present invention;

FIG. 39 is an exploded fragmentary cross sectional view in perspective of the container with the plug member opened from the spout member in preparation for reclosing the container;

FIG. 40 provides an exploded fragmentary cross sectional view in perspective of the container seen in FIGS. 36–39, with the container being re-closed after filling according to the present invention;

FIGS. 41 and 41A provide fragmentary cross sectional perspective views of a filling mechanism for filling containers as seen in FIGS. 36–40, and with FIG. 41A being an enlarged view of a portion of FIG. 41;

FIGS. 42 and 42A provide fragmentary cross sectional perspective views of the filling mechanism seen in FIGS. 41 and 41A, with FIG. 42A being an enlarged view of a portion of FIG. 42, and with the container and filling mechanism at a subsequent step in the filling process;

FIG. 43 provides a fragmentary cross sectional perspective view of the filling mechanism seen in FIGS. 41, and 42, with the container and filling mechanism at a step in the filling process during which product or material is flowing into the container;

FIGS. 44 and 44A provide fragmentary cross sectional perspective views of the filling mechanism seen in FIGS. 41–43, with FIG. 44A being an enlarged view of a portion of FIG. 44, and with the container and filling mechanism being at a step preparatory to reclosing the container; and FIGS. 45 and 45A provide fragmentary cross sectional perspective views of the filling mechanism seen in FIGS. 41–44, with FIG. 45A being an enlarged view of a portion of FIG. 45, and with the container and filling mechanism being at another preparatory step to reclosing the filled container.

DETAILED DESCRIPTION OF EXEMPLARY PREFERRED EMBODIMENTS OF THE INVENTION

While the present invention may be embodied in many different forms, disclosed herein are three specific exemplary embodiments that illustrate and explain by example the principles of the invention. In conjunction with the description of these embodiments, a method of making and using the embodiments is described. It should be emphasized that the present invention is not limited to the specific examples and exemplary preferred embodiments illustrated herein. In other words, many modifications, alternatives, and substitutions will suggest themselves to those ordinarily skilled in the pertinent arts. Of course, recitation of all of these modifications, alternatives, and substitutions in this document would result in an unreasonable burden both on the Applicant, and on the reader. Accordingly, each and every disclosure and detail of the present specification is to be considered as exemplary and not as limiting, and the invention is intended to be limited only by the spirit and scope of the appended claims.

Particularly, this invention concerns a bag type of container having a spout member providing communication with a variable-volume cavity within the container, and a cap member closing the spout member. The cap member is unitary, and includes a plug portion sealingly fitting into the spout member, and a skirt portion arranged about and locking onto the spout member. The cap member outwardly presents a surface portion to be sterilized. In preparation for filling the bag with material introduced into the cavity via the spout member, the cap member is separated within the sterilized surface portion into a plug portion and a skirt portion. For filling of the container, the plug portion is removed from the spout member while the skirt portion remains on the spout member.

It is to be noted that reference herein to a particular drawing Figure also includes reference to the enlarged fragmentary views accompanying that drawing Figure. For example, reference to FIG. 1, also includes reference to fragmentary views 1*a* and 1*b*.

First Embodiment

An Overview of a Container

Figure 1:
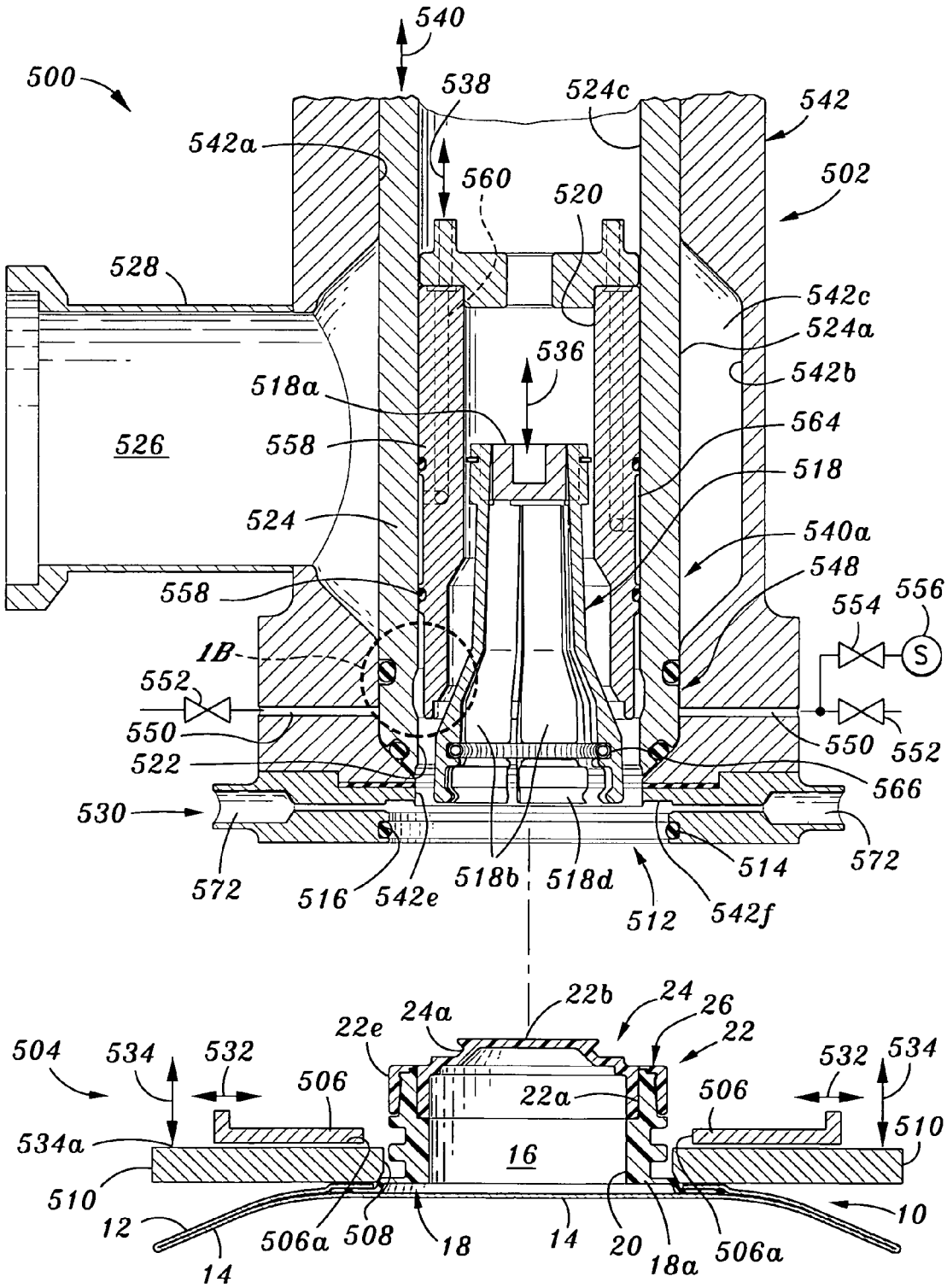
Figure 1A:
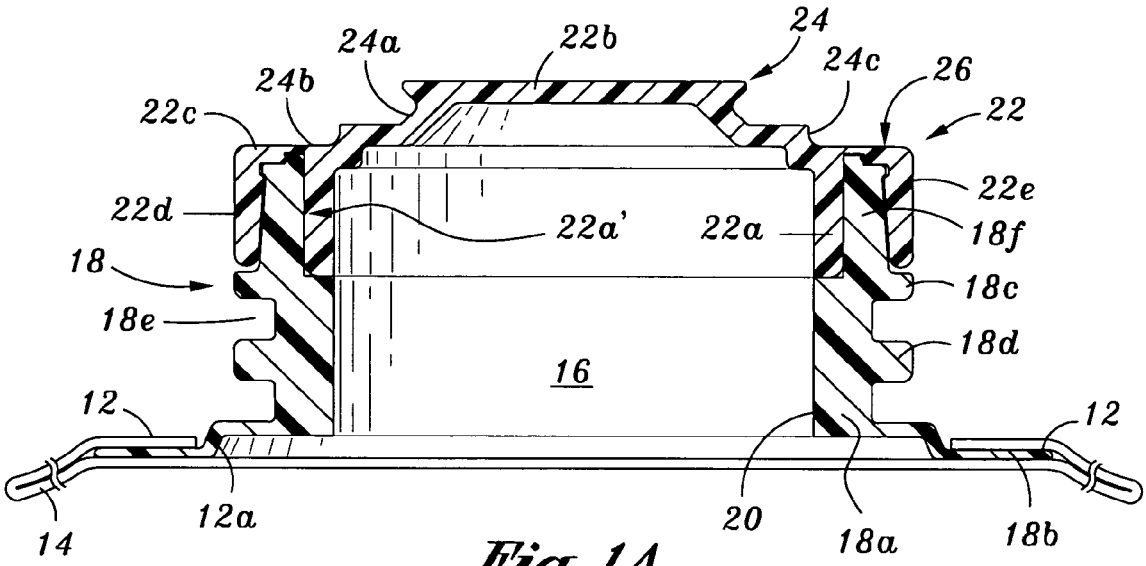

Referring first to FIG. 1, a container 10 of the flexible bag type is illustrated. This container 10 includes a pair of walls 12, 14 (although the invention is not so limited. That is, the container may have more than two walls) cooperatively defining a variable-volume cavity or chamber 16 (the cavity being collapsed in FIG. 1). One of the walls (wall 12 in this case) defines a hole 12*a*, and a tubular spout member 18 is sealingly attached to the wall 12. The tubular spout member 18 includes a body 18*a* defining a passage 20 communicating with the cavity 16, and outwardly this spout member defines a radially outwardly extending flange portion 18*b* at which the wall 12 is sealingly attached. Spaced from the flange 18*b*, the body 18*a* defines a pair of radially outwardly extending collar portions 18*c* and 18*d*, although the invention is not so limited. That is, the spout member may have only a single collar which is employed to grasp and manipulate the spout member. These collar portions 18*c* and 18*d* cooperatively define therebetween a radially opening circumferential groove 18*e*. It will be seen that the collars 18*c*, 18*d*, and groove 18*e* are effective to allow gripping and manipulation of the spout member 18. Above the collar 18*c* (i.e., above as seen in FIG. 1), the spout member body 18*a* includes a cylindrical tubular portion 18*f*.

Sealingly received onto the spout member 18 (i.e., onto and around the cylindrical tubular portion 18*f*) is a cap member 22. This cap member generally includes a cylindrical portion 22*a* which is received sealingly into the passage 20 within portion 18*f* of the spout member body 18*a*. The portion 22*a* forms with the spout member 18 a sealing interface or sealing line, generally indicated with the arrowed numeral 22*a'*. The cap member 22 includes a wall portion 22*b* which spans and closes the cylindrical portion 22*a* (thus also closing the passage 20). Further, a radially outwardly extending flange portion 22*c* extends outwardly to carry a depending apron or skirt portion 22*d*. The skirt portion 22*d* is circumferentially continuous, and this skirt portion closely radially outwardly overlies the cylindrical portion 18*f* of the spout member. Skirt portion 22*d* outwardly defines a smooth cylindrical surface 22*e*, and it will be seen that this surface 22*e* is sealingly engageable.

As is seen in FIG. 1, the cap member 22 includes a centrally disposed outwardly (that is, upwardly) extending boss portion 24. This boss portion 24 is undercut or recessed radially to provide a radially outwardly opening circumferential groove 24*a*. Also, radially outwardly of the groove 24*a*, the boss portion 24 defines an axial step 24*b*, so that a radially disposed shoulder 24*c* is outwardly presented on the cap member 22. It will be seen that the cap member 18 is sealingly engageable at the step 24*b* and/or at shoulder 24*c* (as will be further explained). Consequently, the cap member 22 outwardly presents a sterilizable surface, generally indicated with the arrowed reference numeral 26, which is circumferentially continuous, and which extends radially between the step and/or shoulder indicated respectively with reference numerals 24*b* and 24*c*, and outwardly to include at least a portion of the surface 22*e*, although the invention is not so limited. In other words, the sterilizable area may be selected to have a greater or lesser radial extent than is illustrated and described in this particularly preferred embodiment. Also, the sterilizable area 26 may extend more fully down the side surface 22*e*, so that the cap member may be separated in an axial direction according to this preferred embodiment, or may alternatively be separated in a radial direction if desired.

It is further to be noted that the drawing Figures depict the bag 10 as it would appear without this bag being contained within a drum, barrel, box, or crate (not shown). In actual use it is likely that the flexible bag 10 will be contained within the confines of an outer protective and shape retaining drum, box, crate, etc., for greater safety, security, and ease of handling and storage.

An Overview of the First Embodiment of a Filling Mechanism

Now viewing FIGS. 1–10 in conjunction with one another, it should be noted that these Figures show a sequence of steps for filling the bag container 10 utilizing a bag container filling mechanism or filling system, generally indicated with the numeral 500.

First viewing FIG. 1, an empty flexible bag container 10 can be seen in preparatory alignment and confrontation with a filling head assembly portion 502 of the filling mechanism 500. The container 10 is received and preliminarily held in this position by a gripper and elevator assembly, generally referenced the numeral 504. This gripper and elevator assembly 504 includes a pair of cooperative gripping jaws 506 shown in their open position in FIG. 1 and in their closed position in FIG. 2. These jaws are controllably and selectively movable horizontally (in the orientation of the mechanism shown in the drawing Figures, to which the invention is not limited) between their opened and closed positions, as is indicated by the associated arrows (to be further identified below) on FIG. 1. In the closed position of these jaws 506, a substantially arcuate surface portion 506*a* of each of the jaws is received into the groove 18*e* between the pair of collars 18*c*, 18*d*. In the open position of the jaws 506, the spout member 18 (including cap member 22, as seen in FIG. 1) is receivable upwardly into an aperture 508 defined by an elevator member 510 of the assembly 504. The elevator member 510 is plate like, and carries the gripping jaws 506. Also, the elevator member 504 is controllably and selectively movable vertically between a first position seen in FIG. 1, a second position seen in FIG. 2, a third position seen in FIGS. 3–8, a fourth position seen in FIG. 9 (which fourth position has substantially the same vertical level as the second position, although the invention is not so limited), and then back to the first position of FIG. 1. The vertical movements of the elevator member 504 between the identified positions may agree with the sequence just described, or may be altered at will depending upon the necessities of the filling process to be further described below.

Figure 3:
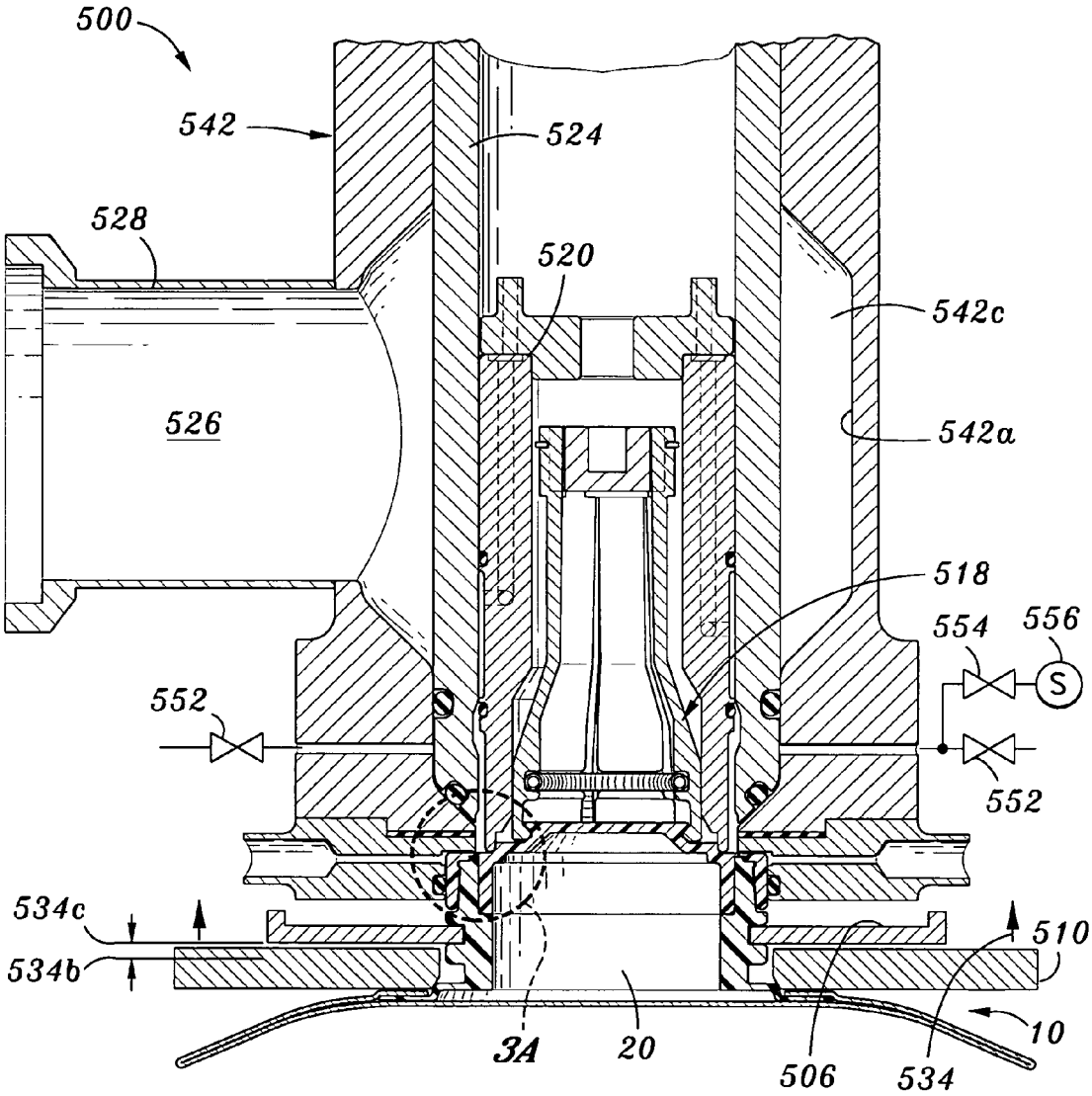
Figure 3A:
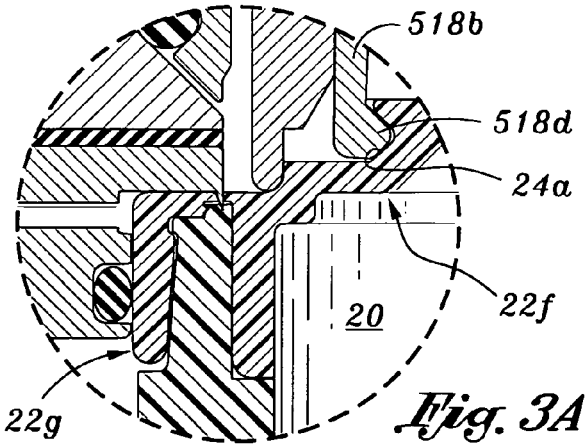
Figure 8:
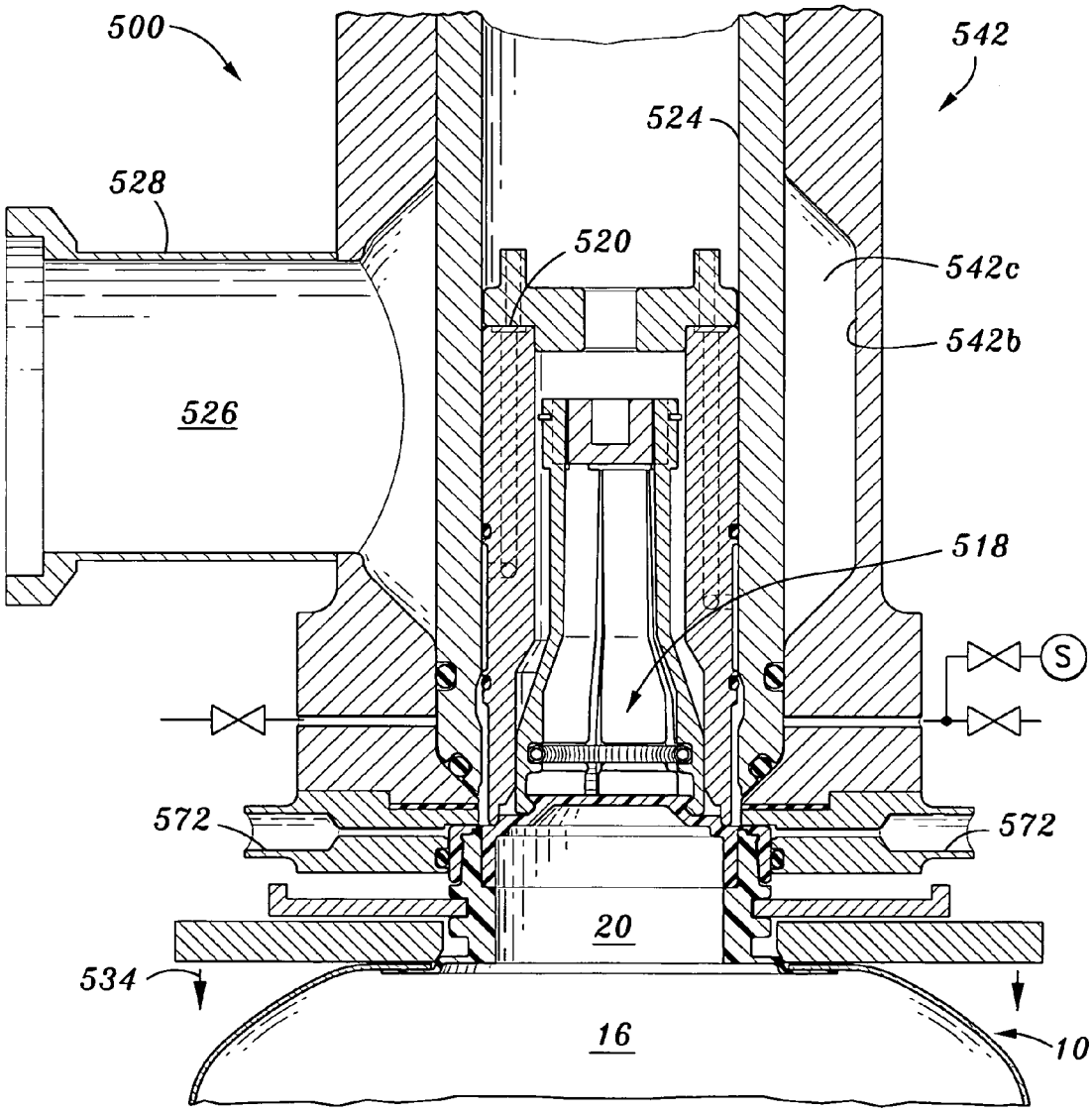
FIG. 8 depicts a next-subsequent step in the filling of the container, and shows reclosing of the container.
Figure 9:
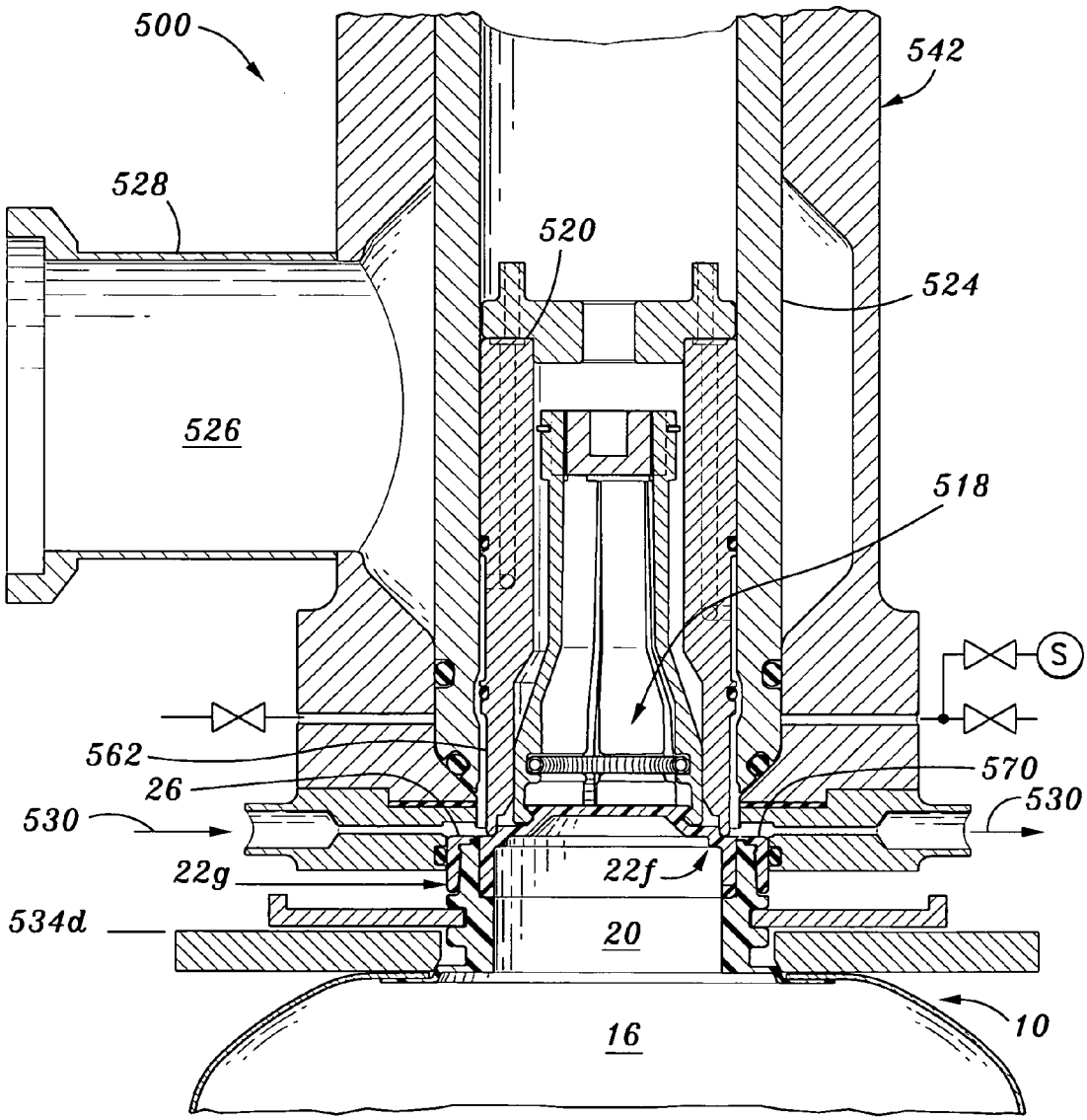
FIG. 9 shows a cleaning step in the process of filling the container.
Figure 10:
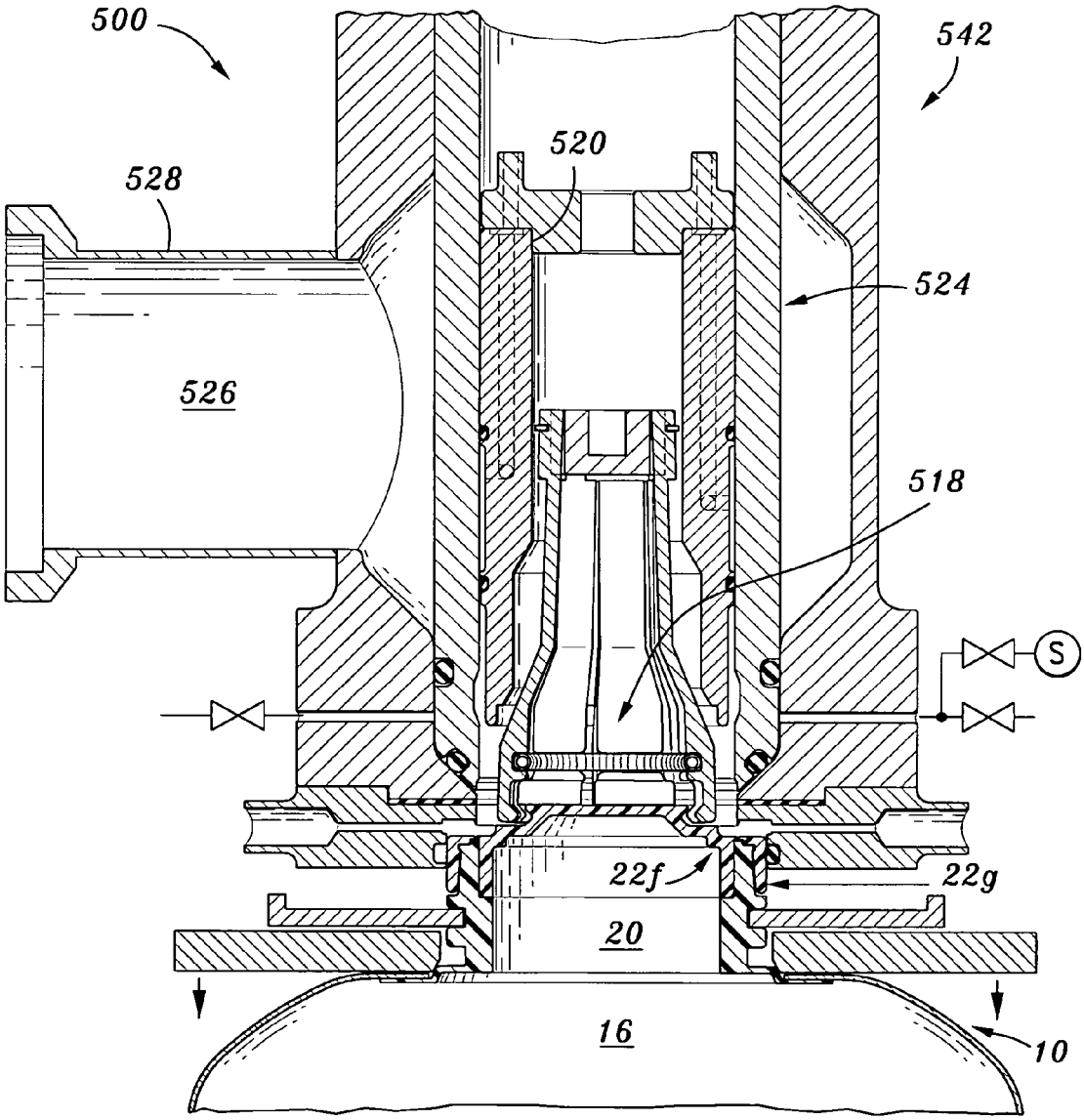
FIG. 10 depicts a near-final step in the filling of the container, in which the container is partially released from the filling mechanism.

In general, it will be seen that the filling mechanism 500 performs a sequence of steps or actions (referenced to the appropriate drawing Figures being provided in the following abbreviated listing of steps), including:

first griping and elevating (arrows on FIG. 1) the spout member 18 and cap member 22 in order to receive the spout member and cap member into a filling cavity 512 of the filling head assembly 502, in which the surface 22*e* is sealingly engaged by an O-ring type of sealing member 514 carried in a groove 516 of the filling head assembly 502 (FIG. 2); then grips the cap member 22 at groove 24*a* (by use of a collet assembly 518) and also sealingly engages with the cap member 22 at step/shoulder 24*b*/24*c* (by means of a collet closer sleeve 520) in order to isolate the sterilizable surface area 26 (FIG. 2), while simultaneously opening a sterilant flow path (to be identified and further described below) leading to the sterilizable surface area 26;

sterilizes the sterilizable surface area 26 (FIG. 2A) by flowing sterilant along the sterilant flow path;

within the sterilizable surface area separates the skirt portion 22*g* and plug portion 22*f* of the cap member 22 from one another (FIG. 3A);

withdraws the plug portion 22*f* of the cap member 22 from within the spout member 18, and draws this plug portion 22*f* sealingly into a plug portion recess 522 of a filling valve stem 524 of the filling head assembly 502 (FIG. 4); and then moves the filling valve stem 524 from a first closed position (FIGS. 1–4) to a second opened position (FIG. 5) effecting material flow in a material flow path 526 now in communication with the passage 20, so that material flows from a passage defined within a conduit 528 along the flow path 526 and through the passage 20 of spout member 18 into the container 10;

as the container 10 approaches being filled with material, the filling valve stem 524 is moved from its second opened position to a third still opened and throttling position (FIG. 6), while the plug portion 22*f* continues to be sheltered within the plug portion recess 522 of the filling valve stem 524; and then returns the filling valve stem 524 to its first closed position, stopping material flow into the container 10 (FIG. 7); and returns the plug portion 22*f* to a sealing position within the spout member 18 (FIG. 8); and subsequently lowers the spout member and cap member (still consisting of now separated skirt portion 22*g* and plug portion 22*f*) slightly in order to open a material flush flow path, generally indicted with the arrowed numeral 530, and flows flushing fluid across the sterilizable surface area 26 in order to substantially clean from this surface area any remnant of material resident thereon (FIG. 9);

withdraws the collet closer sleeve 520, effecting disengagement of the collet 518 from the boss portion 24 of plug portion 22*f* of cap 22 (noting once again that the cap member 22 has been divided into plug portion 22*f*, and separated skirt portion 22*g*) in order to prepare for withdrawal of the spout member and cap member from within the filling cavity 512 (FIG. 10);

finally, the filling mechanism returns the spout member 18 of the filled container 10 (with the cap member 22 closing this spout member) to the position seen in FIG. 1, in which the gripping jaws 506 open in order to release the filled container from the filling mechanism 500.

Considering now FIG. 1 in greater detail (and referring to the other Figures when indicated), it is seen that this Figure is also used to introduce the selective and controlled movements of the component parts of the filling mechanism 500. That is double headed horizontal arrows 532 on FIG. 1 indicate the movements of the gripping jaws 506 between their first position seen in FIG. 1, and their second position seen in FIG. 2. Similarly, double headed vertical arrows 534 (a general reference) indicate the vertical movements of the gripper/elevator member 504 between its first vertical position seen in FIG. 1 (indicated with a vertical reference 534*a*), a second vertical position seen in FIG. 2 (indicated by a vertical reference 534*b*), a third vertical position seen in FIG. 3 (indicated by a vertical reference 534*c*, and a fourth vertical position seen in FIG. 9 (indicated by a vertical reference 534*d*). It will be noted that the second (534*b*) and third (534*c*) vertical reference positions differ by only about 0.135 inch (indicated by confronting arrow heads on the left hand side of FIG. 3—although the invention is not so limited), and that the second (534*b*) and fourth (534*d*) vertical reference positions for the gripper/elevator 504 are substantially the same, although they need not be exactly the same.

Still considering FIG. 1, it is further noted that a double headed arrow 536 indicates the vertical movement of collet assembly 518 between first, second, and third positions relative to the filling valve stem 524. A double headed arrow 538 similarly indicates the relative vertical movement of collet closer sleeve 520 between positions relative to the filling valve stem 524. And also, a double headed arrow 540 indicates the vertical movements of filling valve stem 524 between a first (or closed) position (FIG. 1—reference arrow 540*a*), a second (or fully opened) position (FIG. 5—reference arrow 540*b*), and a third (or opened and throttling) position (FIG. 6—reference arrow 540*c*).

All of these controlled and selective motions indicated by arrows on the various drawing Figures, and described briefly above, are effected controllably by an actuator, or by a combination of actuators which are not illustrated in the present disclosure. These actuators may be mechanical, pneumatic, hydraulic, electrical servo mechanisms, or any combination of these and other types of actuator without limitation. Those ordinarily skilled in the pertinent arts will well understand how to effect the described motions for the indicated components of the filling mechanism, and the invention is not limited to any particular type of actuator, or to the precise sequence of motions disclosed. In other words, it may be desired to eliminate, combine, add to or alter some or all of the motions, and their sequence, as disclosed herein.

Continuing now with a consideration of FIG. 1, the filling head assembly 502 is seen to have a vertically extending generally tubular body 542, defining a vertical through bore 542*a*, in which the filling valve stem 524 is slidably and movably received. The bore 542*a* includes an enlarged diameter portion 542*b*, into which the material flow passage or conduit 528 opens. Thus, the enlarged diameter portion 542*b* provides a circumferential chamber 542*c* communicating with the conduit 528 and surrounding a portion of the filling valve stem 524. The bore 542*a* also includes a converging tapered (i.e., conical) portion 542*d* (best seen in FIG. 5), providing a conical valve seating surface (indicated also with the same numeral 542*d*). The seating surface 542*d* leads via a short cylindrical bore section 542*e*, and an outwardly stepped bore section 542*f*, to the filling cavity 512 (which opens outwardly and downwardly on the filling head assembly 502 in order to receive the spout member 18 and cap member 22, as previously described).

Reciprocally received in the bore 542*a* of the filling head body 542 is the filling valve stem 524, which is itself tubular in order to define a stepped outer diameter surface 524*a*, leading downwardly to a conical seating surface 524*b* (again, best seen in FIGS. 5 and 6), and also defining a stepped through bore 524*c*. The stepped outer diameter surface 524*a* includes one of a pair of spaced apart grooves 544*a* (best seen in FIGS. 5 and 6), and the other of this pair of grooves 544*b* is defined on the conical seating surface 524*b*. Each one of this pair of grooves receives a respective O-ring type of sealing member, each indicated with the numeral 546. As is seen in FIG. 1, when the filling valve stem 524 is in its first, or fully closed position, the pair of O-rings 546 each sealingly engage with the bore 542*a* at respectively vertically spaced apart locations.

Thus, an annular or circumferential chamber or space 548 (arrowed numeral on FIG. 1) is defined between the filling valve stem 524 and the filling head body 542, and between the pair of O-ring seals 546. As is also seen in FIG. 1, a pair of passages (each indicated with the numeral 550) communicate with the space 548. Outwardly of the space 548, each of the passages 550 leads to a respective one of a pair of valves 552, and one of the pair of passages 550 (the one on the right viewing FIG. 1) also leads to a second valve 554, and when this valve is open, communicates to a pressure sensor indicated with the circled "S" character, and the reference numeral 556. As will be further explained, the passages 550 and valves 552 may be employed to perform a number of pressure sensing and fluid supply functions. Particularly, leakage flow at the lower one of the pair of O-rings 546 can be detected, or prevented. Also, a sterile or sterilant fluid may be provided into the chamber 548 via the passages 550 to act as a barrier against migration of microbes. Leakage flow at either one of the O-rings 546 may be detected, for example, by using sensor 556 to detect a pressure change increase. Alternatively, one or both of the passages 550 may be employed to provide a dose of fluid at an elevated pressure into the chamber 548, after which fluid supply is shut off, and the sensor 556 is used to detect the rate of pressure loss (if any) as a form of leak down test.

Returning to a consideration of the filling valve stem 524, is seen that the inner diameter bore 524*c* of this tubular stem 524 defines a shallow groove 524*d* (best seen in FIG. 1*b*, but seen also in FIGS. 1 and 2) of slightly larger diameter than the remaining portion of the bore 524*c*. This shallow groove 524*d* has oppositely sloping or conical transition surface portions 524*e* (viewing FIG. 1*b*).

Received into the bore 524*c* of the tubular filling valve stem 524 is the collet closer sleeve member 520. This collet closer sleeve outwardly carries a pair of spaced apart O-ring type of seal members, each indicated with the numeral 558. As seen in FIG. 1, in the first position of the collet closer sleeve 520, the lower one of these O-ring seals 558 is sealingly engaged with the surface of bore 524*c* above the groove 524*d* (i.e., above the fragmentary view of FIG. 1*b*). However, in FIG. 2 it is illustrated that the lower one of the O-rings 558 is aligned with the shallow groove 524*d*. Thus, it is seen and should be recalled that the lower one of this pair of O-rings 558 can perform a valving function as the collet closer sleeve 520 moves relative to the filling valve stem.

Figure 1B:
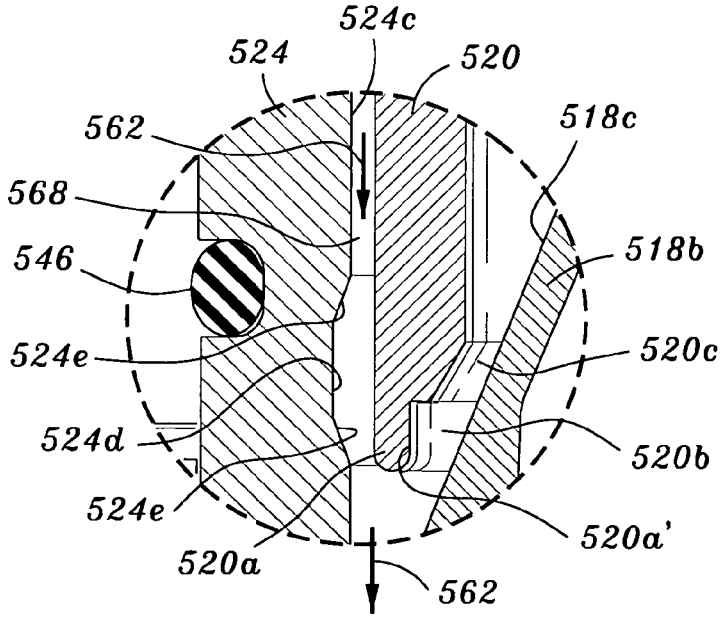
Figure 2:
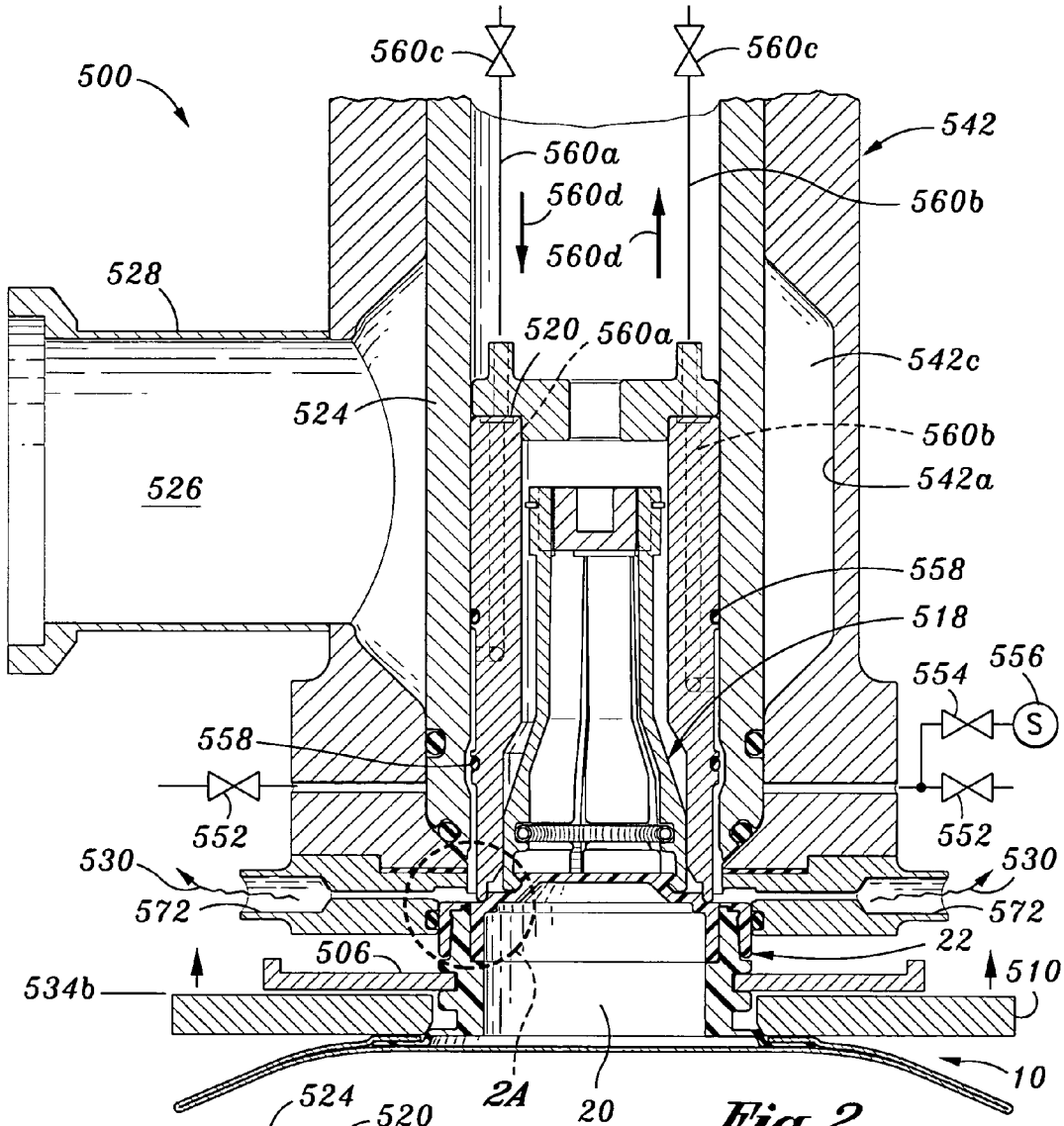

The collet closer sleeve 520 also defines a pair of passages 560*a* and 560*b* (seen in FIG. 2) each opening outwardly (generally at diametrically opposite locations) on this sleeve between the pair of O-rings 558, and each defining a portion of a sterilant circulation and supply flow path, generally indicated with the arrowed numeral 562 (best seen in FIG. 1*b*). As will be further explained, during a circulation phase of operation (which applies when the valve stem 524 is in its first or closed position) a sterilant material is circulated into one of the passages 560*a/b* and to annular chamber 564 defined between the pair of O-rings 558 (which annular chamber is also a part of the sterilant circulation and flow path indicated with arrowed numeral 562). The sterilant material then circulates out of the other of the two passages 560*a/b*. This circulation of sterilant (if that sterilant is steam) keeps the chamber 564 hot and free of condensate. The circulation of the sterilant material (again, which may be steam, for example) along the passages 560*a/b* is schematically illustrated in FIG. 2 with control valving indicated with the numeral 560*c* and sterilant circulation direction being indicated by arrowed numerals 560*d*.

At its lower termination, the collet closer sleeve 520 defines an axially extending collar portion 520*a* (FIG. 1*b*), which is sized at its end edge surface 520*a*' to seat sealingly upon the axial step 24*b* of the cap member 24. Further, this collar portion 520*a* also defines an internal bore portion 520*b* of a diameter substantially matching (possibly with an interference fit) that of the radial shoulder 24*c* on the boss portion 24 of cap member 22. Above the collar portion 520*a*, the collet closer sleeve 520 defines a chamfer surface (or actuating surface) 520*c* (FIG. 1*b*), which will be explained further to be slidably engageable with each of a plurality of collet fingers of the collet assembly 518.

Considering now the collet assembly 518, it is seen that this assembly includes and is carried in its vertical movement by a unison member 518*a*. The actuation indicated by arrow 536 depicts an actuator connection to this unison member 518*a*. The unison member 518*a* carries a plurality of collet fingers 518*b*, each extending downwardly inside of the collet closer sleeve 520, and each outwardly presenting a conical surface 518*c* (FIG. 1*b*), confronting the chamfer surface 520*c* of the collet closer sleeve 520. The collet fingers 518*b* are circumferentially discontinuous, but cooperatively define a circumferential array of closely spaced fingers, as is best seen in FIGS. 1 and 2). In FIG. 1, the collet 518 is in its opened position, and the fingers 518*b* are spaced apart at their lower ends, and cooperatively define an opening large enough to receive the boss 24 of the cap member 22.

Figure 2A:
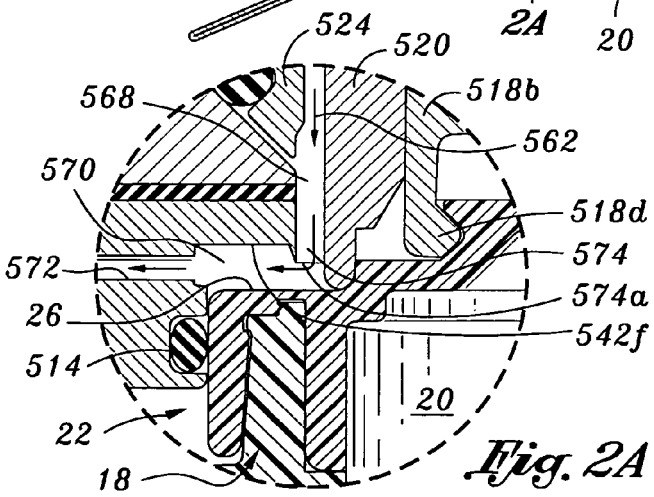

At their lower terminations, each of the collet fingers 518*b* defines a respective radially inwardly extending substantially arcuate rib portion 518*d* (FIG. 2*a*). This rib portion 518*b* is receivable into the groove 24*a* of the cap member 22. Above the arcuate rib portions 518*b*, each of the collet fingers 518*b* defines a respective circumferentially extending substantially arcuate section of a radially inwardly opening groove 518*e*. This groove 518*e* is indicated on FIG. 5 because of the lesser degree of reference numeral crowding on this Figure. This circumferential groove 518*e* cooperatively defined by the plural collet fingers 518*b* accepts and retains a circular garter spring member 566. This spring member 566 acts as a circular compression spring, and yieldably biases each of the collet fingers 518*b* to the opened position seen in FIG. 1. However, the spring 566 is yieldable so that the collet fingers 518*b* can move to their second position seen in FIG. 2, in response to the collet closer sleeve 520 moving relatively downwardly. When the collet closer sleeve does move downwardly around the lower portions of the collet fingers 518*b* (i.e., to the second position of the collet closer sleeve, as is seen in FIG. 2), the chamfer surface 520*c* engages on the conical surfaces 518*c* of the collet fingers 518*b*, and forces these fingers to their second position.

In preparation for filling a container 10, the container is placed in the position seen in FIG. 1, the gripper jaws 506 are closed from their first position seen in FIG. 1 to their second position seen in FIG. 2, securely holding the spout member 18 on the gripper/elevator 504 (i.e., in opening 508). Then the gripper/elevator 504 is elevated to its second position, seen in FIG. 2, inserting the cap member 22 into the filling cavity 512, as is seen in FIG. 2. As the cap member 22 is inserted into the filling cavity 512, the O-ring seal member 514 sealingly engages with the surface 22*e* of this cap member, so that the cap member is sealingly isolated from ambient within the filling cavity 512. In this position of the cap member 22, the boss portion 24 of the cap member will have entered the lower extent of the collet assembly 518, but will not be secured to this collet because the collet fingers 518*b* are yet in their open position, as is seen in FIG. 1.

FIG. 2 depicts the result of the collet closer sleeve 520 being moved relative to the filling valve stem 524 from its first position seen in FIG. 1 and to its second position seen in FIG. 2. The immediate effect of this movement of the collet closer sleeve 520 to its second position is that the chamfer 520*c* engages with the conical surfaces 518*c* of the collet fingers, and this plurality of collet fingers 518*b* close at their lower extent onto the boss 24. Consequently, the arcuate rib portions 518*d* of these collet fingers enter into the groove 24*a*. Subsequently, as the collet closer sleeve fully reaches its second position, the end edge surface 520*a*' sealingly (i.e., forcefully) engages against the cap member 22 at axial step 24*b* and/or sealingly engages about radial shoulder 24*c* (i.e., by engagement of this shoulder 24*c* within the bore 520*b* of the collar portion 520*a* of the collet closer sleeve 520). As a result, it will be seen that the sterilizable surface area 26 of the cap member 22 is isolated both from ambient (i.e., by the O-ring seal 514), and from the environment within the collet closer sleeve (i.e., inwardly of the end edge surface 520*a'*).

Also, as a result of the movement of the collet closer sleeve 520 to its second position seen in FIG. 2, the lower one of the pair of O-ring seal members 558 moves into alignment with the groove 524*d* within the filling valve stem 524 (FIG. 1*b*). As a result, the sterilant circulation and flow path (generally indicated previously with the arrowed numeral 562) is opened from passage 560, through an annular space 568 (FIGS. 1*b* and 2*a*) defined between the filling valve stem 524 and collet closer sleeve 520, and through an annular radially extending space 570 extending across the sterilizable surface area 26 of the cap member 22. This annular space 570 is upwardly bounded by the surface of the step 542*f* on the bore 542*a*. This sterilant flow path 562 leads to the material flush flow path 530, which in this instance provides an exit or venting flow path for the sterilant delivered along flow path 562. The material flush flow path 530 is preferably defined by a pair of diametrically opposed passages 572 defined by the filling head assembly 502, although the invention is not so limited. In this instance, both of the passages 572 are employed as exit passages for the sterilant delivered along flow path 530. At this time, the one of the circulation control valves 560*c* controlling exit circulation at the passages 560*a/b* is closed, while the supply side valve 560*c* remains open. Consequently, circulation in the passages 560*a/b* ceases, and the chamber 564 becomes a supply chamber for sterilant supplied along passage 560*a* to this chamber, and subsequently flowing along flow path 562, as best depicted in FIG. 2*a*.

Thus, as is indicated in FIG. 2*a* by the flow arrows extending along this sterilant flow path 562, and out of the flush flow path 530 (i.e., passage 572 as seen in FIG. 2*a*, flow exit arrows being seen on FIG. 2), sterilant flow (which may be sterile steam, or other sterilant at an elevated temperature, or may be another sterilant at lower or even ambient temperature) flows across and sterilizes the sterilizable surface area 26 of cap 22.

During this process (i.e., a time interval of sterilant flow is required) of sterilizing the sterilizable surface area 26, it is to be noted that in the event that any leakage takes place past the lower one of the pair of O-ring seals 546 and between the flow path 562 and the annular chamber 548, then the pressure level in chamber 548 will increase. By opening valve 554, and noting any pressure increase in chamber 548 by use of pressure sensor 556, the "health" of sealing integrity provided by the lower one of the O-ring seals 546 can be determined. Thus, in the event that leakage at the lower one of the pair of O-ring seals 546 is detected in this way (i.e., by a pressure increase in chamber 548 during sterilant flow), the upper one of this pair of O-ring seals will still provide sealing integrity between the sterilant flow path 562 and the material in chamber 542*c*. However, leakage of the lower one of the pair of O-rings 546 indicates that serial operation of the filling mechanism 500 to full successive containers 10 should be interrupted in order to allow replacement of the lower O-ring seal 546.

Alternatively, the valves 552 may be opened and the chamber 548 may be filled with a sterile material, such as sterile condensate, or with a sterilant such as steam. This sterile material or sterilant may be maintained at a higher pressure than the sterilizing flow in passage 562, so that no leakage flow into chamber 548 is possible. Thus, no still-viable microbes can be forced by sterilizing pressure in the flow path 562 past the O-rings 546 and into the material flow path at chamber 542*c*.

Or (still alternatively), a sterilant may be placed into chamber 548 in this way to act as an isolation barrier against microbes being forced into the material flow path. Sterilant material in chamber 548 does not need to be maintained at an elevated pressure because any microbes forced past the lower one of the two O-rings 546 will be killed by this sterilant.

Still further to the above, it should be noted that because the circulation of sterilant in passages 560*a/b* and chamber 564 is maintained until the chamber 564 becomes a supply chamber for sterilant flow along path 562, the steam or other sterilant so supplied is fresh and/or hot, and is most effective at achieving sterility on the sterilizable surface 26. Further, the sterilizable surface 26 is relatively small, so the time interval required to bring this surface and the other the surfaces bounding the chamber 570 to a temperature/time condition sufficient to assure sterility is also comparatively short.

Also, as is seen best in FIG. 2*a*, during the sterilant flow through chamber 570 and across surface 26, the flange portion 22*c* extends across the interface or sealing line 22*a*' defined by the cylindrical portion 22*a* of the cap member 22 and the spout member 18. Consequently, no still-viable microbes may be forced past this sealing interface and into the chamber 16 of the container 10.

Next, the gripper/elevator 504 moves from its second position to its third position (FIG. 3), in which the cap member 22 is brought fully into the filling cavity 512 and into engagement with the downwardly disposed surface of step 542*f*, eliminating the annular space 570, and sinking an annular or ring-shaped knife edge feature 574 (which is best seen in FIG. 2*a*, and which depends from the inner margin of step 542*f* of the filling head assembly 502 and into the filling cavity 512) into (and preferably axially downwardly through) the flange portion 22*c* of cap member 22. It will be noted that the invention is not limited to having the knife edge 574 cut completely through the flange portion 22*c*. But, preferably, the tip, point, or apex 574*a* of this knife edge 574 penetrates completely through the flange portion 22*c* and may penetrate slightly into the material of spout member 18 at the upper extent of tubular portion 18*f*. Alternatively, a shallow circumferential recess may be provided on the axial end surface of the spout member 18, so that the penetrating tip of the knife member 574 does not sink into or sealingly engage this end surface of the spout member 18. Further, it is to be noted that the knife edge 574 cuts the flange portion 22*c* within the boundaries of the sterilized surface 26. The knife edge 574 thus effectively separates the cap member 22 into a separate central plug portion (indicated now with numeral 22*f*) and a separate circumferential skirt portion (indicated now with numeral 22*g*), which are best seen in FIG. 3*a*. Thus, the sterilized surface 26 is separated into two parts, one of which is with the now separate plug portion 22*f*, and the other part of which is with the now separate skirt portion 22*g*.

Figure 4:
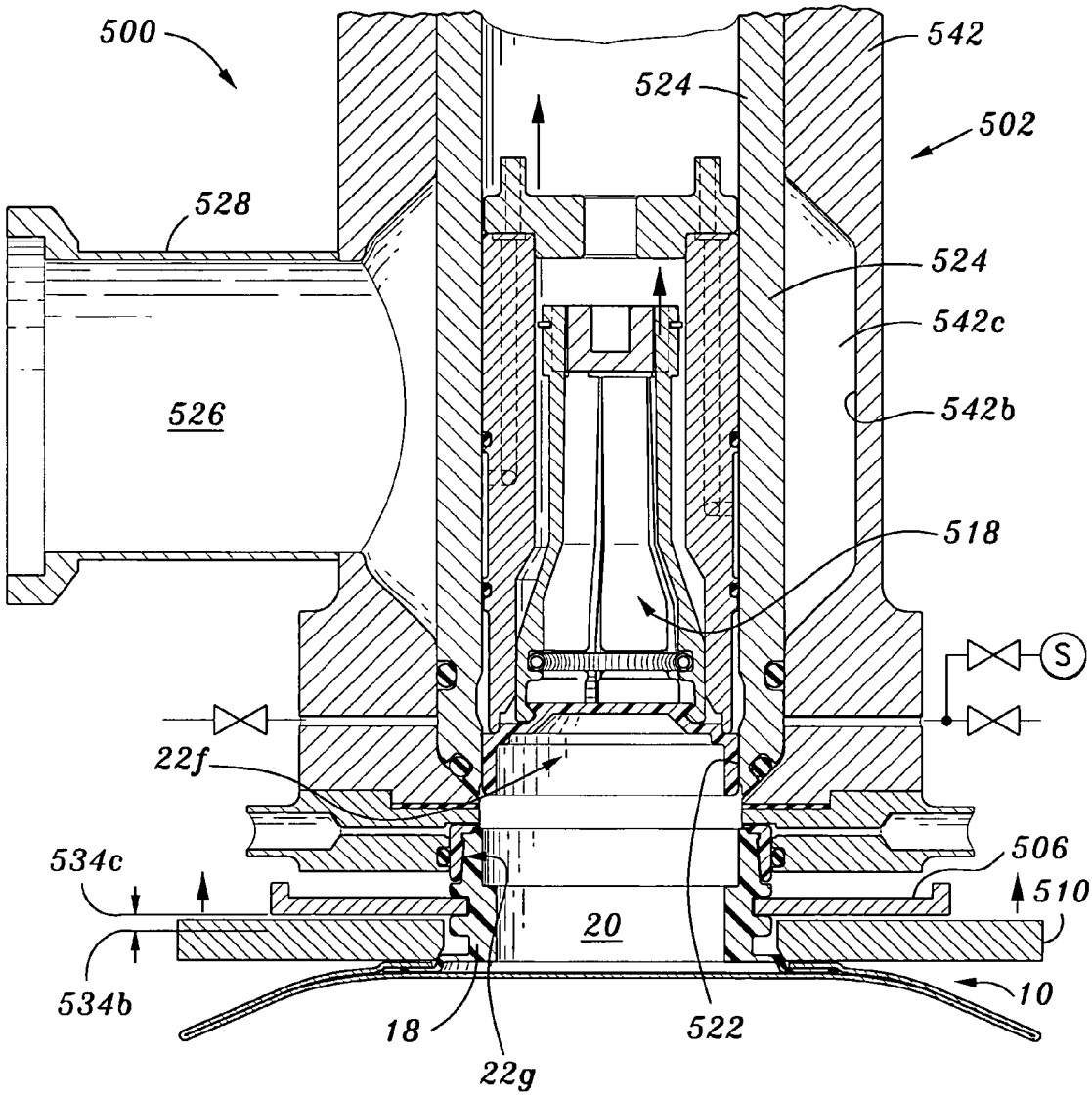
FIG. 4 illustrates a next-subsequent step in the process of filling the container utilizing the illustrated filling mechanism.

FIG. 4 illustrates that the collet assembly 518 and collet closer sleeve 520 are next moved together in unison to their second positions relative to the filling valve stem 524. This movement of the collet assembly 518 and collet closer sleeve 520 withdraws the plug portion 22*f* from within the spout member 18 and draws this plug portion axially (i.e., by vertical relative movement, viewing the drawing Figures) into the plug portion recess 522 within the lower extent of the filling valve stem 524. It will be seen viewing FIG. 4, that in this position of the plug portion 22*f*, there is substantially no part of the plug portion that protrudes axially outwardly (i.e., below) the lower extent of the filling valve stem 524. In other words, the plug portion 22*f* is received axially completely into the plug portion recess 522. Further, the plug portion recess 522 has an inner diameter slightly smaller than the diameter of the knife edge 574, so that there is an interference and sealingly tight fit of the plug portion 22*f* into the plug portion recess 522 of the filling valve stem 524. This sealing tight fit of the plug portion 22*f* into the plug portion recess 522 further isolates the upper surface of the plug portion 22*f* which lies within the annular portion of the sterilized surface 26 now carried with this plug portion 22*f*, from the material flow path 526, as will be appreciated by viewing FIG. 5. The skirt portion 22*g* remains in place on the spout member 18, as is depicted in FIG. 4.

Figure 5:
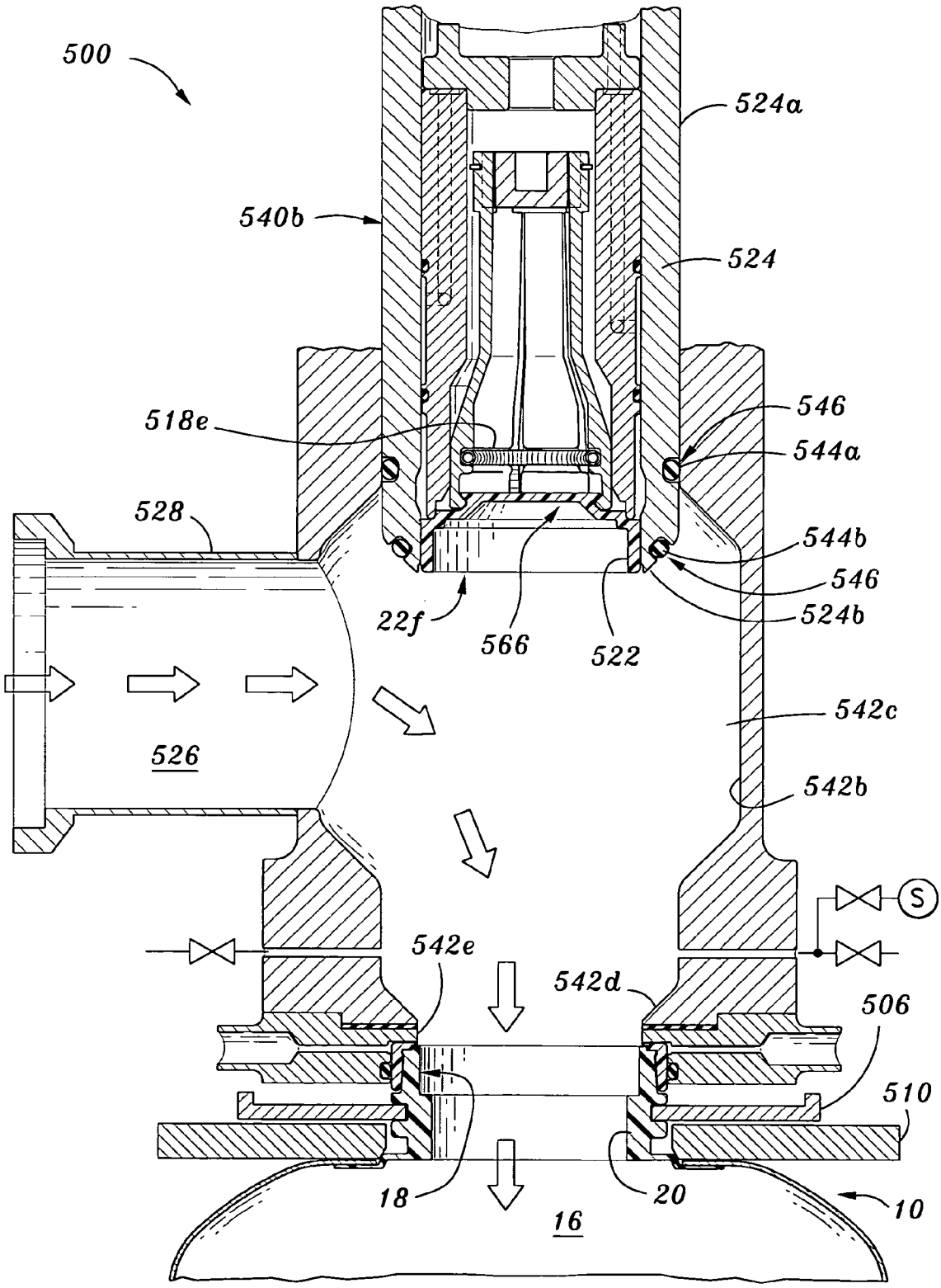
FIG. 5 depicts a subsequent step in the filling of a product or material into the container utilizing the filling mechanism of the present invention.
Figure 6:
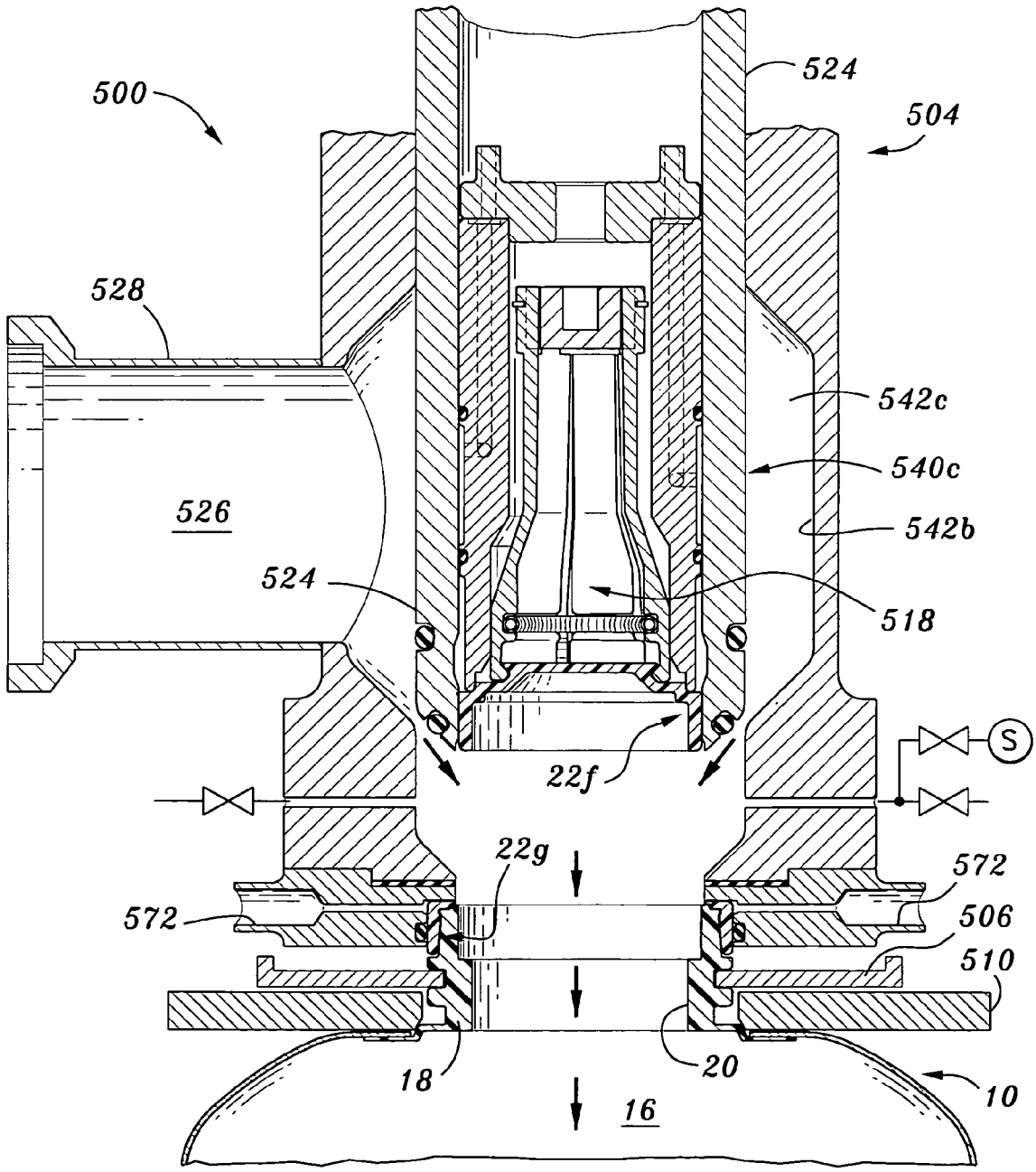
FIG. 6 depicts a subsequent step in the filling of the container, near the end time of this filling.

FIG. 5 now shows that the filling valve stem 524 is moved to its second position. This movement takes place in unison with the collet assembly 518, collet closer sleeve 520, and plug portion 22*f* within plug portion recess 522. In other words, the filling valve stem 524 carries these other parts along as it moves to its second position. Movement of the filling valve stem to its second position opens the material flow path 526 from conduit 528 through the chamber 542*c*, and along bore 542*a* to the spout member 18 and passage 20 of this spout member. Consequently, material flows from conduit 528 into the chamber 16 of the container 10, as is depicted by the flow arrows on FIG. 5. Considering again the sealing engagement of the plug portion 22*f* with the collet closer sleeve 520 (i.e., at collar portion 520*a* on step/shoulder 24*b*/24*c*) and the sealing engagement of the plug portion 22*f* within the plug portion recess of the filling valve stem (i.e., by interference fit of this plug portion 22*f* within the slightly smaller diameter plug portion recess 522), it is seen that a duality of sealing isolation of the unsterile central surface of boss 24 from the material flow path 526 is achieved by the present invention. That is, sterility of the flow path 526 is insured by maintaining a redundant isolation of the unsterile central boss surface 24 from the flow path 526.

As the container 10 becomes nearly filled with material flowed along flow path 526, it is desirable to be able to determine the amount of material placed into the container 10. This determination may be accomplished by weighing the container 10 and its contents in order to determine the amount of material that has been placed into this container. However, the impact and reaction of the material flowing into the container via the spout member 18 at full flow rates can interfere with this need to weigh the container 10 and its contents. Thus, FIG. 6 illustrates that the filling valve stem 524 is next moved to a third position in which the filling valve stem is still opened, but is closely spaced relative to the transition between chamber 542*c* and the smaller diameter portion of bore 542*a*. In this position of the filling valve stem 524, the valve stem performs a throttling function, considerably slowing the flow rate of material from conduit 528 into the container 10. Thus, the impact and reaction from material flowing into the container 10 is considerably reduced, and the container and its contents can more easily and accurately be weighed. It is to be noted in FIG. 6 that the plug portion 22*f* is completely sheltered within the plug portion recess 522 during this throttling operation. Thus, the plug portion 22*f* has no part in this throttling of material flow, and the high velocity of material flow that takes place at the "pinch" or place of minimal flow area between the filling valve stem and the body 542 of the filling head has no impact on the plug portion 22*f*. Accordingly, there is no tendency during a throttling interval, or during closing of the filling valve stem, for the plug portion 22*f* to be dislodged from the end of the filling valve stem.

Alternatively, the determination of how much material has been placed into container 10 may be accomplished by use of a flow meter system (i.e., an accumulating volume flow measurement system). In this case, it may still be desirable to utilize the throttling step illustrated by FIG. 6. On the other hand, the throttling step of FIG. 6 may possibly be eliminated by use of a predictive determination of the moment at which the flow is to be stopped, and the inclusion in this predication of a compensation factor accounting for flow taking place during transition of the filling valve stem from its fully opened to it closed position. Thus, the time and action needed to utilize the throttling step of FIG. 6 can possibly be eliminated.

Figure 7:
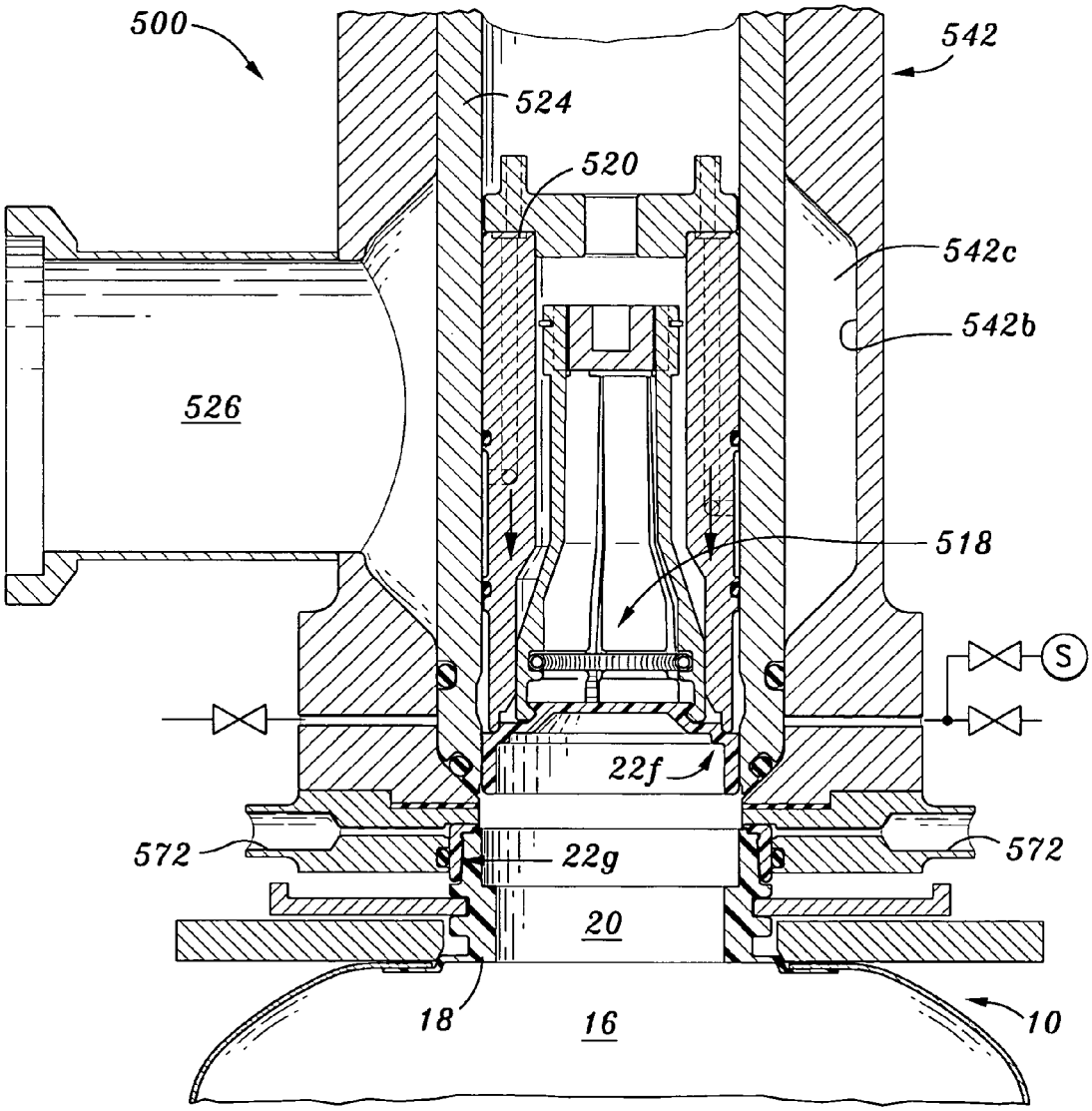
FIG. 7 depicts a subsequent step in the filling of the container, after the time when the container is filled, and preparatory to reclosing the container.

FIG. 7 illustrates that the filling valve stem is next returned to its first or closed position, stopping flow of material into the container 10. FIG. 8 shows that the collet assembly 518 and collet closer sleeve 520 are next advanced downwardly relative to the filling valve stem 524 so that the collet assembly 518 is returned to its first position, returning the plug portion 22*f* to its original position within and closing the spout member 18. FIG. 9 illustrates that the gripper/elevator 504 is next lowered to its fourth position (substantially the same as the second position) along with the collet assembly 518 and collet closer sleeve 520 to lower the spout member 18 and cap member 22 (now consisting of separate plug portion 22*f* and skirt portion 22*g*) slightly out (i.e., downwardly, viewing the drawing Figures) of the filling cavity 512. This downward movement of the spout member 18 and cap member 22 once again opens up the annular space 570 extending across the sterilizable surface 26, and withdraws the knife edge 574 from the material of flange portion 22*c* of cap member 22. In this position of the cap member, the material flush flow path 530 (passages 572) and/or sterilant flow path 562 are employed to introduce a sterile flushing material (sterile water perhaps) along one of the pair of passages 572, while the other of the pair of passage 572 is employed as a flush out passage. Sterile steam or another sterilant may be introduced along the sterilant flow path 562 as described earlier in order to assist in agitating and removing any material still resident on the outside of the cap 22. This flushing flow results in the flushing fluid, sterilant, and removed material flowing out of the other one of the pair of passages 572, as is indicated by the arrows on FIG. 9.

FIG. 10 depicts that the collet closer sleeve 520 is next elevated to its first position relative to the filling valve stem 524, allowing the collet assembly 518 to open and release the cap member 22 (actually releasing the now separate plug portion 22*f* of this cap member 22). Subsequently, the gripper/elevator 504 is lowered to its first position (as seen in FIG. 1) and the gripper jaws 506 are opened to their first position (also as seen in FIG. 1) so that the filled container 10 can then be removed from the filling mechanism 500 to be moved to a place of storage or prepared for shipment.

Second Embodiment

An Overview of a Container

Figure 11:
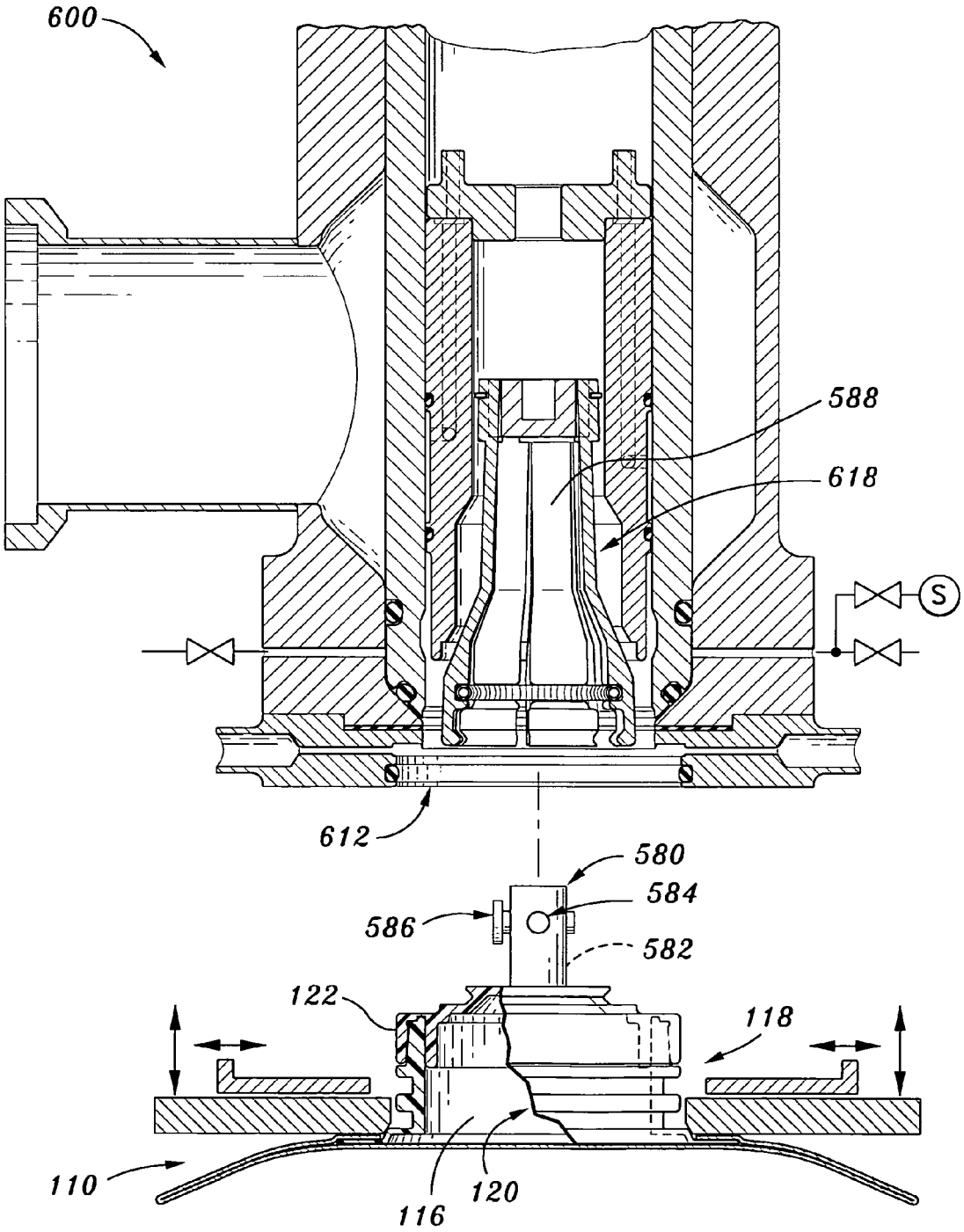
FIG. 11 is a fragmentary view, partly in cross section, showing a portion of another (i.e., second) embodiment of a bag filling mechanism and container embodying the present invention.
Figure 12:
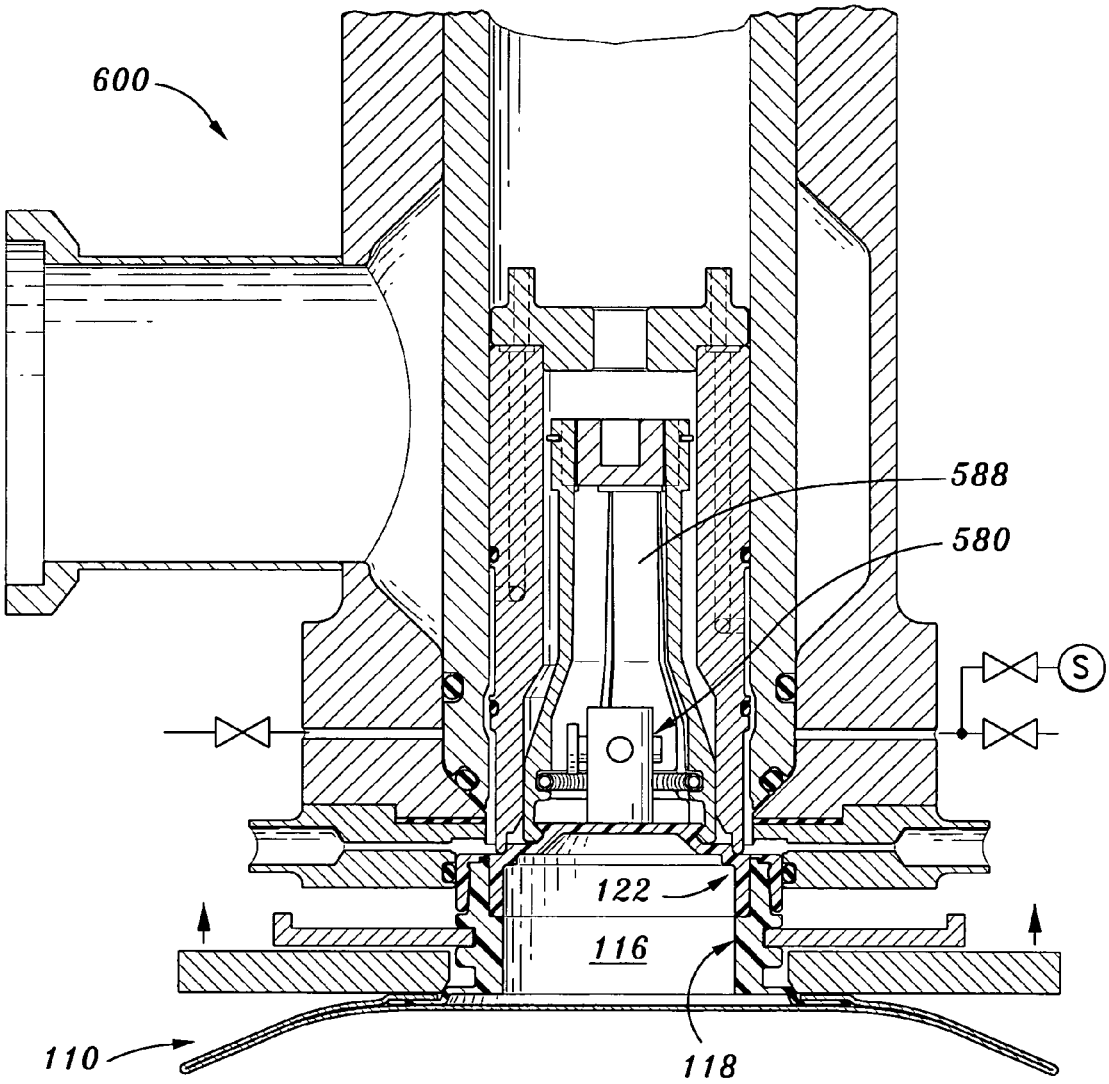
FIG. 12 is a fragmentary view, similar to FIG. 11, but showing the mechanism and container at a stage of filling analogous to that shown in FIG. 2.

Turning now to FIGS. 11 and 12 in conjunction, these drawing Figures illustrate an alternative embodiment of container for use to implement the present invention, and embodying the present invention. Because the alternative embodiment of FIGS. 11 and 12 has many features in common with the first embodiment depicted and described by reference to FIGS. 1–10. Accordingly, features of FIGS. 11 and 12 which are analogous in structure or function to those of FIGS. 1–10 are referenced with the same numeral used above, but increased by one hundred (100). It will be noted viewing FIGS. 11 and 12, that the filling mechanism 600 is substantially the same as or identically the same as the filling mechanism 500 depicted and described above by reference to drawing FIGS. 1–10. Such may be the case, although the invention is not so limited. In essence, the container 110 is also the same as container 10 depicted and described above, except that the cap member 122 includes and carries a dispensing spigot 580. This dispensing spigot defines a passage, indicated with dashed line arrow 582, which communicates outwardly through the spigot from the chamber 116 of the container 110 and to a dispensing port indicated with arrowed numeral 584. A dispensing control handle 586 is disposed on the spigot 580 and controls flow of material from within container 110 through the passage 582 and from port 584.

Viewing FIG. 11, it is seen that the container 110 is engaged at spout member 118 in just the same way as container 10. The filling mechanism 600 is configured in this case just like the mechanism 500, although the invention is not so limited. In other words, while the filling mechanism 600 in common with filling mechanism 500, has sufficient space in an axially extending cavity 588 inside of the collet assembly 618 for the spigot 580 carried on cap member 122, it is possible to provide a larger spigot on such a cap member, and to configure the filling mechanism to have a more spacious cavity within the collet assembly.

FIG. 12 shows that the container 110 with spout member 118 and spigot 580 on cap 122 is received into the filling cavity 612, just like the container 10 was received into filling cavity 512. However, in this case, the spigot extends upwardly into cavity 588 such that the spigot does not interfere with the operation of the collet assembly 618. In all other respects, the structure and operation of the embodiment shown in FIGS. 11 and 12 is the same as that shown and described by reference to FIGS. 1–10.

Third Embodiment

An Overview of a Container

Because the third alternative embodiment of FIGS. 13–21 has many features in common with the first embodiment depicted and described by reference to FIGS. 1–10, features of the filling mechanism of FIGS. 13–21 which are analogous in structure or function to those of FIGS. 1–10 are referenced with the same numeral used above, but increased by two hundred (200). Features of the container are increased by twenty (20) over FIGS. 1–10.

Referring first to FIG. 14, a container 30 of the flexible bag type is illustrated. This container 30 includes a pair of walls 32, 34 cooperatively defining a variable-volume cavity 36. A tubular spout member 38 is sealingly attached to the wall 32. The tubular spout member 38 includes a body 38*a* defining a passage 40 communicating with the cavity 36, and outwardly this spout member defines a radially outwardly extending flange portion 38*b* at which the wall 32 is sealingly attached. Spaced from the flange 38*b*, the body 38*a* defines a pair of radially outwardly extending collar portions 38*c* and 38*d*. These collar portions 38*c* and 38*d* cooperatively define a radially opening circumferential groove 38*e*. Above the collar 38*c*, the spout member body 38*a* includes a cylindrical tubular portion 38*f*. This cylindrical portion 38*f* includes a radially outwardly extending circumferential lip 38*h* disposed near the termination of this tubular portion 38*f*.

Sealingly received onto the spout member 38 is a cap member 42 including a cylindrical portion 42*a* which is received sealingly into the passage 40. The cap member 42 includes a wall portion 42*b* which spans and closes the cylindrical portion 42*a*, and a radially outwardly extending flange portion 42*c* extends outwardly to carry a depending apron or skirt portion 42*d*. It will be noted in FIG. 14 that the flange portion 42*c* is relatively thin, or is of fine-dimension thickness. Thus, this flange portion 42*c* will be understood to be frangible.

The skirt portion 42*d* is circumferentially continuous and outwardly overlies the cylindrical portion 38*f* of the spout member. Near its lower termination, the skirt portion 42*d* defines a radially outwardly extending circumferential shoulder or step 42*h*. Above the step 42*h*, the skirt portion 42*d* presents a radially outwardly disposed smooth cylindrical surface 42*e*, and it will be appreciated that this surface 42*e* is sealingly engageable.

Again, as is seen in FIG. 14, the cap member 42 includes a centrally disposed upwardly extending boss portion 44, which is undercut or recessed radially to provide a radially outwardly opening circumferential groove 44*a*, and which is stepped at 44*b* to present a radially disposed shoulder 44*c*. Consequently, the cap member 42 outwardly presents a sterilizable surface, generally indicated with the arrowed reference numeral 46, which is circumferentially continuous, and which extends radially between the step and/or shoulder indicated respectively with reference numerals 44*b* and 44*c*, and outwardly to include at least a portion of the surface 42*e*.

An Overview of the Second Embodiment of a Filling Mechanism

Now viewing FIGS. 13–21 in conjunction with one another, it should be noted that these Figures show a sequence of steps for filling a bag container 30 utilizing a bag container filling mechanism or filling system, generally indicated with the numeral 700. The bag container 30 has many features in common with or similar to those described above with reference to the first embodiment of bag container.

First viewing FIG. 13, an empty flexible bag container 30 can be seen in preparatory alignment and confrontation with a filling head assembly portion 702 of the filling mechanism 700. The container 30 is held in by a gripper and elevator assembly 704, including a pair of gripping jaws 706 with substantially arcuate surface portions 706*a*. The gripping jaws 706 are carried on an elevator member 710. The filling mechanism 700 performs a sequence of steps or actions like those described and disclosed above, except that the embodiment of FIGS. 13–21 does not employ the use of knife edge to separate a skirt portion 42*g* and a plug portion 42*f* of a cap member 42. In the embodiment of FIGS. 13–21, the skirt portion 42*g* of the cap member 42 is connected to the plug portion by a frangible flange portion 42*c*. This frangible flange portion 42*c* is fractured, by for example, the application of elongation stress, in order to separate the skirt portion and plug portion of the cap member 42, as is further described below. It will be noted that the invention is not limited to fracturing the frangible flange portion by elongation stress, and that other methods of fracturing the flange portion may be employed.

Thus, the drawing FIGS. 13–21 present a series of method steps including:

first griping (FIG. 13) and elevating the spout member 38 and cap member 42 in order to receive the spout member and cap member into a filling cavity 712 of the filling head assembly 702, in which the surface 42*e* is sealingly engaged by a pair of O-ring type of sealing members 714*a* and 714*b* each carried in a respective one of a pair of grooves 716*a* and 716*b* of the filling head assembly 702 (FIG. 13), although the invention is not so limited; then grips the cap member 42 at groove 44*a* (by use of a collet assembly 718) while sealingly engaging the cap member 42 at step/shoulder 44*b*/44*c* with the end edge of a collet closer sleeve 720 and opening a sterilant flow path leading to the sterilizable surface area 46;

sterilizes the sterilizable surface area 46 (FIG. 15*a*) by flowing sterilant along a sterilant flow path 762;

within the sterilizable surface area fractures flange portion 42*c* and separates the skirt portion 42*g* and plug portion 42*f* of the cap member 42 from one another (FIGS. 16 and 16A); and moves the skirt portion 42*g* to a second position on spout member 38 (FIG. 16*a*);

withdraws the plug portion 42*f* of the cap member 42 from the spout member 38 and sealingly into a plug portion recess 722 of a filling valve stem 724 of the filling head assembly 702 (FIG. 17); and then moves the filling valve stem 724 from a closed position (FIGS. 13–17) to an opened position (FIG. 18) in order to flow material through the passage 240 of spout member 38 into the container 30;

returns the filling valve stem 724 to its first closed position, stopping material flow into the container 30 (FIG. 19) (a throttling step may be included, as described above); and returns the plug portion 42*f* to a sealing position within the spout member 38 (also seen in FIG. 19); and subsequently lowers the spout member and cap member (still consisting of now separated skirt portion 42*g* and plug portion 42*f*) slightly in order to open a material flush flow path, generally indicted with the arrowed numeral 730, and flows flushing fluid across the sterilizable surface area 46 in order to substantially clean from this surface area any remnant of material resident thereon (FIGS. 20 and 20*a*);

withdraws the collet closer sleeve 720, effecting disengagement of the collet 718 from the boss portion 44 of plug portion 42*f* of cap 42 (noting once again that the cap member 42 has been divided into plug portion 42*f*, and separated skirt portion 42*g*) in order to prepare for withdrawal of the spout member and cap member from within the filling cavity 712 (FIG. 21); and then returns the spout member 38 of the filled container 30 (with the cap member 42 closing this spout member) to the position seen in FIG. 21 (substantially the same position as seen in FIG. 13) in which the gripping jaws 706 will open in order to release the filled container from the filling mechanism 700.

Considering now FIG. 13, and FIGS. 15–21 in sequence and in greater detail the filling head assembly 702 is seen to have a vertically extending generally tubular body 742, defining a vertical through bore 742*a*, in which the filling valve stem 724 is movably received. The bore 742*a* includes an enlarged diameter portion 742*b* into which a material flow passage 728 opens, communicating into a circumferential chamber 742*c*. The bore 742*a* also includes a conical portion 742*d* providing a conical valve seating surface, indicated also with the same numeral 742*d*. The seating surface 742*d* leads via a short cylindrical bore section 742*e*, and an outwardly stepped bore section 742*f*, to the filling cavity 712 which opens outwardly and downwardly on the filling head assembly 702.

The filling valve stem 724 is tubular in order to define a stepped outer diameter surface 724*a* leading to a conical seating surface 724*b*, and also defines a stepped through bore 724*c*. A pair of spaced apart grooves 744*a* and 744*b* receives a respective pair of O-ring sealing members, each indicated with the numeral 746.

Received into the bore 724*c* of the tubular filling valve stem 724 is the collet closer sleeve member 720. This sleeve member surrounds a collet assembly 718 including a unison member 718*a* and a plurality of collet fingers 718*b*.

When the gripper/elevator 704 is elevated to its second position, seen in FIG. 15, inserting the cap member 42 into the filling cavity 712, and the pair of O-ring seals member 714*a* and 714*b* sealingly engage with the surface 42*e* of this cap member 42. In this position of the cap member 42, the boss portion 44 of the cap member will have entered the lower extent of the collet assembly 718, but will not be secured to this collet because the collet fingers 718*b* are yet in their open position, as is seen in FIG. 13.

FIG. 15 depicts the result of the collet closer sleeve 720 being moved relative to the filling valve stem 724 from its first position seen in FIG. 13 and to its second position seen in FIG. 15. The collet fingers 718*b* consequently grasp into the groove 44*a* and the end edge surface 720*a*' of the collet closer sleeve 720 sealingly (i.e., forcefully) engages against the cap member 42 at axial step 44*b* and/or sealingly engages about radial shoulder 44*c* by engagement of this shoulder 44*c* within the bore 720*b*. As a result, the sterilizable surface area 46 of the cap member 42 is isolated both from ambient (i.e., by the pair of O-ring seals 714*a* and 714*b*), and from the environment within the collet closer sleeve.

Also, the sterilant circulation and flow path (generally indicated previously with the arrowed numeral 762) is opened from passages 760*a/b*, through the annular space 768 (FIG. 15*a*) and through the annular, radially extending space 770 extending across the sterilizable surface area 46 of the cap member 42. Consequently, sterilant flows across and sterilizes the sterilizable surface area 46 of cap member 42. Again, the return side of the passages 760*a/b* will be closed during this sterilizing supply of sterilant to surface area 46. Also, during sterilization, the flange portion 42*c* extends across the interface or sealing line 42*a*' defined by the cylindrical portion 42*a* of the cap member 42 and the spout member 38. Consequently, no still-viable microbes may be forced past this sealing interface and into the chamber 36 of the container 30.

Next, the gripper/elevator 704 moves from its second position to its third position (FIGS. 16 and 16*a*), in which the cap member 42 is brought fully into the filling cavity 712 and into engagement with the downwardly disposed surface of step 742*f*, eliminating the annular space 770. This movement of the spout 38 and cap member 42 brings the radial shoulder 42*h* of the cap member into forceful engagement with a downwardly disposed surface 712*a* surrounding the filling cavity 712, and results in the flange portion 42*c* of the cap member 42 being subjected to elongating stress (FIG. 16*a*). This stress on the frangible flange portion 42*c* fractures this flange portion so that the skirt portion 42*g* is separated from the plug portion 42*f*. Also, the skirt portion 42*g* is moved axially downwardly along the spout member 38 to the position (a second position) seen in FIG. 16*a*, in which the fractured edge 42*c*' of the flange portion 42*c* catches on the radial lip 38*h* of the spout member 42. Thus, the skirt portion 42*g* is captured on the spout member 42 in this second position.

FIG. 17 illustrates that the collet assembly 718 and collet closer sleeve 720 are next moved together in unison to their second positions relative to the filling valve stem 724. This movement of the collet assembly 718 withdraws the plug portion 42*f* from within the spout member 38 and sealingly draws this plug portion axially into the plug portion recess 722 of the filling valve stem 724.

FIG. 18 now shows that the filling valve stem 724 is moved to its second position opening the material flow path 726 to the spout member 38 and passage 40 of this spout member 38. Consequently, material flows from conduit 728 into the chamber 36 of the container 30, as is depicted by the flow arrows on FIG. 18.

FIG. 19 illustrates that the filling valve stem 724 is next returned to its first or closed position (an intermediate throttling position, and throttling step in the filling of the container 30 may optionally be employed), stopping flow of material into the container 30. FIG. 19 also shows that the collet assembly 718 and collet closer sleeve 720 are advanced downwardly relative to the filling valve stem 724 so that the collet assembly 718 is returned to its first position, returning the plug portion 42*f* to its original position within and closing the spout member 38.

FIGS. 20 and 20*a* illustrate that the gripper/elevator 704 is next lowered to its fourth position (substantially the same as the second position) allowing the collet assembly 718 and collet closer sleeve 720 to push the spout member 38 and cap member 42 (now consisting of separate plug portion 42*f* and skirt portion 42*g*) slightly out (i.e., downwardly, viewing the drawing Figures) of the filling cavity 712. This downward movement of the spout member 38 and cap member 42 once again opens up the annular space 770 extending across the portion of the sterilizable surface 46 which remains with plug member 42*f*, and across the exposed end edge surface of the spout member 38, as is seen in FIG. 20*a*.

In this position of the cap member, the material flush flow path 730 (passages 772) and/or sterilant flow path 762 are employed to introduce a sterile flushing material (sterile water or steam perhaps) along one of the pair of passages 772, while the other of the pair of passage 772 is employed as a flush outlet passage. Sterile steam or another sterilant may also be introduced along the sterilant flow path 762 as described earlier in order to assist in agitating and removing any material still resident on the outside of the cap member 42 and on the exposed end edge surface of the spout member 38. This flushing flow results in the flushing fluid, sterilant, and removed material flowing out of the other one of the pair of passages 772, as is indicated by the arrows on FIG. 20*a*.

And finally, FIG. 21 depicts that the collet closer sleeve 720 is next elevated (i.e., raised) to its first position relative to the filling valve stem 724, allowing the collet assembly 718 to open and release the cap member 42 (actually releasing the now separate plug portion 42*f* of this cap member 42). Subsequently, the gripper/elevator 704 is lowered to its first position (as was seen in FIG. 13) and the gripper jaws 706 are opened to their first position (also as seen in FIG. 13) so that the filled container 30 can then be removed from the filling mechanism 700 to be moved to a place of storage or prepared for shipment.

An Alternative Embodiment

An Overview of a Container

Referring first to FIG. 22, a container 50 of the flexible bag type is illustrated. It is to be noted that FIG. 23 illustrates a cap member 62 of this container in isolation. This container 50 includes a pair of walls 52, 54 cooperatively defining a variable-volume cavity or chamber 56 (the cavity being collapsed in FIG. 22). A tubular spout member 58 is sealingly attached to the wall 52, and defines a passage 60 communicating with the cavity 56. The spout member 58 sealingly receives therein a cap member 62, and outwardly defines a radially extending collar 58*a* having a circumferentially continuous outer surface. The cap member 62 is generally configured as a plug and includes a cylindrical portion 62*a* which is received sealingly into the passage 60 within of the spout member 58. The cylindrical portion 62*a* of cap member 62 includes a pair of axially spaced apart sealing ring portions, each indicated with a respective arrowed numeral 62*b* and 62*c*. Between the sealing rings 62*b* and 62*c*, the cylindrical portion 62*a* defines a radially outwardly opening groove 62*d*. When the cap member 62 is received sealingly into the passage 60 of the spout member 58, this groove 62*d* cooperates with the spout member 58 to define a circumferential gas storage chamber 62*e*.

The cap member 62 includes an upper wall portion 62*f* which spans and closes the cylindrical portion 62*a*. Wall portion 62*f* defines an upwardly extending boss portion 64, which defines a radially outwardly opening groove 64*a*. Circumscribing the boss portion 64, the cylindrical portion 62*a* includes an upper extent 62*g*, which provides both an axially disposed sealing end surface 62*g*' and a radially inwardly disposed (i.e., disposed radially inwardly toward the boss portion 64) sealing surface 62*g*".

In order to provide for a volume of pressurized gas communicating with the chamber 62*e*, the cylindrical portion 62*a* defines a gas port 66 communicating between the chamber 62*a* and a cavity 68 internal of the cylindrical portion 62*a*. This cavity is closed by a lower wall member 70 inserted into a stepped lower extent 68*a* of the cavity 68 and sealingly secured (i.e., by plastic welding perhaps) in place.

As is best seen in FIG. 23, the upper wall portion 62*f* is configured with a relatively thin, flexible, diaphragm portion 72, which in its undistorted, unstrained condition is outwardly concave. However, when the cap member 62 is internally pressurized, as is best seen in FIG. 22, this diaphragm portion 72 is outwardly convex. Accordingly, the diaphragm portion 72 serves as a visible and as a tactile test button for pressurization of the cap member 62. That is, a user of the package 50 can confirm that the cap member holds internal pressure by either looking at or touching the diaphragm portion 72. So long as the portion 72 is outwardly convex (i.e., protruding), then the cap member 62 is internally pressurized.

Another Embodiment of Filling Mechanism

Turning now to FIGS. 24–27, a filling head 802 is shown. This filling head is configured for cooperating with a bag container as shown in FIG. 22 to fill the container with flowable material or product. Also, the filling head is configured to remove the cap member from the container, and to fill the chamber 68 with pressurized gas (or to refresh this gas charge) prior to returning the cap 62 member to sealing cooperation with the spout member 58. FIG. 24 shows a filling mechanism or filling system, generally indicated with the numeral 800.

Again, as is seen in FIG. 24, an empty flexible bag container 50 is depicted in engagement with the filling head 802, and in preparation to being filled with flowable product. The container is grasp by the filling mechanism, and is elevated into a filling cavity 812 of the filling head. The container 50 is moved by the elevator assembly 804 from a first position (similar to the position depicted in FIG. 1 for that embodiment) and to the second position seen in FIG. 24. In this second position a collet closer sleeve 820 associated with a collet assembly 818 sealingly engages with the cap member, isolating a central portion of the cap member from the sealing interface between the cap member and spout member. In this second position, the spout member 858 sealingly cooperates with the filling head 802 to isolate the interface of the spout member and cap member from ambient exterior to the filling head, so that portions of the outside surfaces of each of the spout member 58 and cap member 62 can be sterilized. This sterilizing step is illustrated in FIG. 24.

Viewing FIG. 24 in detail, it is seen that the collet assembly 818 includes a collet closer sleeve 820 cooperating with a plurality of collet fingers 818 so that these collet fingers grasp into the groove 64*a* of the boss portion 64 of the cap member (recalling FIGS. 22 and 23). The collet closer sleeve sealingly engages into the portion 64*g* of the cap member, so that the surface 64*g*″ is sealingly engaged against the outer diameter of the collet closer sleeve. In this position of the collet assembly on the cap member 62, and of the elevator assembly 804, the spout member 58 is received sealingly into the filling cavity 812, so that the collar 58*a* on the outer surface of this spout member is sealingly engaged into the filling cavity 812.

In this position of the spout member and cap member, sterilant flows (as is indicated by arrows on FIG. 24) via a sterilant inlet 860*a*, an annular chamber 860*b*, and a port 860*c*. This port 860*c* opens into an annular space 860*d* bounded inwardly by the collet closer sleeve 820 and outwardly bounded by the filling valve stem 824 of the filling head 802. The sterilant flows from annular space 860*d* in an annular chamber 870 across the annular sterilizable surface portion 66 of the spout member 58 and cap member 62, which surface portion 66 includes the circular line of sealing interface of these two members. During this flow of sterilant across this sterilizable surface area portion 66, still-viable microbes cannot be forced past the sealing interface of the cap member and spout member because of the presence of pressurized gas in chamber 62*e*. This pressurized gas may additionally be a gas which is bacteriostatic or is toxic to microbes. Thus, the continued sterility of the inside of the container 50 is assured. Sterilant exits the annular chamber 870 into an exhaust manifold 890, and exits the filling head 802 from the manifold 890 via an exhaust outlet 892.

The elevator assembly 804 then moves the spout member 58 to a third position seen in FIG. 25, at which an axial surface of the collar 58*a* may sealingly engage with a confronting surface of the filling head 802. Alternatively, the circumferential surface of the spout member 58 above the collar 58*a* may sealingly engage into the bore 842*a* of the filling valve body 842. The filling valve stem 824 provides a cap member recess 822, into which the cap member 62 is slidably received. That is, as is seen in FIG. 26, the collet assembly 818 is moved upwardly relatively to the filling valve stem 824, so that the cap member 62 is withdrawn from within the spout member 58, and is drawn axially upwardly into the recess 822 of the filling valve stem 824. The filling valve stem 824 is itself tubular in order to define the chamber 860*b*.

FIG. 26 depicts the result of the collet assembly 818 being moved upwardly relative to the filling valve stem 824 from its position seen in FIG. 25 and to its position seen in FIG. 26. This movement of the collet assembly 818 and collet closer sleeve 820 withdraws the cap member 62 from within the spout member 58 and draws this plug portion axially (i.e., by vertical relative movement, viewing the drawing Figures) into the cap member recess 822 within the lower extent of the filling valve stem 824.

Now, the filling valve stem 824 is moved to its second position, opening material flow from the inlet 826 into the container 50 (FIG. 27). This movement takes place in unison with the collet assembly 818, collet closer sleeve 820, and cap member 62 within cap member recess 822. In order to facilitate this axial movement of the filling valve stem 824, the filling valve head 802 defines a sterilant gland chamber 894, through which the filling valve stem 824 reciprocates. This sterilant gland chamber 894 has an inlet port 894*a* into which sterilant is supplied, and an outlet port 894*b* from which the sterilant exits the filling head 802.

Consequently, material flows from supply path 826 into the chamber 56 of the container 50, as is depicted by the flow arrows on FIG. 27. When the container 50 is filled, the filling valve stem is returned to its closed position, as seen in FIG. 26. Subsequently, it is noted that the port 890*c* communicates with chamber 68 within the cap member 62. This communication is utilized to introduce a charge of pressurized gas into this chamber 68. Next, collet assembly 818 and collet closer sleeve 820 are next advanced downwardly relative to the filling valve stem 824 so that the collet assembly 818 is returned to its position returning the cap member 62 to its original position within and closing the spout member 58 (FIG. 25). Next, gripper/elevator 804 is again lowered to its position seen in FIG. 24, and the surfaces of the spout member and cap member which are exposed to flowable product or material are cleaned to remove any residue of this material or product. Finally the collet closer sleeve 820 is elevated to its first position relative to the filling valve stem 824 and collet assembly 818, allowing the collet assembly 818 to open and release the cap member 62. And, the gripper/elevator 804 is lowered to its first position (not seen in the family of drawing Figures including FIGS. 24–27, but similar to that seen in FIG. 1) and the gripper jaws 806 are opened to release the filled container 50.

Yet Another Alternative Embodiment—an Overview of a Container

Referring now to FIGS. 28–30 taken in conjunction, and considering first FIG. 28, another embodiment of a container 80 of the flexible bag type is illustrated. This container 80 is substantially similar to the container depicted and described with reference to FIGS. 1–10, and is usable with a filling head as thus depicted, with one distinctive difference for both the container and filling head. Viewing FIG. 28, it is seen that the spout member 88 includes on passage 90 a plurality of circumferentially spaced apart, radially inwardly and circumferentially extending locking lugs 74. Similarly, the cylindrical portion 92*a* of the cap member 92 includes a circumferentially extending and radially outwardly extending plurality of circumferentially spaced apart locking tabs 76. As FIG. 28 depicts, when the locking tabs 76 are each aligned axially with a gap between the locking lugs, then the cap member 92 may be engaged onto the spout member 88, as is indicated by the arrow on FIG. 28. FIG. 29 shows the result of engaging the cap member 92 onto the spout member 88, with proper rotational alignment of the locking tabs and locking lugs, and with no relative rotation after engagement. As FIG. 30 depicts, the cap member 92 may be separated into a separate plug portion 92*f*, and separate skirt portion 92*g* (i.e., by a filling mechanism). Further, the plug portion is removable axially from the bore 90 of the spout member 88, just as with the first embodiment disclosed above (indicated by an upwardly directed arrow on FIG. 30).

However, once the container 80 is filled, the plug portion 92*f* is engaged into the spout member 88, first with an axial movement (arrowed on FIG. 30) followed by a relative rotational movement of the plug portion 92*f* relative to the spout member 88 (also arrowed on FIG. 30). The result is that the plug portion 92*f* is locked securely into the spout member 88. Subsequently, in order to remove the plug portion 92*f* from the spout member 88, a relative rotational movement must be applied, followed by an axial pulling of the plug portion from within the spout member 92.

FIGS. 28–30 indicate that in order for a filling mechanism to be able to lock the cap member 92 into the spout member 88, the filling head must be capable of applying a relative rotation between the plug portion 92*f* and the spout member 88.

Still Another Alternative Embodiment Of A Container

Referring now to FIGS. 31–35 taken in conjunction, and considering first FIG. 31, another embodiment of a container 110 of the flexible bag type is illustrated. This container 110 is substantially similar to the container depicted and described with reference to FIGS. 1–10, and is usable with a filling head as thus depicted, with one distinctive difference for the container. Viewing FIG. 31, it is seen that the spout member 118 includes a passage 120 with a circumferential groove 120*a* providing for receipt in sealing cooperation with a circumferential rib 118*f'* defined on a tubular portion 122*a* of a cap member 122.

However, as is seen in FIG. 31, the cap member 122 includes a central, axially elongate stem 122*i*, which extends inwardly of the spout member 118 into the cavity 116. This stem 122*i* carries a disk-like, yieldably resilient wiper member 122*j*. The wiper member 122*j* has an outer diameter that is slightly larger than that of the bore 120, including that portion of the bore 120 which defines the groove 120*a*. Thus, the wiper member 120*j* must be elastically distorted in order to pass through the bore 120 (viewing FIGS. 33 and 35 for a moment to see how this disk-like wiper member distorts to a shallow conical shape as it passes through passage 120).

Thus, as is indicated and arrowed on FIG. 31, the cap member 122 is placed upon spout member 118, with the disk-like wiper member 122*j* distorting elastically to allow this wiper member 122*j* to pass through bore 120 and into the cavity 116 of the container 110 (viewing FIG. 32). Subsequently, a filling machine like that depicted and described above with reference to FIGS. 1–10 is able to separate the cap member into a plug portion 122*f* and a skirt portion 122*g*. The plug portion 122*f* is then removed from the spout member 118, as is depicted in FIG. 33, with the wiper disk taking a shallow conical shape in order to pass through passage 120. Once the plug portion 122*f* is removed from spout member 118 a sufficient distance, seen in FIG. 34, the wiper 122*j* returns substantially to its disk shape. After the container 110 is filled, the passage 120 will have a residue of material or product on the surfaces of this passage, including in groove 120*a*. Consequently, as the plug portion 122*f* is returned to its position of sealing closure of the spout member 118, the wiper disk 122*j* first passed inwardly through the passage 120 (FIG. 35), wiping the passage 120 and groove 120*a* substantially clean of product or material that has been placed into the container 110. Accordingly, the sealingly cooperable surfaces of the cap member and spout member are able to seal more effectively.

Another Alternative Embodiment of a Container

Referring to FIGS. 36–40, and viewing first FIG. 36, a container 910 of the flexible bag type is illustrated. It is to be noted that FIG. 36 illustrates a spout member 918 and a cap member 922 of this container 910 each in isolation. However, the spout member 918 and cap member 922 are oriented in FIG. 36 as they would be in preparation for closing the container 910 prior to sterilization of this container. That is, during manufacture of the container 910, the cap member is placed on the spout member, closing the cavity 916 from the ambient. Then, the entire container 910 is sterilized, for example, by irradiation, rendering the inside of this container free of viable microbes. This container 900 includes a pair of walls 912 and 914, just as the containers disclosed earlier did. However, these walls are not depicted in FIGS. 32–36, because only the spout member and cap member are depicted.

However, the cap member 922 has features in common with several of the embodiments depicted earlier. That is, cap member 922 includes a wall portion 922*b*, and a flange portion 922*c* carrying a sacrificial skirt portion 922*d*. The flange portion 922*c* outwardly defines an annular sterilizable surface area 926 for the cap member 922. Further, this flange portion, in conjunction with the skirt portion 922*d*, shields the sealing interface (i.e., a circular line of sealing interface) defined between the cap member 922 and spout member 918. The wall portion 922*b* includes a flexible diaphragm portion 972. A cylindrical plug portion 922*a* of the cap member 922 includes a pair of axially spaced apart sealing collars or lands 962*b* and 962*c*. These sealing lands 962*b* and 962*c* are spaced apart to cooperatively bound a radially outwardly opening groove 962*d*. A port 966 communicates from the groove 962*d* inwardly to a gas chamber 968 defined within the cylindrical portion 922*a*. A lower wall portion 970 closes the lower extent of the gas chamber 968.

Considering FIG. 36, it is seen that prior to assembly of the cap member 922 onto the spout member 918, the gas pressure chamber or cavity 968 is at ambient pressure, and the diaphragm portion 972 is outwardly concave. FIG. 37 shows that after assembly of the cap member 922 onto spout member 918, the gas chamber 968 is still at ambient pressure. This is true after the container 910 is sterilized, for example, by irradiation, and during shipping of the sterilized container to a user. Because the cap member 922 seals the spout 918, no microbes can enter the interior of the sterile container 900. As FIG. 38 shows, the cap member can be separated into a separate plug portion 922*f* and separate skirt portion 922*g*, with the separation being done within sterilizable area 926 after this area has been made sterile. During sterilization of the sterilizable area 926, the flange portion 922*c* shields the sealing interface line between the plug portion 922*f* and the spout member 918.

However, FIG. 39 shows that prior to being replaced into the spout member 918 (i.e., after the container 910 is filled with flowable product or material), the gas chamber 968 is pressurized with a charge or volume of pressurized gas, resulting in the diaphragm portion 972 becoming outwardly convex. This charge of pressurized gas is retained within the gas chamber 968 of the plug portion 922*f* after the plug portion is returned to sealing relationship with the spout member 918, as is illustrated by FIG. 40, so that the diaphragm portion 972 remains outwardly convex as long as sealing integrity of the plug portion 922 is maintained. Further, this gas pressure is communicated via the port 966 into the circumferential chamber 962*e* at groove 962*d*. That is, although the circumferential gas pressure chamber 962*e* alone could be employed to retain a charge of pressurized gas, a considerable extra margin of pressurized gas volume is provided by communication of the internal gas pressure chamber 968 to the chamber 962*e* via port 966.

Turning now to FIGS. 41–45 (including the enlarged partial views provided for some of these Figures), a filling mechanism 1000 for utilizing a container according to FIGS. 36–40 is presented. The filling mechanism 1000 has many features in common with filling mechanisms presented earlier herein, and also has the capacity to utilize a container with a spout and cap member having an internal gas pressure cavity within the cap member, and to pressurize this cavity in the process of filling a container. Further, this filling mechanism has the capacity to partially inflate a filled container as a near-final step in the process of filling the container. A partially inflated container may be preferable in some instances because sloshing of the contents of the container during shipping do not fatigue the walls of the container, and thus do not lead to these container walls cracking or breaking due to such fatigue.

Turning now to FIG. 41 and 41A, a filling mechanism 1000 is depicted in fragmentary cross sectional view. The mechanism 1000 includes a filling head assembly 1002, associated with a gripper and elevator assembly 1004. The filling head assembly 1002 defines a filling cavity 1012 into which the spout 918 and cap member 922 of the container 910 is received for filling. A collet assembly 1018 and collet closer sleeve 1020 provide for grasping the boss 924 of the cap member 922, as will be well understood now in view of earlier disclosure and description. A filling valve stem 1024 includes a plug portion recess 1022, and sealingly cooperates with the filling valve head body 1042 at two spaced apart seal members 1016 to bound a chamber 1048. However, as FIG. 41 shows, in this embodiment the filling valve stem 1024 itself includes a hollow wall, 1090, defining a circumferentially and axially extending chamber 1090*a*. The chamber 1090*a* includes an internal partition member 1092 dividing this chamber into a radially inner part 1090*a*' and a radially outer part 1090*a*". The parts of the chamber 1090 communicate with one another around the lower end 1092*a* of the partition member, as is best seen in FIG. 41A. Adjacent to an upper extent of the filling valve stem 1024 a pair of coolant ports 1094*a* and 1094*b*, communicates with the chamber 1090. One of the ports 1094*a* communicates with the inner chamber 1092*a*', while the other port communicates with the outer chamber 1092*a*". Thus, coolant flow introduced via port 1094*a* must flow lengthwise of the filling valve stem 1024 around the end 1092*a* of partition member 1092, and flow again lengthwise of this filling valve stem to reach the other port 1094*b*.

Close consideration of FIG. 41 will show that in this embodiment, the material chamber 1042*c* is defined within body 1042 of the filling head 1002. Further, the body 1042 has a hollow wall section 1096, forming a cooling jacket surrounding this material chamber 1042*c*, with an inlet port 1098*a* and outlet port 1098*b*, along with an internal partition member 1100 providing for coolant flow axially in this cooling jacket. The lower extent of the body 1042 is received sealingly in a vertically (i.e., axially) movable cup shaped portion 1102 of the filling head assembly. Vertical relative movements of the portion 1102 are indicated on FIG. 41A by the double headed arrow associated with this portion. This portion 1102 defines the filling cavity 1012, and provides both material flush ports 1030, as well as providing connections 1104 (to be further described below) for a gas pressure inflation system, which is effective to selectively inflate a filled container, or to inflate a plug portion before the plug portion is returned to sealing engagement within a spout member, or both.

FIGS. 42 and 42A depict engagement of the spout 918 and cap 922 into the filling cavity 1012, with the collet closer sleeve 1020 in a position relative to the filling valve stem 1024 in which the sterilant flow path 1062 is opened (noting the groove 1024*d* on the inside of the filling valve stem 1024, and alignment of O-ring 1046 with this groove). Thus, sterilant flows to and across the sterilizable area 926 of the cap member 922 (i.e., in chamber 1072, and flows out the passages 1072. During this flow of sterilant across this sterilizable surface area portion 926 still-viable microbes cannot be forced past the sealing interface of the cap member and spout member because of the presence of the flange portion 922*c*. Thus, the continued sterility of the inside of the container 910 is assured.

FIG. 43 shows that the elevator assembly 1004 then moves the spout member 918 to a position in which a knife edge 1074 (best seen in FIG. 42A) cuts the flange portion 922*c* to separate plug portion 922*f* from skirt portion 922*g*. Subsequently, the collet assembly 1018 and collet closer sleeve 1020 are together moved upwardly relative to the filling valve stem 1024, drawing the plug portion 922*f* into the plug portion recess 1022 of the filling valve stem 1024. This filling valve stem 1024 it then moved upwardly from its position seen in FIGS. 41 and 42 to the position seen in FIG. 43, opening material flow from the chamber 1042*c* into the cavity 916 of the container 910, as is depicted by the flow arrows on FIG. 43. A material pipeline 1028 connects into the chamber 1042*c*, as will be understood in view of FIG. 43 and the depiction and description set out above.

FIG. 44 illustrates that once the container 910 is filled with flowable material or product introduced via the filling head assembly 1002 and along the passage 920 of the spout 918, this same filling head may be used to selectively inflate the bag container 910, so as to reduce or eliminate the effects on the walls of the container of sloshing of the contents of this container. This inflation would preferably be effected using a sterile gas. Considering FIG. 44, and especially FIG. 44A, it is seen that the lower member 1102 has been lowered (by lowering of the gripper and elevator assembly 1004) to a position as illustrated, in which the member 1102 cooperates with the filling head body portion 1042 to define a chamber 1106. The ports 1104 open into the chamber 1106. As is seen in FIG. 44A, the chamber 1106 communicates via a gap 1106*a* defined between the member 1102 and the lower extent of the filling head body portion 1042 to the passage 920 of the spout member 918. Thus, in this relative position of the parts and components of the filling head 1002, pressurized gas introduced via the ports 1104 flows via chamber 1106 and gap 1106*a* into the cavity 916 of the container 910. This pressurized gas is introduced preferably at a relatively low regulated pressure, so as to inflate the walls of the container 910 outwardly and against whatever crate, box, or other shape-retaining protective vessel carries the bag container 910. Thus, the walls of the bag container are protected against being fatigued by sloshing of the contents of the container 910.

Now, FIGS. 45 and 45A illustrate that at a subsequent relative and cooperative position of the parts and components of the filling head assembly 1002, the chamber 1106 and gap 1106*a* provide communication of pressurized gas from ports 1104 into the gas pressure chamber 968 within the plug portion 922*f*. This cooperative position of the parts of the filling head assembly 1002 is achieved by slight lowering of the filling valve stem 1024 from its position of FIGS. 44, and to the relative position seen in FIGS. 45. Also, the collet assembly 1018 and collet closer sleeve 1020 are lowered slightly from their position seen in FIGS. 44 relative to the filling valve stem, and to the position seen in FIGS. 45. This effectively protrudes the plug portion 922*f* slightly from within the plug portion recess 1022 of the filling valve stem, and sealingly introduces the lower one of the sealing lands 962*b* into the spout 918. Land 962*c* remains sealingly received within the plug portion recess 1022 of the filling valve stem 1024. Thus, pressurized gas (now at a higher pressure) communicated from chamber 1106 is isolated from the cavity 916 of the container 910. However, the groove 962*d* of the plug portion is aligned with a circumferential chamber 1108, communicating with chamber 1048 between the seals 1016, and communicating with gap 1106*a*. The chamber 1108 surrounds the downwardly protruding part of the plug portion 922*f*. Thus, pressurized gas supplied to ports 1104 is communicated into the chamber 968 of the plug portion 922*f*. It should be noted at this time that the invention is not limited to this disclosed combination and cooperation of components in order to gas charge the plug portion 922*f*. A number of alternatives and equivalents may be employed to introduce a charge of pressurized gas into the plug member 922*f*.

Subsequently, the filling head assembly 1002 returns the plug portion 922*f* fully into its sealing position within spout 918. Once the plug portion 922*f* is returned to this sealing position within the spout member 918, the chamber 968 serves to supply pressurized gas to the circumferential chamber 962*e*. This pressurized gas provides both a barrier against microbes traveling along the interface between the spout member and plug portion, and indicates by causing the diaphragm portion to remain outwardly convex that the chamber 968 remains pressurized. Thus, a user of the container 910 can confirm that the sealing integrity of the plug portion 922*f* and spout member 918 is effective.

Those skilled in the art will further appreciate that the present invention may be embodied in other specific forms without departing from the spirit or central attributes thereof. Because the foregoing description of the present invention discloses only particularly preferred exemplary embodiments of the invention, it is to be understood that other variations are recognized as being within the scope of the present invention. Accordingly, the present invention is not limited to the particular embodiments which have been described in detail herein. Rather, reference should be made to the appended claims to define the scope and content of the present invention.

We claim:

1. A container comprising a flexible wall defining a variable-volume chamber, and a spout member attaching to said wall and providing a passage communicating with said variable-volume chamber, a cap member sealingly cooperating with said spout member to define a line of sealing interface and to close communication along said passage, and said cap member including a continuous flange portion radially extending across and shielding the line of sealing interface of said cap member with said spout member, wherein said cap member further includes a circumferentially continuous skirt portion depending continuously from said flange portion about the entire circumference to extend axially along an outer surface of said spout member.

2. The container of claim 1 wherein said cap member further carries a dispensing spigot outwardly disposed on said cap member, and said dispensing spigot defining a dispensing passage communicating with said variable-volume chamber.

3. The container of claim 1 wherein said cap member outwardly presents a boss providing for grasping of said cap member to apply an axially directed removing force to said cap member, whereby said boss may be grasped and said cap member may be removed axially from said spout member.

4. The container of claim 1 wherein said cap member further defines an outwardly disposed sterilizable surface disposed annularly between a radially outer sealingly engageable surface of said cap member and a radially inner sealingly engageable surface of said cap member.

5. The container of claim 1 wherein said flange portion includes an annular fine-dimension section, and said skirt portion is separable from said remainder of said cap member by fracture of said fine-dimension flange section.

6. The container of claim 1 wherein each of said spout member and said cap member further includes cooperable locking structures, and said cap member is retained on said spout member when said cooperable locking structures are cooperatingly engaged with one another.

7. The container of claim 1 wherein said spout member defines an interior surface bounding said passage, and said cap member further includes a wiper structure sized and configured to pass along said passage in response to engagement or disengagement of said cap member upon said spout member, and said wiper structure further is engageable with said interior surface of said passage during said passing of said wiper structure along said passage in order to wipe said interior surface.

8. The container of claim 1 wherein said cap member defines with said spout member another line of sealing interface spaced inwardly along said passage, and an annular chamber interposed between said line of sealing interface and said another line of sealing interface.

9. The container of claim 8 wherein said cap member and said spout member further cooperate with one another to sealingly retain a volume of pressurized gas in said annular chamber between said line of sealing interface and said another line of sealing interface.

10. The container of claim 9 wherein said cap member further defines an internally disposed cavity for receiving an additional volume of pressurized gas, and a port communicating said cavity with said annular chamber.

11. The container of claim 10 further including a flexible diaphragm portion having a face exposed to said pressurized gas, and said flexible diaphragm portion being outwardly convex when said pressurized gas acts on said face.

12. The container of claim 10 wherein said flexible diaphragm portion has an inherent undistorted or unstrained configuration, and in said inherent configuration said flexible diaphragm portion is outwardly concave.

13. A container comprising a flexible wall defining a variable-volume chamber, and a spout member attaching to said wall and providing a passage communicating with said variable-volume chamber, a cap member sealingly cooperating with said spout member to define a first outer line of sealing interface and an axially spaced second inner line of sealing interface, and said cap member cooperating with said spout member to define an annular chamber interposed between said first line of sealing interface and said axially spaced second line of sealing interface, and wherein said cap member and said spout member further cooperate with one another to sealingly retain a volume of pressurized gas in said annular chamber between said first line of sealing interface and said axially spaced second line of sealing interface.

14. The container of claim 13 wherein said cap member further defines an internally disposed cavity for receiving an additional volume of pressurized gas, and a port communicating said cavity with said annular chamber.

15. A method of filling a container including a flexible wall defining a variable-volume chamber, a spout member attaching to said wall and providing a passage communicating with said variable-volume chamber, a cap member sealingly cooperating with said spout member to close communication along said passage, said method including steps of:

providing said cap member with a radially extending flange portion radially extending across and shielding a line of sealing interface of said cap member with said spout member;

providing a skirt portion depending from said flange portion to extend along an outer surface of said spout member; and separating said cap member into a plug portion which sealingly closes said passage and a separate skirt portion disposed about said spout member.

16. The method of claim 15 in which said separating step is accomplished by the step of cutting said skirt portion from said plug portion.

17. The method of claim 15 in which said separating step is accomplished by the step of fracturing said skirt portion from said plug portion.

18. The method of claim 15 in which said separating step is accomplished by the step of axially elongating said flange portion along said spout member to and beyond the point of breakage of said flange portion in order to separate said skirt portion from said plug portion.

19. A method of filling a sealed container having a flexible wall bounding a variable-volume chamber, and a spout member attaching to said wall and providing a passage communicating with said variable-volume chamber, and a cap member sealingly cooperating with said spout member to close communication along said passage, the cap member having an annular outer sealingly engageable surface thereon, said method comprising steps of:

providing a filling head having a sealing ring adapted to sealingly engage the outer sealingly engageable surface of said cap member, and a sterilization chamber within the sealing ring;

engaging the filling head with the spout member so that the sealing ring of the filling head sealingly engages the outer sealingly engageable surface of the cap member;

providing a sterilant in said sterilization chamber to sterilize at least a radially outer surface area portion of the cap member; within the sterilized surface area portion of the cap member separating the cap member into a central plug portion and an annular skirt portion;

withdrawing the plug portion from said spout member; and flowing flowable material along said passage into said variable-volume chamber.

20. The method of claim 19 further including the steps of:

providing said cap member with an inner sealingly engageable surface within said annular outer sealingly engageable surface, and utilizing said inner sealingly engageable surface and said annular outer sealingly engageable surface to bound said sterilizable surface area portion of said cap member to the shape of an annular area.

21. The method of claim 20 further including the steps of:

providing said filling head with an inner annular sealing ring adapted to sealingly engage with said inner sealingly engageable surface, and sealingly engaging said inner annular sealing ring with said inner sealingly engageable surface to limit contact of said sterilant to said annular sterilizable surface area of said cap member.

22. The method of claim 19 further including the steps of:

utilizing said cap member to cooperatively define with said spout member a first outer line of sealing interface;

utilizing said cap member to cooperatively define with said spout member an axially spaced second inner line of sealing interface; and defining an annular chamber interposed between said first line of sealing interface and said axially spaced second line of sealing interface.

23. The method of claim 22 further including the step of: sealingly retaining a volume of pressurized gas in said annular chamber between said first line of sealing interface and said axially spaced second line of sealing interface.

24. The method of claim 23 further including the steps of:

defining within said cap member a cavity for receiving an additional volume of pressurized gas, and providing a port communicating said cavity with said annular chamber.

25. The method of claim 17 including the steps of:

utilizing said cap member and said spout member to cooperatively define a circular line of sealing interface, providing said cap member with a flange portion extending radially across and shielding said line of sealing interface, and utilizing said flange portion to prevent flow of sterilant to said line of sealing interface between said cap member and said spout member during sterilization of said sterilizable surface area portion.

26. A filling apparatus for cooperating with a bag container having a flexible wall bounding a variable-volume chamber, a spout member attaching to said wall and providing a passage communicating between ambient and said variable-volume chamber, and a cap member sealingly cooperating with said spout member to close communication through said passage, said cap member including a radial flange portion extending radially across and shielding a circular line of sealing interface between said spout member and said cap member, and a skirt portion depending from said flange portion along an outer surface of said spout member; said filling apparatus providing in combination:

a grasping structure for holding said container, spout member, and cap member in a selected position;

an isolating structure for isolating a selected surface area portion of said cap member from ambient, said selected surface area portion including at least a part of said flange portion; sterilizing flow path structure for delivering a sterilant to said selected surface area portion of said cap member; and a cap separating structure for separating said cap member at said radially extending flange portion into a radially inner plug member and a radially outer skirt portion;

a plug portion pulling structure for removing said plug portion from sealing cooperation with said spout member; and a material flow path structure for delivering a flowable material along said flow path and along said passage into said variable-volume chamber.

27. The filling apparatus of claim 26, further including said filling apparatus providing pressure manifold structure for providing a pressurized fluid selectively into a selected one of said bag container and said plug portion.

28. The filling apparatus of claim 26, further including said filling apparatus providing a filling head body movably carrying a filling valve stem, said filling valve stem being selectively movable between a first position in which said material flow path structure is closed to flow of material into said variable-volume chamber, and a second position in which material flows from said material flow path structure into said variable-volume chamber of said bag container, said filling head body and said filling valve stem cooperatively defining in said first position of said filling valve stem, an annular chamber which is sealingly isolated both from said flow path structure and from said variable volume chamber, and a respective passage communicating with said annular chamber.

29. The filling apparatus of claim 26, further including said filling apparatus providing a cooling jacket structure surrounding at least a portion of said material flow path structure.

30. A method filling a flexible bag container, said flexible bag container including a pair of walls sealingly attached to one another so as to cooperatively define a chamber therebetween, a spout member sealingly attached to one of said pair of walls at an opening therein, and said spout member defining a passage therethrough communicating with said chamber, said spout member carrying a cap member sealingly closing said spout member, said method comprising steps of:

providing said cap member with a wall portion spanning and closing said passage, a cylindrical portion sealingly received within said passage, a flange portion extending radially outwardly from said cylindrical portion, and a skirt portion depending from said flange portion along an outer surface of said spout member; and separating said cap member within said flange portion into a plug portion including a central part of said wall portion and said cylindrical portion, and a separate skirt portion.

31. The method of claim 30 further including the step of providing said cap member with a gas pressure chamber disposed within said cylindrical portion.

32. The method of claim 31 further including the step of moving said separate skirt portion axially along said spout member away from said flange portion after separation of said skirt portion from said plug portion.

33. The method of claim 30 further including the step of providing said cap member skirt portion with a cylindrical outer surface which is sealingly engageable.

34. The method of claim 30 further including the step of providing said cap member with an outwardly extending central boss portion, and providing on said central boss portion a structure allowing the cap member to be grasped for withdrawal of said plug portion from said spout member.

35. The method of claim 34 including the step of configuring said structure on said cap portion which allows grasping of said plug portion to also include a radially outwardly opening circumferential groove circumscribing said boss portion.

36. A flexible bag container comprising:

a pair of opposed flexible walls sealingly attached to one another so as to form an expansible chamber therebetween;

a tubular spout member attached to one of said pair of walls, said tubular spout member defining a through passage and defining an axis along the length of said through passage; and a cap member attached to the spout member, and said cap member including a plug portion sealingly disposed within said spout member to cooperatively define a circular line of sealing interface with said spout member, said cap member further including radially outwardly extending shield structure extending outwardly from said plug portion to overly said circular line of sealing interface, and wherein said skirt portion is separable from a remainder of said cap member.

37. A filling apparatus for cooperating with a bag container having a flexible wall bounding a variable-volume chamber, a spout member attaching to said wall and providing a passage communicating with said variable-volume chamber, and a cap member sealingly cooperating with said spout member to close communication through said passage, said filling apparatus comprising:

a filling head providing a material flow path for delivering a flowable material into said variable-volume chamber;

said filling head including a body movably carrying a filling valve stem selectively movable between a first position in which said material flow path is closed and a second position in which material flows from said material flow path into said variable-volume chamber;

said filling head body and said filling valve stem cooperatively defining in said first position of said filling valve stem an annular chamber disposed along said filling valve stem and which is sealingly isolated both from said material flow path and from said variable-volume chamber; and a passage communicating with said annular chamber.

38. The filling apparatus of claim 37, further including a respective flow path communicating with said passage for providing a pressurized fluid into said annular chamber.

39. The filling apparatus of claim 37, further including a respective flow path communicating with said passage, and a device associated with said respective flow path for sensing a pressure level in said annular chamber.

* * * * *